United States Patent [19]

Ishida et al.

[11] Patent Number: 5,006,890

[45] Date of Patent: Apr. 9, 1991

[54] IMAGE FORMING APPARATUS WITH A PROVISION FOR DESIGNATING DIFFERENT COLORED IMAGE AREAS

[75] Inventors: Masato Ishida, Yokohama; Hiroaki Takeda, Kawasaki; Kazuo Watanabe; Akira Suzuki, both of Yokohama; Nobuyuki Suzuki, Musashino; Isamu Sato; Kazuki Miyamato, both of Yokohama, all of Japan

[73] Assignee: Canon Kabushiki Kaisha, Tokyo, Japan

[21] Appl. No.: 401,569

[22] Filed: Aug. 29, 1989

Related U.S. Application Data

[63] Continuation of Ser. No. 930,911, Nov. 17, 1986, abandoned.

[30] Foreign Application Priority Data

| | | | |
|---|---|---|---|
| Nov. 18, 1985 | [JP] | Japan | 60-258107 |
| Nov. 18, 1985 | [JP] | Japan | 60-258108 |
| Nov. 18, 1985 | [JP] | Japan | 60-258113 |
| Nov. 18, 1985 | [JP] | Japan | 60-258114 |
| Nov. 18, 1985 | [JP] | Japan | 60-258115 |
| Nov. 18, 1985 | [JP] | Japan | 60-258116 |
| Nov. 18, 1985 | [JP] | Japan | 60-258118 |

[51] Int. Cl.[5] ..... G03G 15/00; G03G 15/01; G03G 15/04

[52] U.S. Cl. ..... 355/202; 355/218; 355/244; 355/328

[58] Field of Search ..... 355/202, 218, 244, 326, 355/328

[56] References Cited

U.S. PATENT DOCUMENTS

| | | | |
|---|---|---|---|
| 4,320,962 | 3/1982 | Takahashi et al. | 358/300 |
| 4,340,295 | 7/1982 | Nakamura | 355/7 |
| 4,417,805 | 11/1983 | Kishi | 355/7 |
| 4,627,707 | 12/1986 | Tani et al. | 355/218 |
| 4,685,794 | 8/1987 | Watanabe | 355/7 |
| 4,794,421 | 12/1988 | Stoudt | 355/202 |

FOREIGN PATENT DOCUMENTS

| | | | |
|---|---|---|---|
| 60-166969 | 8/1985 | Japan | 355/244 |
| 3159 | 1/1986 | Japan | 355/7 |
| 3183 | 1/1986 | Japan | 355/7 |

OTHER PUBLICATIONS

Research Disclosure, "Copying Machine", 22737, pp. 116–118, Mar. 1983.

*Primary Examiner*—Joan H. Pendegrass
*Attorney, Agent, or Firm*—Fitzpatrick, Cella, Harper & Scinto

[57] ABSTRACT

An image forming apparatus capable of incorporating a DF, an ADF or an RDF includes a digitizer for designating at least one area of an original, an image forming unit for forming an original image of the designated area on a transfer sheet, and a control section for adding a specific image to the designated area. The control section also allows a multi-copy or a two-sided copy operation for a plurality of designated areas with different colors. The apparatus also includes a memory, the area designation data of which is retained whether reset by a reset key or upon a power ON operation. In this case, only the designated areas are reset. The apparatus further includes a middle tray and a second sheet feeder, which are selectively used according to the types of sheets.

21 Claims, 49 Drawing Sheets

START
S7-15
RESET KEY ON?
Y
N
S7-16
COPY KEY ON?
N
Y
S7-17
ORIGINAL ?
N
Y
S7-18
FEED ORIGINAL
S7-19
FEED SHEET FROM 2ND SHEET FEEDER, EXECUTE COPY AND DELIVER SHEET OUT
S7-21
FEED SHEET FROM 2ND SHEET FEEDER, EXECUTE COPY AND DELIVER SHEET OUT
S7-22
FEED SHEET FROM 2ND SHEET FEEDER, EXECUTE TRANSPOR-TATION ONRY, AND DELIVER IT OUT
S7-20
DELIVER ORIGINAL OUT
END

FIG. 75
| NO. | SIZE OF ORIGINAL | CIRCUIT FOR DETECTING ORIGINAL | | |
|---|---|---|---|---|
| | | 12-1 | 12-2 | 12-3 |
| 1 | A3 | ON | ON | ON |
| 2 | B4 | ON | OFF | ON |
| 3 | A4 | ON | ON | OFF |
| 4 | B5 | ON | OFF | OFF |
| 5 | A4R | OFF | OFF | ON |
ON: DETECTION OF PRESENCE OF ORIGINAL
OFF: DETECTION OF ABSENCE OF ORIGINAL
FIG. 76
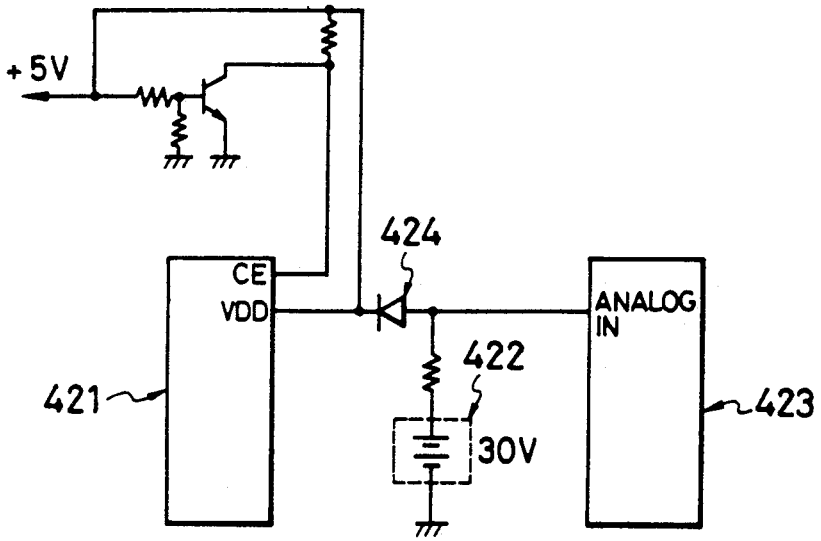
FIG. 77
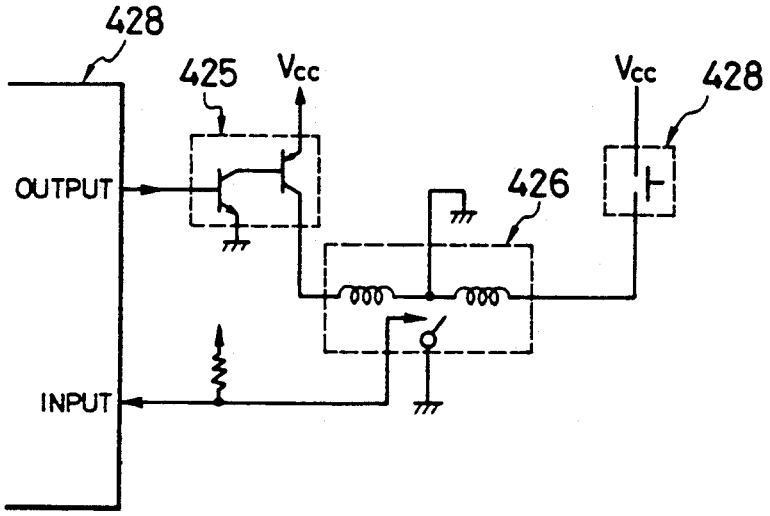

IMAGE FORMING APPARATUS WITH A PROVISION FOR DESIGNATING DIFFERENT COLORED IMAGE AREAS

This application is a continuation of application Ser. No. 930,911 filed 11/17/86, now abandoned.

BACKGROUND OF THE INVENTION

I. Field of the Invention

The present invention relates to an image forming apparatus such as a copying machine.

2. Description of the Related Art

In order to obtain a paint-out copy image like an image obtained by painting characters with a felt-tip marker, an original for the paint-out copy is separately prepared, and multi-copy operation must be performed, resulting in cumbersome and time-consuming operation that causes many copy errors.

Another conventional apparatus is proposed to designate a desired area so as to copy only the desired area of the original. However, if a plurality of areas are designated, colors cannot be assigned to these areas in one-to-one correspondence. For this reason, complicated manipulation is required such that the recording cycle must be repeated a plurality of times.

In a conventional copying machine, the multi-copy mode and the two-sided copy mode cannot be simultaneously selected. In another conventional copying machine having copy modes such as color, masking, and trimming copy modes, it may be assumed that these modes are combined, and that a copy cycle is performed in a combination of modes. For this purpose, it is assumed that the combination of modes is designated by a single key operation. However, in this case, there are a plurality of modes having identical functions. As a result, the operation may often be complicated.

In conventional copying machines, copy mode data is cleared when a reset key is turned on or when a predetermined period has elapsed. However, trimming data and masking data require complicated and time-consuming input operations. If an operator accidentally depresses the reset key or turns off the power switch, such data must be registered again, resulting in inconvenience.

The operator had been able to designate only one area in the conventional copying machines. However, when a function for designating a plurality of areas is developed, the positional relationship among the designated areas becomes unclear. As a result, it is difficult to obtain a desired image.

In order to designate a desired area on an editor such as a tablet for designating the original area and to obtain a multi-copy or two-sided copy image with different colors, the operator must operate both the operation sections of the editor and a recording apparatus. As a result, such a system has poor operability.

In a recording apparatus having a middle tray for temporarily storing recorded sheets, the middle tray cannot be used for the different types (e.g., sizes) of sheets or at the time of paper jam. Therefore, two-sided copy or multi-copy cannot be desirably performed.

SUMMARY OF THE INVENTION

It is an object of the present invention to provide an image forming apparatus which can eliminate the conventional drawbacks described above.

It is another object of the present invention to improve an image forming apparatus.

It is still another object of the present invention to provide an image forming apparatus capable of adding information on a sheet with a simple operation to emphasize the formed image.

It is still another object of the present invention to provide an image forming apparatus capable of combining a plurality of designated areas in different colors with a simple operation or of performing two-sided recording.

It is still another object of the present invention to provide an image forming apparatus capable of forming a desired image without omissions even if there are a plurality of designated areas.

It is still another object of the present invention to provide an image forming apparatus wherein data concerning the designated area cannot be easily lost and operability can be improved.

It is still another object of the present invention to provide an image forming apparatus for simplifying complicated image forming mode setting.

It is still another object of the present invention to provide an image forming apparatus capable of transporting a sheet along a suitable transporting path according to the types of sheets and of performing desired recording processing.

The above and other objects, features, and advantages of the present invention will be apparent from the following description and the appended claims in conjunction with the accompanying drawings.

BRIEF DESCRIPTION OF THE DRAWINGS

FIG. 4-1 is a diagram showing an LED array and its driver;

FIG. 4-2 is a view showing radiation from the LED array onto a drum;

FIG. 4-3 is a timing chart for explaining LED lighting;

FIG. 5-1 is a diagram showing an arrangement of an editor;

FIGS. 5-2 and 5-3 are diagrams of equivalent circuits of the editor when position designation is performed along the X and Y directions, respectively;

FIG. 75 is a view showing a method of detecting an original size;

FIGS. 76 and 77 are circuit diagrams for explaining the diagnosis operation of RAM 421.

DETAILED DESCRIPTION OF PREFERRED EMBODIMENT

General Description

Figure 1:
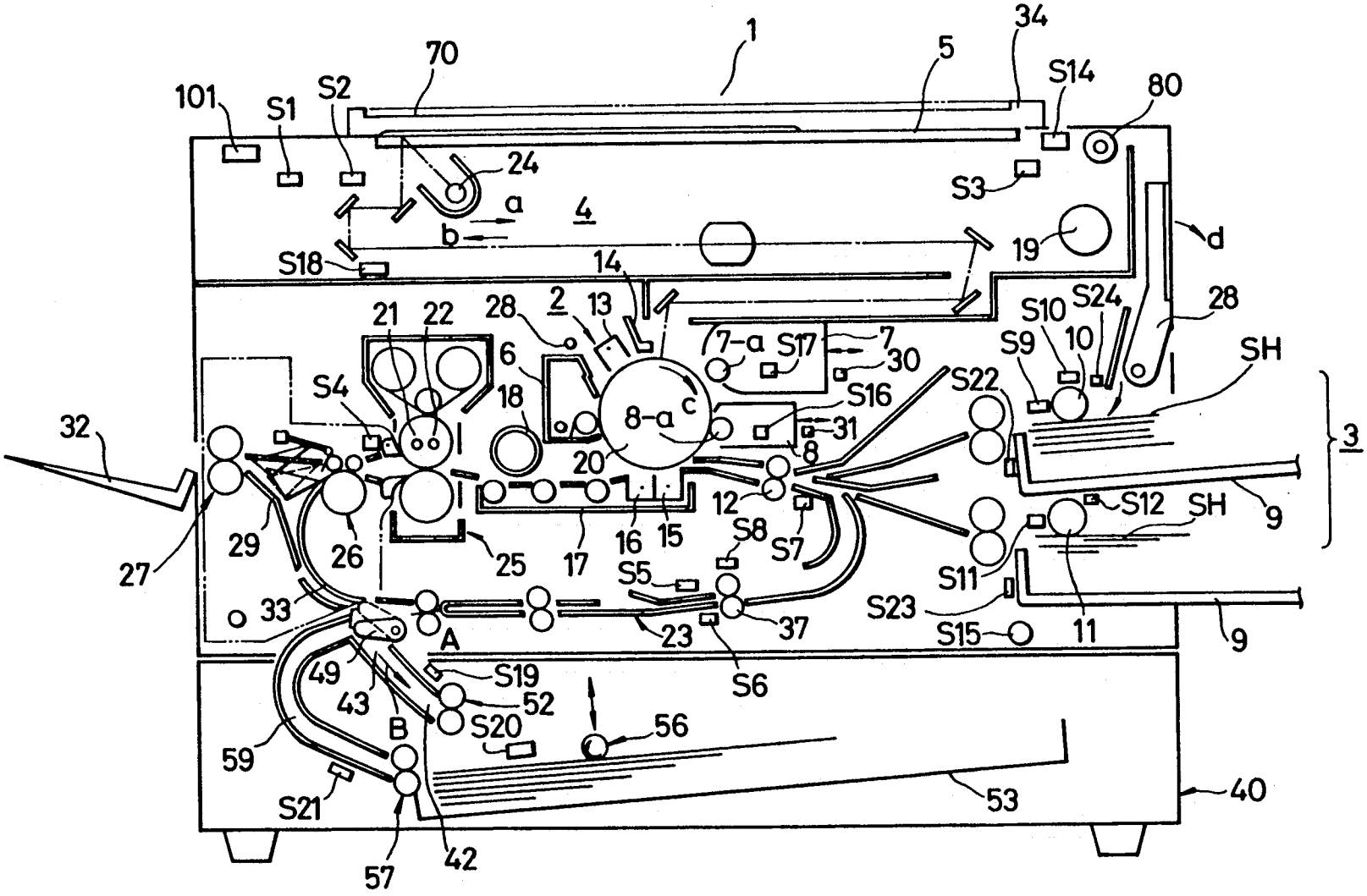
FIG. 1 is a schematic sectional view of a copying machine to which the present invention is applied.

FIG. 1 is a schematic view showing a copying machine according to the present invention. The main construction and positions of various sensors S1 to S24 are shown in FIG. 1. Referring to FIG. 1, the copying machine includes a housing 1, an image forming section including a photosensitive drum 20 as a major component, and first and second visualizing means, i.e. developers 7 and 8, respectively for containing toners of different colors (e.g., red and black). The selected one of the developers is brought into slidable contact with the drum 20. A paper feed section 3 feeds a transfer sheet SH inside the machine. The paper feed section 3 includes a paper cassette 9 detachably mounted on the housing 1, paper feed rollers 10 and 11, and sensors S9 to S12, S22, and S23. An optical system 4 exposes an original with light and includes a focusing lens for focusing an original image onto the photosensitive drum 20. The optical system 4 can be driven by an optical motor 19 along directions of arrows a and b. The copying machine also includes a fixing unit 25, a second sheet feeder 23 (to be described later), and a middle tray 40.

Figure 2:
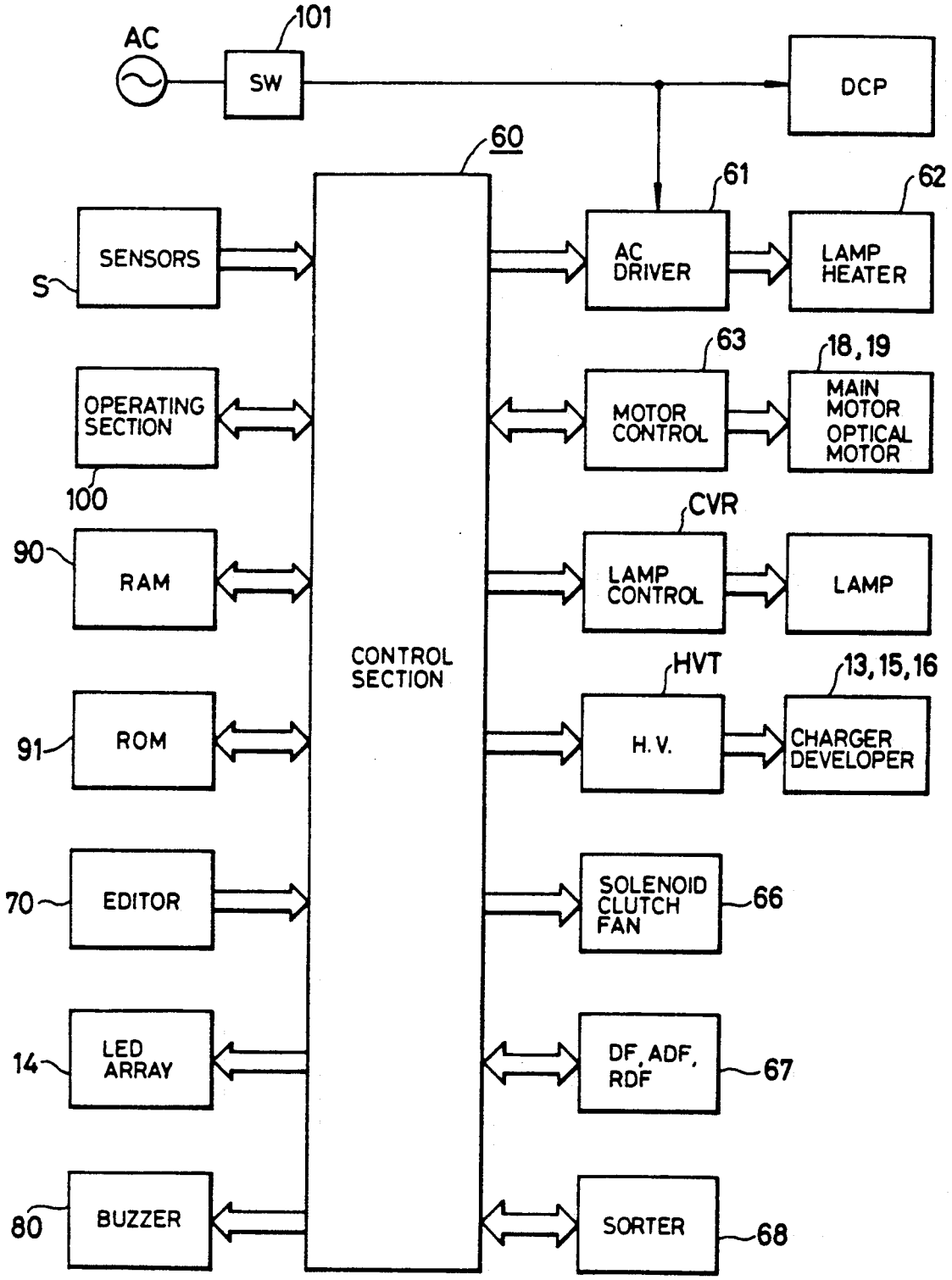
FIG. 2 is a schematic block diagram of a circuit of the copying machine in FIG. 1.

FIG. 2 is a block diagram of a control unit. The control unit includes a control section 60 as a main component. A main switch 101 is connected to an AC power source. The output terminal of the main switch 101 is connected to the input terminal of a DC power source DCP and to an input terminal of an AC driver 61. The driver 61 is connected to AC loads such as a lamp 24 and heaters 21 and 22. The output terminals of sensors S (S1 to S24 in FIG. 1) are connected to input ports of the control section 60. An operating section 100 arranged on the upper surface of the housing 1 is connected to the control section 60 to exchange data therewith. A RAM 90 for storing processed data and a RAM 91 for storing permanent programs are connected to the control section 60. The control section 60 is also connected to a coordinate input device (editor) to receive input coordinate data. The input terminal of a motor control section 63 is connected to an output terminal of the control section 60 to receive an instruction therefrom so as to control a main motor 18 and the optical motor 19. The input terminal of a lamp control section CVR is connected to the control section 60 to receive an instruction therefrom so as to control a lamp. A high voltage generator HVT is also connected to the control section 60 to receive an instruction so as to control chargers 13, 15, and 16 and the developers 7 and 8. The control section 60 is further connected to loads such as a solenoid, a clutch, and a fan so as to control them. An original processing device 67 and a sorter 68 are connected to the control section 60 and controlled thereby. The output ports of the control section 60 are also connected to the LED array 14 and a buzzer 80.

The operation of the control unit having the above arrangement will be described below.

When the power switch 101 is turned on, the heaters 21 and 22 in the fixing unit 25 are heated. The control section 60 waits until the temperature of the heat roller reaches a predetermined temperature subjected to stable fixing (the wait state). When the heat roller in the fixing unit 25 is heated to the predetermined temperature, the main motor 18 is temporarily energized to drive the photosensitive drum 20 and the fixing unit 25, thereby obtaining a uniform temperature of the rollers in the fixing unit 25 (rotation for releasing the wait state). Thereafter, the main motor 18 is stopped, and the copying machine waits in the ready state (i.e., the standby state). The main motor 18 is driven to rotate the photosensitive drum 20, the fixing unit 25, the developers 7 and 8, and various transfer sheet transporting rollers. When a copy instruction is input at the operating section 100, the copy operation is started.

(1) Description of Image Formation

The main motor 18 is rotated in response to a copy instruction to rotate the photosensitive drum 20 in a direction of arrow c. At the same time, a voltage is applied from the high voltage generator HVT to the primary charger 13 so that the outer surface of the photosensitive drum 20 is uniformly charged. Subsequently, the exposure lamp 24 (or lamp for lighting the original) is turned on, and the optical motor 19 is driven. The original placed on the original plate 5 is exposed with light and scanned in the direction of arrow a. A light representing an original image and reflected by the original is projected onto the photosensitive drum 20. A latent image corresponding to the original image is formed on the photosensitive drum 20. The latent image is developed by the developer 7 or 8, and the resultant toner image is transferred to a transfer sheet SH at the portion of the transfer charger 15. The sheet is separated from the photosensitive drum 20 at the portion of the separating charger 16. The residual toner particles on the photosensitive drum 20 are removed and recovered by a cleaner 6. The surface of the photosensitive drum 20 is uniformly discharged by the erasure lamp 28, and then the next copy cycle is repeated. In this case, the unnecessary charge in the portion except for the image area is removed by a blank exposure lamp consisting of the LED array 14. The LED array 14 has a large number of LEDs arranged in a given configuration to erase the charge from an arbitrary area of the image. This operation will be described in detail later. One of the first and second developers 8 and 7 is selected in response to a selection instruction from the operating section 100 and is brought into contact with the photosensitive drum 20. In this embodiment, a black toner is contained in the first developer to constitute the black developer 8, and a color toner (e.g., a red toner) is contained in the second developer 7 to constitute a color toner developer 7. Pressing (urging) and releasing of the developer with respect to the photosensitive drum 20 is performed by a solenoid 31 for releasing the black developer and a solenoid 30 for pressing the color developer. The solenoid 31 is turned on to release the black developer 8 from the drum 20. The solenoid 30 is turned on to press the color developer 7 onto the drum 20. Sensors 16 and 17 for detecting the black and color toners are respectively arranged in the developers 7 and 8.

Developing bias voltages are respectively applied from the high voltage generator HVT to developing rollers 7-*a* and 8-*a* of the developers 7 and 8. The bias voltages have different magnitudes for the black and color toners so as to optimize the developing conditions therefor. The developing conditions of the photosensitive drum 20 can also be changed in response to the instruction from the operating section 100 in the cases wherein durability of the drum is improved and sensitivity characteristics thereof are changed due to the ambient conditions. The changes in conditions will be described in detail later.

In the copying machine of this embodiment, two-sided copy and multi-copy (to be described later) as well as normal one-side copy can be performed. Once the transfer sheet passes through the fixing unit, the conditions (e.g., a resistance) of the sheet are changed. In order to compensate for these changes, the conditions for the high voltages applied to the transfer charger 15 and the separating charger 16 are changed in the first-side copy cycle and the second-side copy cycle in the two-sided copy or multi-copy mode. These bias, transfer, and separating high voltages are changed in response to instructions from the control section 60.

The optical motor 18 is rotated in the forward or reverse direction through the motor control section 63 in response to an instruction from the control section 60, thereby reciprocating the optical system 4. A home position sensor S1 is arranged for the optical system 4. An image-tip sensor S2 detects the leading end position of the original image and is used to establish the timing in copy sequence control. A sensor S3 detects a limiter position (the inversion position) in the maximum scanning length. The optical system 4 is reciprocated by a scanning length determined by the cassette size and a magnification in response to instructions from the control section 60.

(2) Control of Transfer Sheet

The paper feed section 3 in FIG. 1 includes upper and lower paper cassette sensors S9 and S11, sensors S10 and S12 for detecting upper and lower lifter positions, and sensors S22 and S23 for detecting the upper and lower cassette sizes.

The upper and lower units are identically operated, and only the operation of paper feed in the upper unit will be described. When a cassette 9 is inserted, the size detection sensor S22 reads the sheet size and discriminates the size of the cassette 9. The paper absence LED in the operating section 100 is turned off, and a cassette size LED corresponding to the detected paper size is turned on. When the copy operation is started in response to the copy instruction, a clutch (not shown) for lifting a middle plate is turned on to lift the middle plate in the cassette 9, so that the transfer sheets SH are moved upward. Upon lifting of the transfer sheets SH, the uppermost sheet is brought into contact with paper feed rollers 10 and reaches a predetermined height, the lifter detection sensor S10 generates an output to turn off the clutch and at the same time to drive the paper feed rollers 10, thereby feeding a transfer sheet inside the housing 1 (this operation will be described in detail later). As described above, when the transfer sheets are lifted by the clutch for lifting the middle plate, as described above, the sheets are held in this upper position. When the next copy cycle is started, lifting is not performed. When the number of transfer sheets in the cassette in the serial page copy mode becomes small, and the level of the uppermost sheet SH is lower than a predetermined level, the clutch for lifting the middle plate is turned on to lift the middle plate to the predetermined level.

The fed transfer sheet reaches a pre-registration paper sensor S7. Since registration rollers 12 are kept stopped, the transfer sheet forms a proper loop and is stopped. In order to align the leading end of the transfer sheet with the distal end of the image formed on the drum 20, the registration rollers 12 are driven in response to a timing signal from the optical system 4. The transfer sheet is then fed to the transfer section 17 after registration is completed. The image formed on the drum 20 is transferred to the transfer sheet by the transfer charger 15 in the transfer section 17, and then the transfer sheet with the toner image is separated from the drum 20 by the separating charger 16. The separated transfer sheet is fixed by the heat roller in the fixing unit 25. In this case, the surface temperature of the heat roller is controlled by a temperature sensor (not shown)

arranged on the surface of the heat roller and the heater 21 embedded therein. The transfer sheet is then detected by a paper delivery sensor S4 and delivered outside the housing 1 by rollers 26 and 27.

The copy operation by hand-insertion will be described.

When the operator moves a hand-insertion tray 28 downward in a direction of arrow d, the hand-insertion tray sensor S24 is turned on, so that the hand-insertion copy mode is set. In this case, the middle plate in the cassette 9 is automatically moved downward, and thus the transfer sheets SH in the cassette are also moved downward. A transfer sheet is placed on the hand-insertion tray 28, and the hand-insertion lifter clutch is driven in the same manner as in cassette feeding, in response to a copy start instruction from the operating section 100. The transfer sheet set on the hand-insertion tray 28 is lifted and is fed inside the housing 1 by the paper feed rollers 10.

In the multi-copy mode, a flapper 29 is switched by a solenoid (not shown) to a position indicated by a broken line. The fixed transfer sheet is fed to the second sheet feeder 23 through a path 33. In the second sheet feeder 23, the transfer sheet is detected by a second pre-registration paper sensor S5. The width-direction positioning is performed by a paper sensor S8 for width-direction registration and a solenoid of width-direction registration (to be described later). The transfer sheet is fed to the registration rollers 12 by second registration rollers 37 in response to a multi-copy instruction from the operating section 100. The subsequent operations are the same as described above. The copied sheet is delivered onto a delivery tray 32.

In the two-sided copy mode, the copy cycle up to first-side fixing is the same as the normal copy cycle, and the transfer sheet is delivered by the delivery rollers 27. However, when the trailing end of the transfer sheet passes through the flapper 29, the delivery rollers 27 are driven in the reverse direction. The transfer sheet is guided by the flapper 29 to a path 33 (this operation will be described in detail later). Inversion operation is performed by the solenoid for controlling the forward-/reverse rotation. The subsequent operations are the same as those in the multi-copy mode. In this manner, in the two-sided copy mode, once the transfer sheet is delivered outside the housing 1 by the delivery rollers 27, the rollers 27 are rotated in the reverse direction, so that the transfer sheet is turned upside down and fed to the second sheet feeder 23.

In the above description, the single multi-copy and two-sided copy operations have been described. However, a plurality of copies are produced in the multi-copy or two-sided copy mode. In this case, a middle tray 40 is used. As shown in FIG. 1, a tray 53 is disposed in the middle tray 40 to temporarily store transfer sheets passing through a sheet transporting path 43. In the multi-copy mode for a plurality of copies, the fixed transfer sheet is delivered by the delivery rollers 27 under the same control as in a single sheet copy mode or the two-sided copy mode. The delivery rollers 27 are rotated in the reverse direction to cause the transfer sheet to pass through the paths 33 and 43, and the transfer sheet is then stored on the tray 53. This operation is repeated, and a set number of transfer sheets, each of which has one copied surface, are stacked on the tray 53. In this state, the paper feed roller 56 is driven in response to the next copy instruction. The second-side copy operation is executed through paths 59 and 23. However, in the two-sided copy mode for a plurality of copies, the transfer sheet is stored from the fixing unit 25 on the tray 53 by the flapper 29 through the paths 33 and 43 under the same control as in the single multi-copy mode. The subsequent operations are the same as those in the multi-copy mode, and a detailed description will be omitted.

(3) Description of Operating Section

The operating section 100 will be described below.

Figure 3:
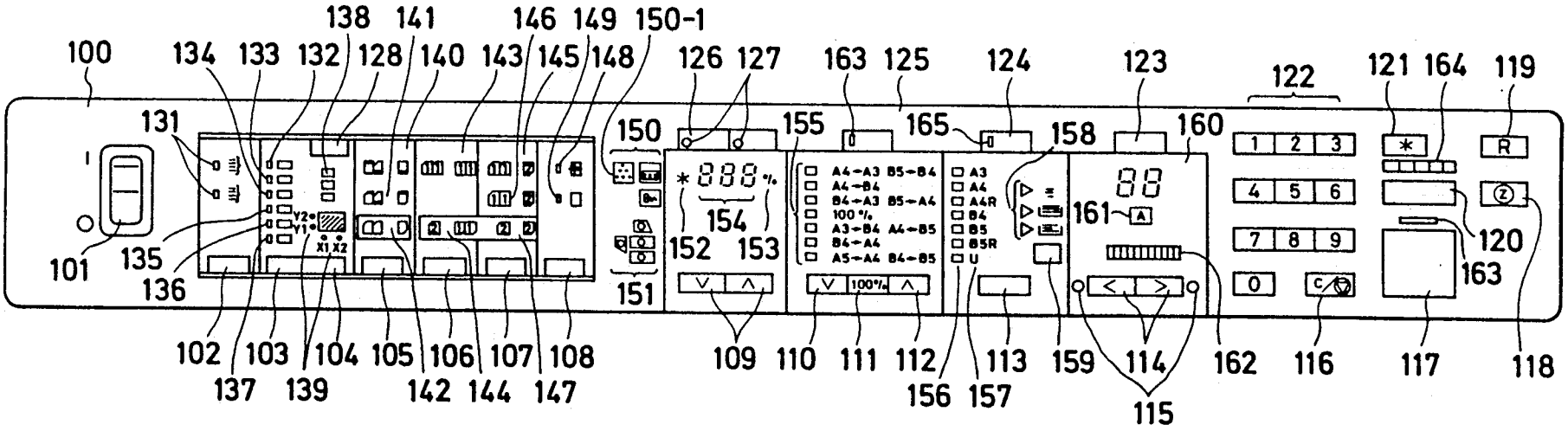
FIG. 3 is a plan view showing an operating section in the copying machine of FIG. 1.

FIG. 3 shows an outer appearance of the operating section 100. The operating section 100 includes a power switch 101 for controlling energization or deenergization of the copying machine, a sorter instruction key 102, a copy image mode selection key 103 for selecting one of the six modes (image conversion modes) for the designated area, a point key 104 (to be described in detail later) for designating points (two points along the X direction and two points along the Y direction) when the operator designates an area, a multi-copy key 105 for selecting the multi-copy mode, a serial copy key 106 for dividing a copy area of original glass plate 5 into two areas and for designating automatic serial copy of two sheets, a two-sided copy key 107 for selecting the two-sided copy mode, a binding-margin/frame-erasure key 108 for designating formation of a binding margin at one side of the transfer sheet and erasure of the frame, a zoom key (up-down) key 109 for increasing or decreasing the magnification displayed on the display in percentage, a reduction key 110 for designating a standard reduction ratio, a key 111 for selecting an equal-size copy mode, a key 113 for selecting a cassette, a key 114 for controlling a copy density, and a density correction key 115 for changing a copy density designated by the copy density control key 114. In this embodiment, a lighting voltage of the original exposure lamp 24 is controlled by the key 114 (to be described later) to control the density. The developing bias voltage is changed by the copy density correction key 115 to correct the density. The operating section 100 also includes a clear/stop key 116. This key 116 serves as a clear key for setting the number of copies in the standby mode. However, during copying, the key 116 serves as a copy stop key. The operating section 100 further includes a copy key 117, a preheating key 118, a standard mode restoration key 119, a color selection key (developer selection key) 120 for selecting one of the developers 7 and 8, an asterisk key 121 for inputting an original length and a copy length and calculating a magnification of the copy length, and a ten-key pad 122. Moreover, the operating section 100 includes an AE key for designating an automatic density control mode, a key 124 for designating an automatic paper selection mode for selecting an optimal transfer sheet according to the original size and the copy magnification, a key 125 for designating an automatic magnification selection mode for selecting an optimal magnification according to the original size and the designated transfer sheet size, a key 126 for accessing the magnification set in a memory, a key 127 for registering the magnification in the memory, a key 128 (to be described later) for designating an area to be registered and accessing an area registered in the memory. The operating section 100 also includes the following display LEDs 131 to 164. More specifically, the LEDs 131 respectively indicate the sort and group modes when a sorter is used. Each of the LEDs 132 and 37 indicates a copy mode when copying is performed for a designated area in combination with the color developer 8. The LEDs 132 to 137 are sequentially selected by the key 103. The copy modes will be described in detail later. The LED 138 indicates the number of designated areas. One of the three areas can be designated in this embodiment. The LEDs 139 indicate coordinate points to be input. The LEDs 140 to 142 respectively indicate copy modes associated with multi-copy. More specifically, the LED 140 indicates the normal multi-copy mode for independently exposing the two originals one by one and sequentially multi-copying these originals. The LED 141 indicates the serial multi-copy mode for dividing the copy area of the original glass plate 5 into two areas and automatically multi-copying the corresponding original areas according to the colors designated by the developer selection key 120. The LED 142 indicates a serial color multi-copy mode for dividing the copy area of the original glass plate 5 into two areas and automatically switching the two developers 7 and 8 to serially multi-copy the originals with two colors. In this embodiment, the left half of the original copy area is copied with black by using the black developer 8. The right half of the original copy area is copied with red by using the color developer 7. The LED 143 indicates a serial page copy mode for dividing the original copy area into the right and left areas and producing two copies by a single copy instruction. The LED 144 indicates the serial two-sided copy mode for producing two one-side copies by using a two-sided original by using an RDF (to be described later). The LEDs 145 to 147 indicate the copy modes associated with two-sided copy. More specifically, the LED 145 indicates the normal two-sided copy mode for independently exposing two originals and copying these images on the both surfaces of a single transfer sheet. The LED 146 indicates the serial two-sided copy mode for dividing the copy area of the original glass plate 5 into the right and left areas and for copying the corresponding images on the two surfaces of a single transfer sheet with a color designated by the developer selection key 120. The LED 147 indicates another two-sided copy mode for copying images of a two-sided original onto two sides of a single transfer sheet by using the RDF. The LED 148 indicates the mode for shifting an original with respect to the transfer sheet to form a binding margin. The LED 149 indicates the mode for erasing an image from the edges of the transfer sheet. The LEDs 150 serve as alarm indicators for indicating the absence of a toner, the absence of a control counter, and paper jam. The LEDs 151 indicate the locations of paper jam, respectively. The LED 152 is turned on during a magnification calculation with the asterisk key 121. The LED 153 is turned on when the magnification display 111 displays a magnification. The LEDs 155 respectively indicate the designated standard magnifications modes, and one of the LEDs 155 is turned on upon selection of a desired standard magnification by using the keys 110 and 112. The LEDs 156 respectively indicate cassette sizes used for copies, and one of these LEDs is turned on upon selection of the corresponding cassette. The LEDs 157 are selectively turned on when the corresponding cassettes are attached to the upper and lower cassette positions. Assume that an A3 cassette is attached to the upper position that an A4 cassette is attached to the lower position, and that the operator selects the lower cassette. In this case, the A3 and A4 LEDs are turned on, and one of the LEDS 156 which is located next to the "A4" LED 157 is turned on. The LEDs 158 respectively indicate that the hand-insertion tray, the upper cassette, and the lower cassette are selected. The LED 159 is turned on when the transfer sheets are absent in the cassette or the cassette is not attached to the housing 1. The eight-segment LEDs (display) 160 indicate the number of copies. The LED 161 indicates the automatic density control mode. The LED 162 indicates a copy density. The LEDs 163 comprise a green LED and a red LED. The green LED is turned on in the standby mode, and the red LED is turned on in the copy disable state. The LEDs 164 respectively indicate colors of the designated developers. The LED 165 indicates the automatic paper selection mode. The LED 166 indicates the automatic magnification selection mode. The no-toner indicator 150-1 indicates that the toner of the developer designated by the developer selection key 120 is empty. If the black developer is empty, the LED 150-1 is turned on only when the black developer 8 is selected. In this case, if the color developer 7 is selected, the LED 150-1 is turned off. This is also the case for the color toner. The LED 150-1 is turned on only when the color developer 7 is empty and selected.

Description of LED Array

The LED array 14 will be described below.

Figures 1, 4:
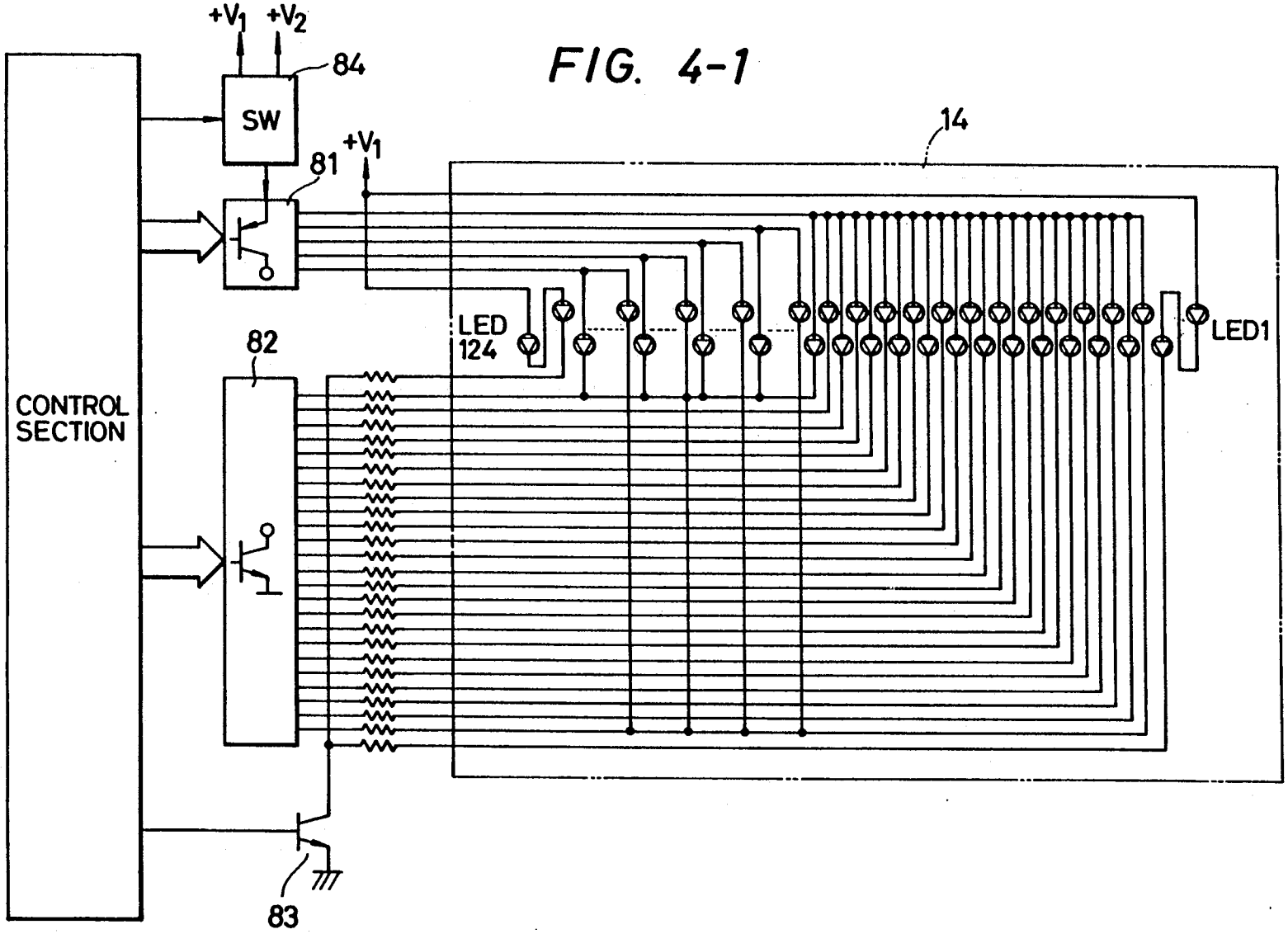
Figures 2, 4:
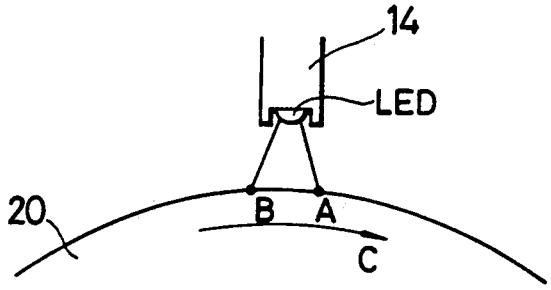
Figures 3, 4:
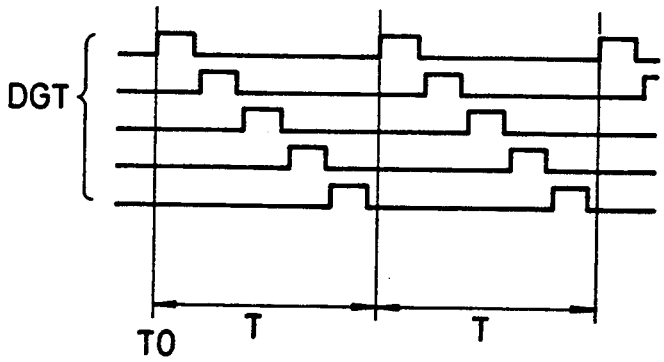

FIG. 4-1 is a view showing the LED array 14 and its driver. The driver includes a control section 60. Five pnp transistors 81 are connected to the anodes of the LEDs. Twenty-four npn transistors 82 are connected to the cathodes of the LEDs. The driver also includes a transistor 83. The LED array 14 comprise one hundred twenty-four light-emitting diodes LED1 to LED124. The LED1 to LED124 are aligned in line along the axial direction of the drum 20. The light-emitting portion of the LED array has a length longer than the width of the maximum transfer sheet. In this embodiment, the length of the LED1, LED2, LED123, and LED124 of the LED array 14 is longer than the width of the maximum transfer sheet. The LED1, LED2, LED123, and LED124 are statically driven by the transistor 83. The remaining LED3 to LED122 are dynamically driven in a $5\times24$ matrix by the transistors 81 and 82.

The lighting timing and LEDs to be turned on in the LED array 14 are controlled by the control section 60. The LED array 14 is used to remove the unnecessary charge form the surface of the drum 20 when a designated area is to be copied.

The driver also includes a switching circuit 84 for switching a power source voltage applied to the transistors 81. FIG. 4-2 is an enlarged view showing the LED array 14 and a portion of the photosensitive drum 20. The LEDs in the LED array 14 illuminate the range defined by points A and B on the drum 20. The drum 20 is rotated in a direction of arrow c. In the area designation copy mode, assume that an area exceeding point A on the drum 20 is to be erased. When the LEDs reach point A in response to the timing signal from the control section 60, the LEDs are turned on. In other words, when the LEDs in FIG. 4-2 reach the range between points A and B, they are turned on. In this case, the product of light incident on the drum surface and time (i.e., this product represents energy) at point A is smallest. The energy level is increased toward point B. The energy level of the downstream area exceeding point B is not changed. For this reason, charge is not sufficiently removed from the boundary between the image portion and the area subjected to image erasure, and the boundary becomes unclear. In addition, when the LEDs are turned off, the corresponding boundary becomes unclear. In order to prevent this, the switching circuit 84 is driven at the turn-on and turn-off timings of the LEDs to supply a voltage +V2 higher than the normal voltage +V1, thereby increasing the amount of light emitted from each LED (high power lighting).

The LED array is dynamically driven. In order to prevent ON timing errors, signals of five digit lines (to be referred to as five DGT signals hereinafter) driven by the transistors 81 are synchronized with high power lighting. For example, as shown in FIG. 4-3, before time T0, the DGT signals from the transistors 81 are disabled, and the LEDs are kept off. At time T0, the five DGT signals are sequentially enabled to turn on the LEDs. The switching circuit 84 receives a signal synchronized with a DGT signal generation period T and performs high power lighting of the LEDs. The high power lighting period is an integer multiple of T. However, the period is determined according to the light scattering degree of the LED array 14 and the rotational speed of the photosensitive drum 20.

I. Description of Editor

Figures 1, 5:
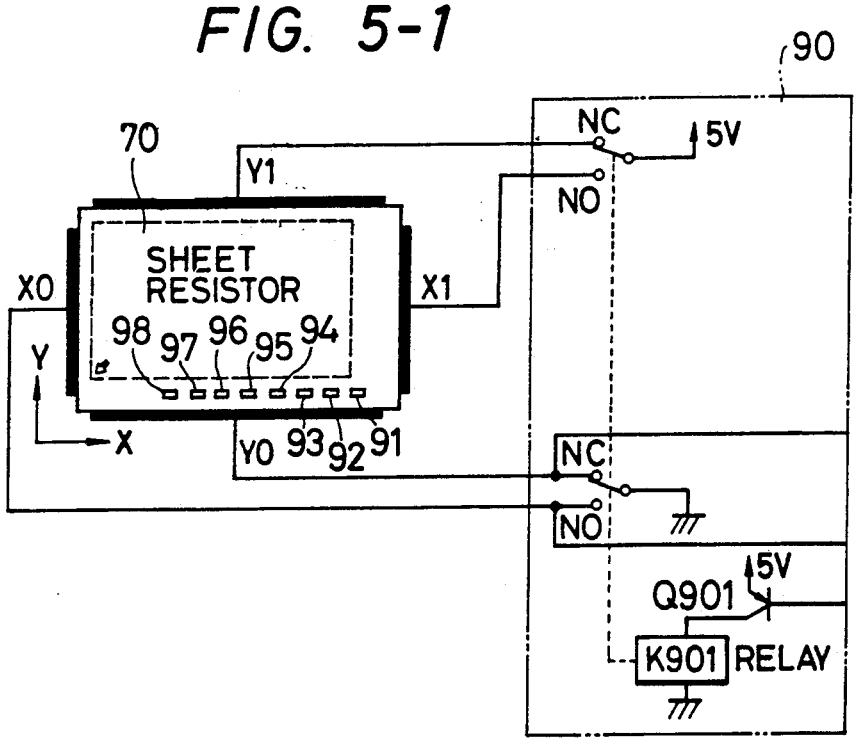
Figures 2, 5:
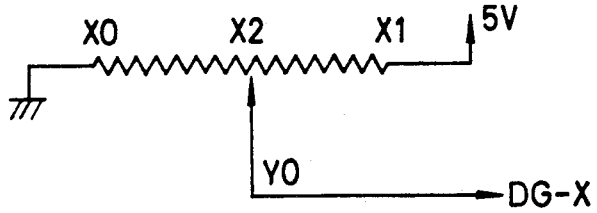
Figures 3, 5:
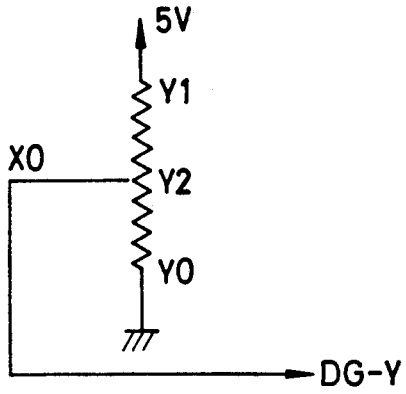

The editor 70 will be described below. The editor 70 is placed on an original pressure plate 34, and the construction of the editor 70 is illustrated in FIG. 5.

The editor 70 comprises a sheet resistor for reading positions along the horizontal (X) direction and the vertical (Y) direction, a switch built-in pen (not shown) for pressing the surface of the editor 70, and a switching circuit 90 for switching the read direction from the X direction to the Y direction and vice versa. An original is placed within a rectangular area indicated by the broken line such that the position of an arrow serves as a reference position. The sheet resistor covers the area indicated by the broken line as well as a clear key 92, a memory key 91, area copy mode keys 93 to 98. The area copy mode keys 93 to 98 correspond to the mode LEDs 132 to 137 on the designated area and resets the area copy mode. The memory key 91 registers the designated area. When given coordinates are input with a pen, a relay K901 is kept off, so that a voltage is applied across terminals Y1 and Y0. In this case, the resultant circuit is equivalent to a circuit of FIG. 5-3. The control section 60 reads a y-coordinate as a voltage DG-Y obtained by dividing a power source voltage by the pen. The control section 60 then enables the relay K901 to apply a voltage across terminals X1 and X0. In this case, the resultant circuit is equivalent to that of FIG. 5-2, thereby reading an x-coordinate in the same manner as described above. The control section 60 sets the coordinates of the area and key inputs according to the read coordinate data.

The control section 60 discriminates the signals from the editor and registers the corresponding copy mode and the coordinates of the designated area. In the copy mode designation operation, the buzzer is energized for 60 ms. In the area coordinate input operation, the buzzer is operated for 30 ms. Different energization modes of the buzzer allow the use to check the editor inputs. If editor inputs are invalid, the buzzer is not actuated.

The coordinate input area of the editor is 432×297 mm. However, an area smaller than the editor area by 5 mm each side is given to determine a maximum or minimum input value. More specifically, if the user designates a point within the range between the editor area and the area smaller than that by 5 mm each side, the control section 60 detects that the user designates the boundary position of the editor area.

Description of Copy Modes

The copy modes will be described in detail.

Mode 1: One-Side Original→Two-Sided Copy (LIghting of LED 145)

Figure 6A:
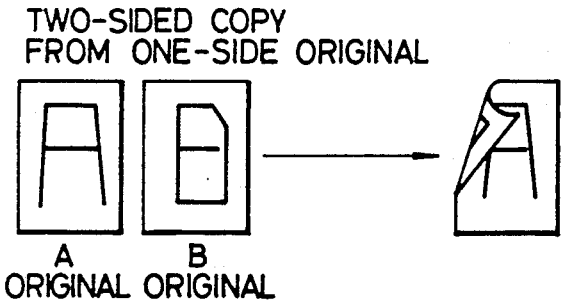
FIG. 6A is a view showing a two-sided copy output derived from one-sided originals.

As shown in FIG. 6A, a two-sided copy is produced by using two one-side originals.

An original A is set on the original plate 5, and the copy key 117 is depressed to form an image on one surface of a transfer sheet. Subsequently, an original B is set on the original plate 5, and the copy key 117 is depressed to form an image on the other surface of the same transfer sheet.

Mode 2: Serial Page→Two-Sided Copy (Lighting of LED 146)

Figure 6B:
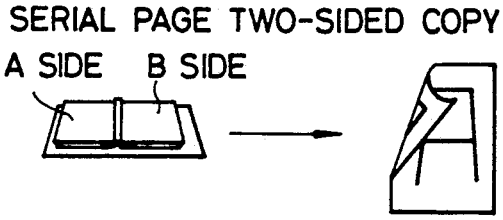
FIG. 6B is a view showing a serial page two-sided copy output.

As shown in FIG. 6B, a two-sided copy is produced from sides a and B as the adjacent pages of a book or the like when it is open.

A book or the like is open and turned back so that the sides A and B faces the original plate 5. When the copy key 117 is depressed, the image of the side A is formed on one surface of a transfer sheet, and then the image of the side B is formed on the other surface of the same transfer sheet. It should be noted that the originals may be separate originals.

Mode 3: One-Side Originals→Multi-Copy (Lighting of LED 140)

Figure 6C:
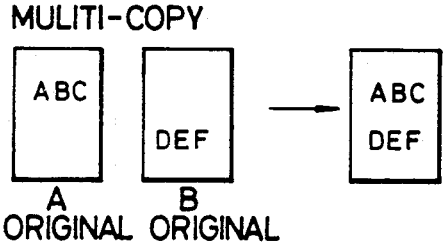
FIG. 6C is a view showing a multi-copy output.

As shown in FIG. 6C, a multi-copy is produced using two originals.

An original A is set on the original plate 5, and the copy key 117 is depressed to form an image on one surface of a transfer sheet. An original B is set on the original plate, and the copy key 117 is depressed to form an image on the same surface but at a different position thereof.

Mode 4: Serial Page Multi-Copy (Lighting of LED 141)

Figure 6D:
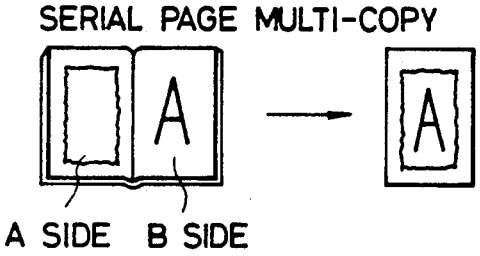
FIG. 6D is a view showing a serial page multi-copy output.

As shown in FIG. 6D, a multi-copy is produced from sides A and B of an open book or the like. The book or the like is open and turned back on the original plate 5. When the copy key 117 is depressed, the image of the side A is formed on one surface of a transfer sheet, and then the image of the side B is formed on the same surface.

Mode 5: Serial Page Color Multi-Copy (Lighting of LED 142)

Figure 6E:
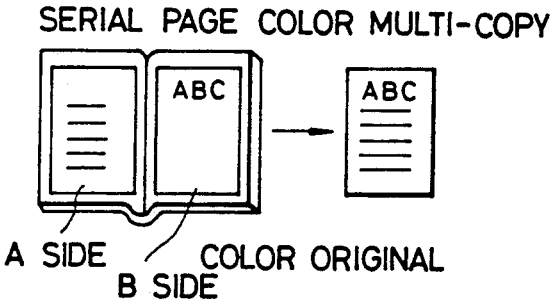
FIG. 6E is a view showing a serial page color multi-copy output.

As shown in FIG. 6E, a side A of an open book or the like is copied with black, and an adjacent side B is copied with a designated color. This mode is the one wherein the side B is copied with the designated color in the serial page multi-copy mode. It should be noted the side A may be copied with the designated color.

Mode 6: Mode for Copying Designated Area in Designated Color and Outside area with Black (Lighting of LED 132)

Figure 7A:
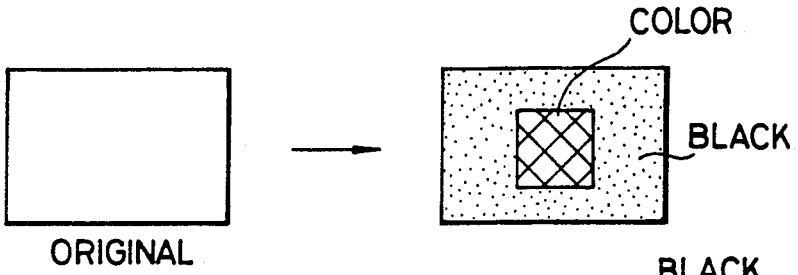
FIGS. 7A to 7F are respectively views showing outputs in the image conversion mode.

As shown in FIG. 7A, an image of the designated area is copied with the designated color, and an image of the outside area is copied with black. An original is set on the original plate, and an area is designated. When the copy key is depressed, the image of the designated area is copied with a designated color on one surface of a transfer sheet, and then the image of the outside area is coped with black on the same surface. In this case, the copying order may be reversed.

Mode 7: Mode for Copying Designated Area with Black and Outside area with Designated Color (Lighting of LED 133)

Figure 7B:
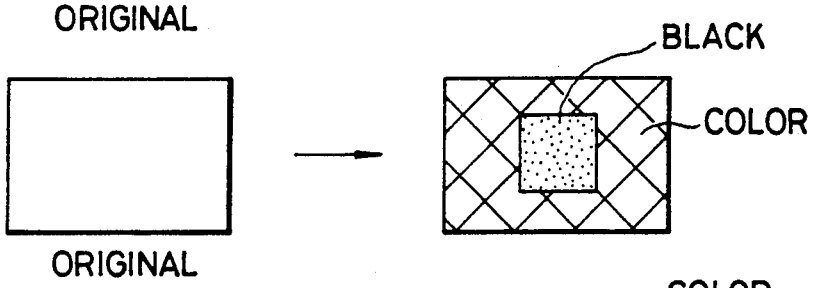

As shown in FIG. 7B, an image of the designated area is copied with black, and an image of the outside area is copied in a specific color. An original is set on the original plate 5, and an area is designated. When the copy key is depressed, the image of the designated area is copied with black on one surface of a transfer sheet, and the image of the outside area is copied with a designated color on the same surface. This mode is a reversed mode of mode 6.

Mode 8: Mode for Copying Designated Area with Designated Color (Lighting of LED 134)

Figure 7C:
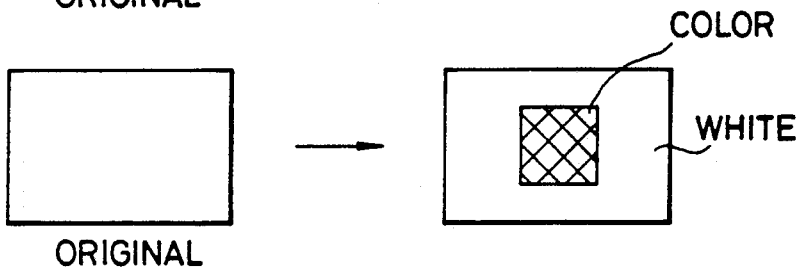

As shown in FIG. 7C, an image of the designated area is copied with a designated color. The original is set and an area is designated. When the copy key 117 is depressed, the image of the designated area is copied with the designated color on one surface of a transfer sheet.

Mode 9: Mode for Copying Area Outside Designated Area with Specified Color (Lighting of LED 135)

Figure 7D:
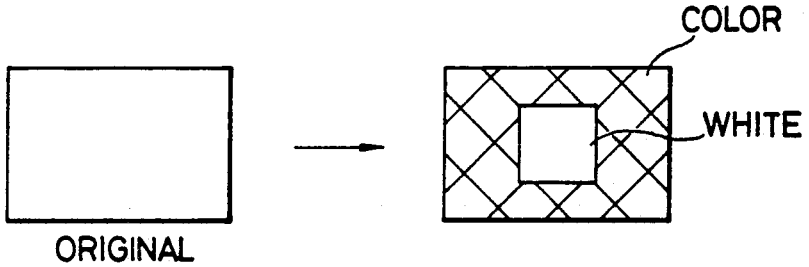

As shown in FIG. 7D, an image of an area outside the designated area is copied with a designated color. An original is set, and an area is designated. When the copy key 117 is depressed, the image of the area outside the designated area is copied with the designated color on one surface of a transfer sheet.

Mode 10: Mode for Copying Designated Area with Black (Lighting of LED 136)

Figure 7E:
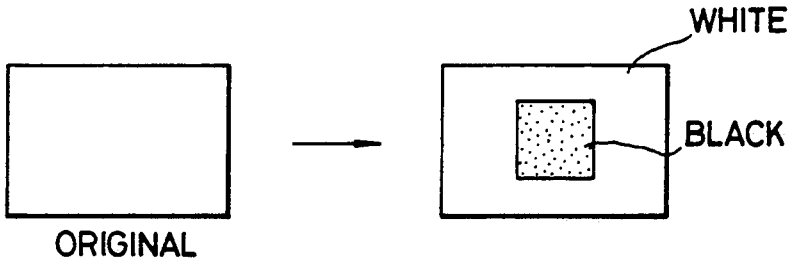

As shown in FIG. 7E, an image of the designated area is copied with black. An original is set on the original plate, and an area is designated. When the copy key 117 is depressed, the image of the designated area is copied with black on one surface of a transfer sheet.

Mode 11: Mode for Carrying Area Outside Designated Area with Black (Lighting of LED 137)

Figure 7F:
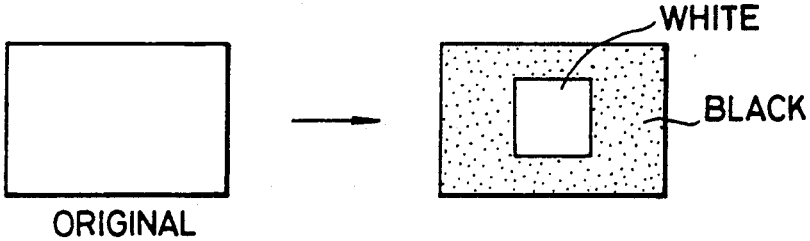

As shown in FIG. 7F, an image of an area outside the designated area is copied with black. An original is set on the original plate, and an area is designated. When the copy key 117 is depressed, the image of the area outside the designated area is copied with black on one surface of a transfer sheet.

Only one paper path is available due to the structural limitations of the copying machine. In each copy cycle, only one of mode 1 to mode 7 can be selected together with one of the single copy mode, the serial page copy mode, the two-sided copy mode, and the two-sided original two-sided copy mode.

In each copy cycle, only one of mode 6 to mode 11 can be selected due to the structural limitations of the copying machine. Due to the same reason described above, in each copy cycle, one of mode 8 to mode 11 can be selected together with one of the binding margin key for the LED 148 and the frame erasure key for the LED 149.

When one of mode 5 to mode 11 is selected, the color selection key 120 is invalid since the copy color mode is included in each of mode 5 to mode 11.

An operation will be described wherein mode 1 or mode 3 is selected and an original transporting device (e.g., DF, ADF, or RDF) is used.

(1) Use of DF

When an original is placed on an original plate of a DF (Document Feeder), the original is automatically fed and set at a predetermined position of the original plate. First-side copying is started under the preset copy conditions. The transfer sheet is stored in the middle tray 40 or the second sheet feeder 23, and first-side copying is completed. The DF delivers the original outside.

In the same manner as described above, the next original is set on the original plate of the DF and is automatically fed. The copying machine starts performing second-side copying. In this case, the transfer sheet is fed from the middle tray 40 or the second sheet feeder 23 since the transfer sheet after first-side copying is stored therein. When second-side copying is completed, the DF delivers the original outside. Therefore, the series of operations are completed.

The original for first-side copying may be manually set and the original for second-side copying may be fed by the DF. Alternatively, the original for first-side copying may be fed by the DF, and the original for second-side copying may be manually set.

(2) Use of ADF

An original is set on an original plate of an ADF (Auto Document Feeder), and the copy key 117 is depressed. The original is automatically fed and delivered. At the time of completion of feeding of the original for first-side copying, if an original for second-side copying is not present, the transfer sheet is delivered outside the copying machine, and the copy cycle is completed. However, if there is a single original, the transfer sheet is stored in the middle tray 40 or the second sheet feeder 23, and the first-side copying is completed. When the copy key 117 is depressed again, second-side copying is started. In this case, the original may be manually set or fed by the ADF.

(3) Use of RDF

When the copy key 117 is depressed, an RDF (Recirculating Document Feeder) recirculation originals set on the original plate and counts the number of originals. If the number of originals is an odd number, the last original is subjected to one-sided copying.

The paper size restrictions upon selection of one of mode 1 to mode 5 will be described.

In the multi-copy or two-sided copy mode, the second sheet feeder 23 or the middle tray 40 often cannot be used because of the size of the transfer sheet. If the second sheet feeder 23 and the middle tray 40 are not used, the original is delivered outside the copying machine and the copy cycle is completed.

(1) When Middle Tray 40 is not Available

In mode 1 or mode 3, the original must be replaced with another original, and thus the number of copies is always "1".

(2) When Middle Tray 40 is Available

In mode 1 or mode 3, since the original must be replaced with another original, the maximum set number of copies is the maximum number of sheets to be stacked on the middle tray. However, if the paper size is given such that the middle tray 40 cannot be used but the second sheet feeder 23 can be used, the maximum number of sheets is "1". Furthermore, if transfer sheets are fed from the hand-insertion tray, different sizes may often be used. In this case, the middle tray 40 cannot be used.

In the multi-copy or two-sided copy mode together with a mode excluding mode 1 and mode 3, the maximum number of sheets is the maximum number of sheets to be stacked in the middle tray 40.

Description of Jam Processing

Jam processing will be described below. If jam occurs in a copy mode without using the middle tray 40 or the second sheet feeder 23, jam processing is performed.

The reset button S15 (FIG. 1) is depressed, and the power switch 101 is turned on to set the copying machine in the standby mode. In this case, the copy mode immediately prior to the occurrence of jam is restored. A difference between the set number of copies and the number of copied sheets is calculated, and the difference, i.e., the remaining number of copies to be made is displayed on the LEDs 160. In this state, when the copy key 117 is depressed, the remaining copies are made, and the copy operation is completed.

If jam occurs during the first-side copy operation in a mode using the middle tray 40 or the second sheet feeder 23, jam processing is performed. Thereafter, the reset button S15 is depressed, and the power switch 101 is turned on, so that the copying machine is set in the standby mode. In this case, the copy mode is the same as that without using the middle tray 40 or the second sheet feeder 23. In this state, when the copy key 117 is depressed, the remaining copies are made, and the first-side copy operation is completed. During the first-side copy operation in the two-sided copy or multi-copy mode together with a mode excluding mode 1 or mode 3, the second-side copy operation is continuously performed. In mode 1 or mode 3, the original is replaced with another original and the copy key 117 is depressed to start the second-side copy operation. In the standby mode after jam processing when the stop key 116 or the reset key 119 is depressed, the control section 60 determines that the user wishes to interrupt first-side copying. The number of transfer sheets stored in the middle tray 40 is displayed on the LEDs 160, and the copying machine is held in second-side copy wait mode. It should be noted that even if the stop key is depressed during the first-side copy operation, the above processing is performed.

If jam occurs during the second-side copy operation in the copy mode using the middle tray 40 or the second sheet feeder 23, jam processing is performed. Thereafter, the reset button S15 is depressed, and the power switch 101 is turned on to set the copying machine in the standby mode. In this case, the copy mode immediately prior to the occurrence of jam is restored. However, the number of transfer sheets stored on the middle tray 40 is displayed on the LEDs 160. When the copy key 117 is depressed, copying is performed until the middle tray 40 becomes empty. If no transfer sheets are present on the middle tray 40 in the copy standby state after jam processing, copying is completed.

Even if the power switch is turned off at the time of jam occurrence, data prior to the occurrence of a jam is backed up by a battery. When a front door (not shown) of the copying machine is opened, a high voltage supplied to a high-voltage section is interrupted.

Description of Non-Toner Processing

No-toner processing will be described.

(1) Black Toner

If the amount of black toner is smaller than the predetermined amount, mode 5, mode 6, mode 7, mode 10, and mode 11 cannot be set.

Even if the no-toner state is detected during copying, the no-toner LED 150-1 is not turned on until the set number of copies are completely made.

In the mode for copying a plurality of originals by using an RDF, copying is not interrupted upon detection of the no-toner state if a product of the number of remaining copies and the number of copied sheets is less than 100. In this case, the copying cycle is performed to the end. However, if the above number exceeds 100, copying is interrupted upon detection of the no-toner state since it is assumed that toner shortage may adversely affect the image.

(2) Color Toner

If the amount of color toner is smaller than the predetermined amount, mode 5, mode 6, mode 7, mode 8, and mode 9 cannot be set.

During copying, if shortage of the color toner is detected, copying is interrupted upon its detection. If copying continues, a mixing ratio of the toner to the carrier is reduced to cause the carrier from the color developer to attach to the surface drum, thereby damaging the surface of the drum. However, if the transfer sheet is stored in the second sheet feeder 23, the consumption of the color toner is small since the single copy mode is set, thereby performing the series of copy operations.

In copying using an RDF, the product of the number of remaining originals and the number of copies to be made is less than a predetermined value, copying is not interrupted even if the amount of color toner is less than the predetermined amount, and copying continues until the last original is copied. When the no-color-toner state is detected during the second-side copy operation in the two-sided copy or multi-copy mode, the user turns off the power switch 101 and replenishes the color developer with a color toner. In this case, the user may remove the transfer sheet from the middle tray 40 or the second sheet feeder 23 and may interrupt copying. Thereafter, when the power switch 101 is turned on and the absence of sheet in the middle tray 40 or the second sheet feeder 23 is detected, copying is disabled, so that the copying machine is set in the standby state.

The no-toner state processing will be described in more detail.

Figure 8:
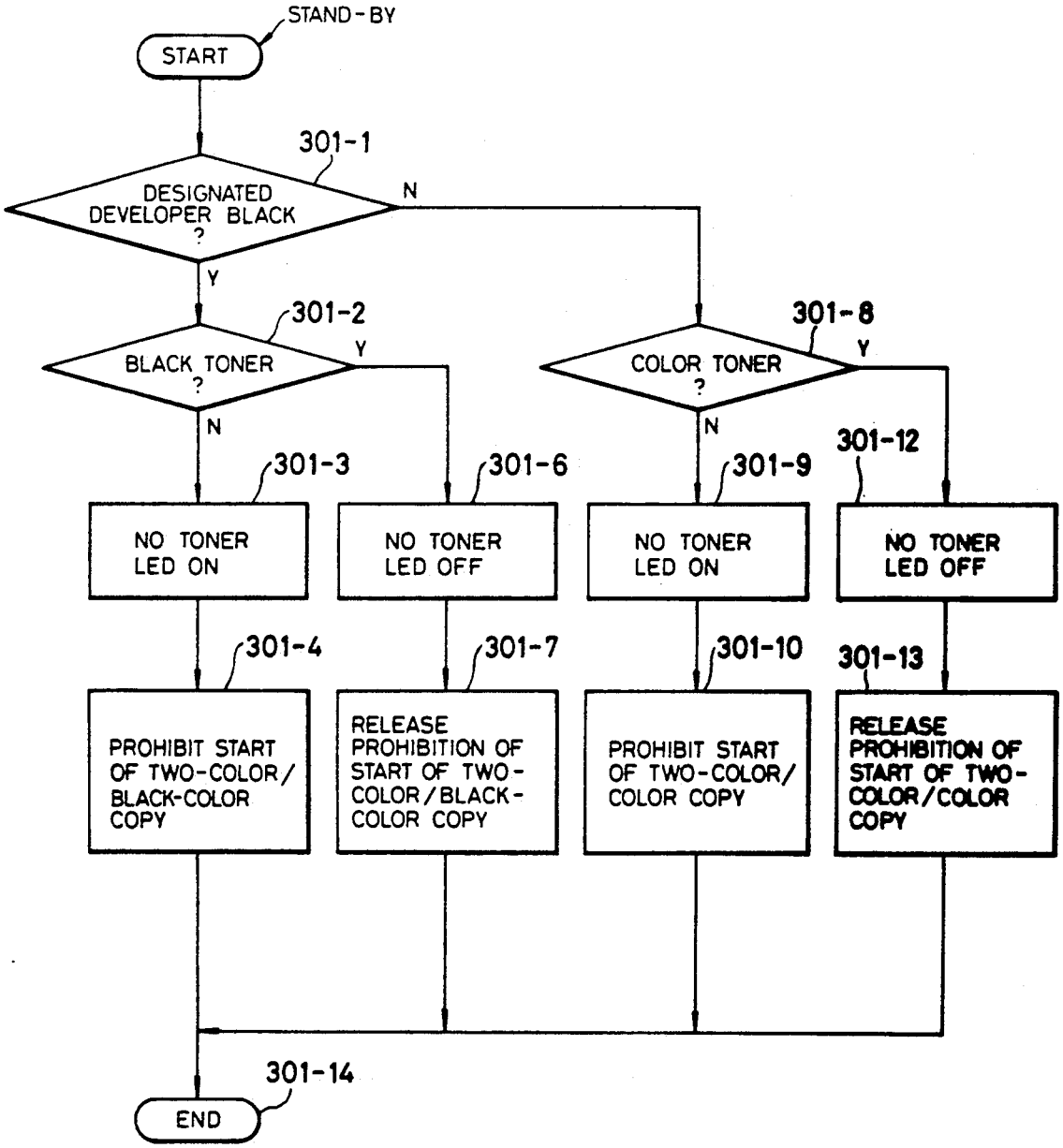
FIG. 8 to 10 are respectively flow charts for explaining the non-toner sequence.
Figure 9:
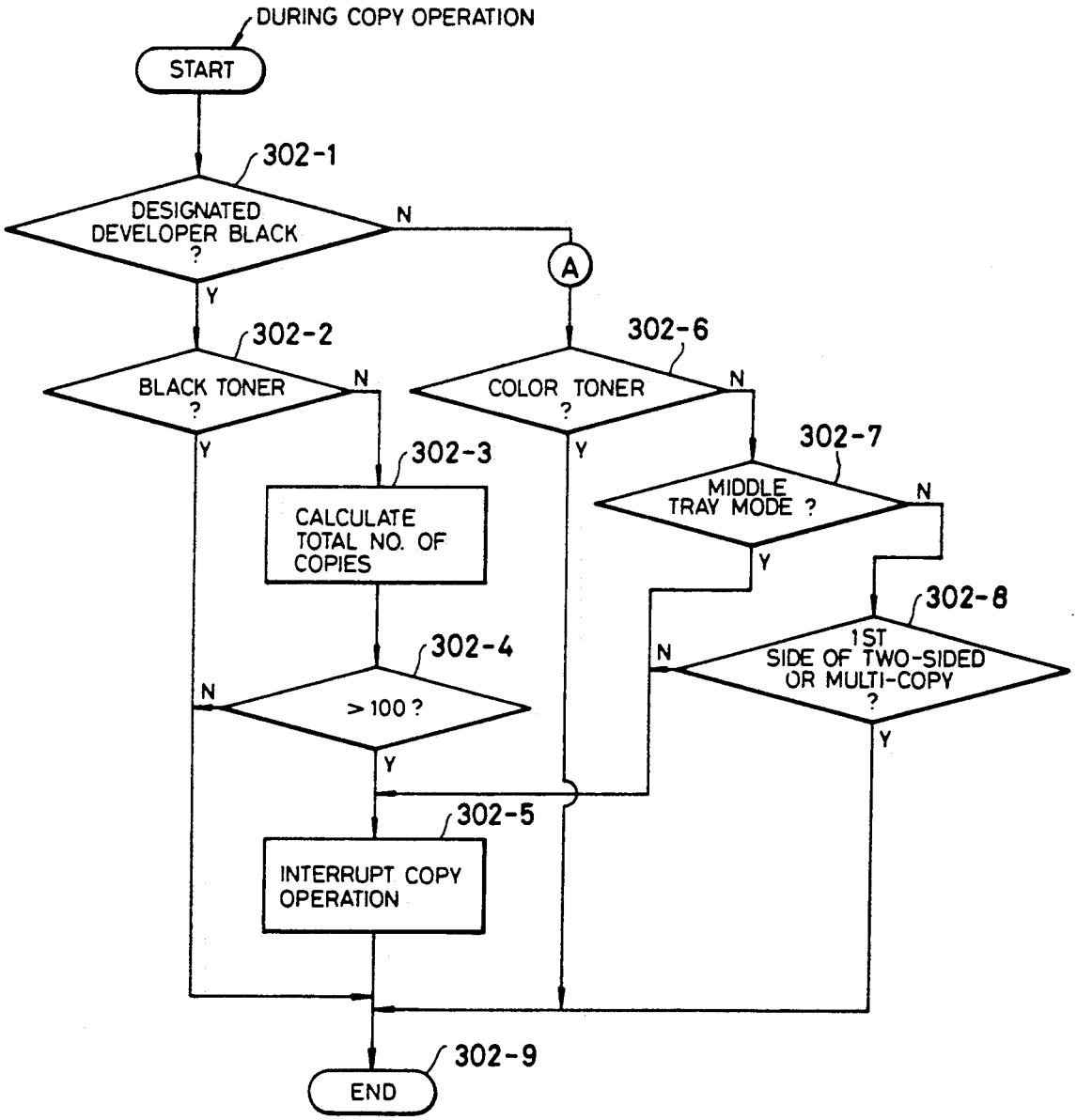

FIGS. 8 and 9 are flow charts of no-toner processing and copy control under such a condition. FIG. 8 shows processing in the standby state.

Referring to FIG. 8, the control section 60 determines the color of the developer designated by the developer selection key 120 (301-1). If the designated developer color is black, the control section 60 checks the presence/absence of the black toner in the developer in step 301-2 on the basis of a toner detection signal from the sensor (not shown). If YES in step 301-2, the no-toner LED 150-1 is turned on (301-3). At the same time, the control section 60 prohibits start of two-color/black-color copy (301-4). In other words, the control section 60 prohibits receiving an output from the copy start key 117. However, if YES in step 301-2, the no-toner LED 150-1 is turned off in step 301-6 and releases prohibition of the start of two-color/black-color copy in step 301-7. The absence/presence of the toner may also be detected by a known method. Even if the no-toner state is detected, the toner is not completely used up. In practice, the no-toner state is detected with a sufficient margin. In the case of selecting the color copy by selecting the color developer, if the amount of color toner is less than the predetermined amount, the LED 150-1 is turned on (301-9), and the control section 60 prohibits the start of two-color and color copy (301-10). However, if NO in step 301-8, i.e., the amount of color toner is sufficient, the control section 60 releases prohibition of the start of two-color/-color copy (301-12 and 301-13). The two-color copy is defined such that the black and color developers are alternately used in mode 5, mode 6, or mode 7 to obtain a two-color copy.

The operation will be described wherein toner shortage is detected during copying.

FIG. 9 shows a flow chart of this operation. Processing in this flow chart is performed for every copy cycle. The control section 60 determines whether the current copy is a black or color copy. If the control section 60 determines that the current copy is the black copy and only if shortage of the black toner is detected (302-2), a total number of copies is calculated (302-3). The calculated number is equal to the number of copies set at the ten-key pad 122 in the operating section 100 if the RDF is not used. However, if the number of originals is known in the case wherein the RDF is used, the calculated number is the product of the number of copies set at the ten-key pad 122 in the operating section 100 and the number of originals.

The control section 60 determines in step 302-4 whether the total number exceeds 100. If YES in step 302-4, the control section 60 sets an instruction for interrupting copy operation. In the case of color copy operation, the control section 60 determines whether the toner is present in step 303-6. If NO in step 303-6, the control section 60 determines in step 302-7 whether the two-sided copy or multi-copy mode for a plurality of transfer sheets by using the middle tray 40 is set. If YES in step 302-7, the control section 60 sets a copy interruption instruction in step 302-5. In the case wherein the operation is performed except for first-side copy operation in the two-sided copy or multi-copy mode performed together with a mode without using the middle tray 40 (302-8 to 302-5), the control section 60 sets the copy interruption instruction. However, a single-sided copy operation can be performed without interruption. For example, if the no-toner state is detected during a one-sided copy operation for a plurality of originals by using the color developer, operations in steps 302-1, 302-6, 302-7, 302-8, and 302-5 are performed, and then the copy interruption instruction is set.

Figure 10:
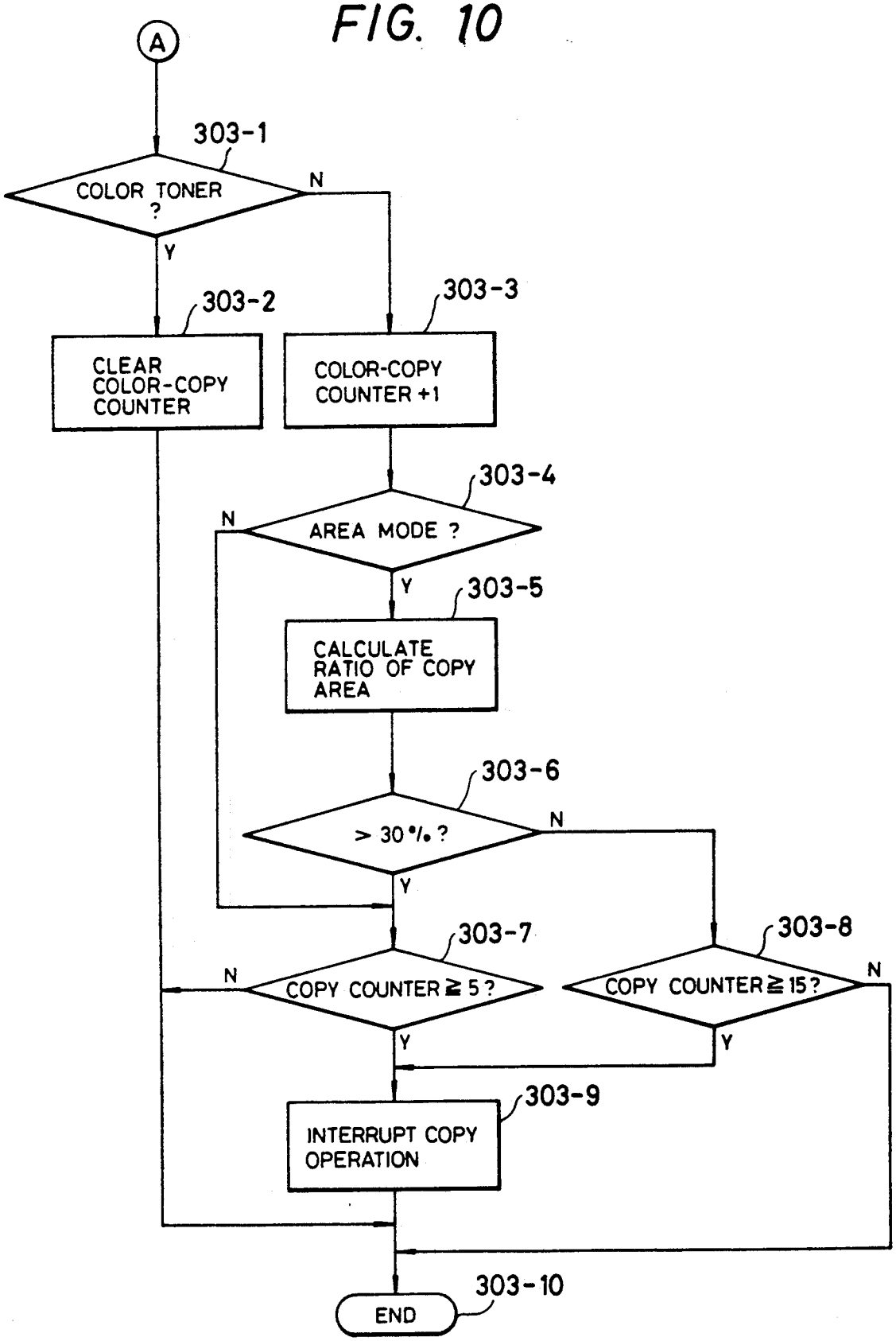

In the above embodiment, when a copy operation is performed using the color developer, the operation is immediately interrupted upon detection of the no-toner state. However, if the number of copies is small (e.g., 3 to 5 originals), control may be achieved so as to complete the operation without interruption. If the designated area is subjected to copy operation by using the color developer and the designated area is small, the number of possible copies to be made can be increased since toner consumption per copy is small. This will be described in the flow chart of FIG. 10. This flow chart is connected to connector a in FIG. 9. The control section 60 determines in step 303-1 the absence/presence of the color toner during the copy operation. If the amount of color toner is determined to be sufficient, a color-copy counter is cleared (303-2). The color-copy counter counts the number of copies in the no-toner state. Upon detection of the no-toner state, the color copy counter is incremented by one (303-3). If a mode is determined to be a mode for copying an area excluding the designated area, the count of the color-copy counter is determined to exceed 5 in step 303-7. If NO in step 303-5, the copy operation continues. If the count exceeds 5, the copy interruption instruction is set in step 303-9, and the copy operation is interrupted. In the area copy mode, a ratio of the designated area to the total area is calculated (303-5). If the ratio exceeds 30%, processing in the normal mode is performed. However, if the ratio is less than 30%, a copy interruption instruction is generated in step 303-9 when the count of the copy counter is 15 or more.

As shown in FIG. 8, detection of the no-toner state prohibits the start of copy. However, if the number of copies is less than a predetermined number, the start of copy may be easily initiated.

The ratio of the copy area can be calculated on the basis of the selected copy paper size, a copy magnification, and the coordinate data of the designated area.

In this manner, when the no-toner LED 150-1 is combined with the LEDs 164 for indicating the color of the set developer, the LED 150-1 can be commonly used for black and color toners. If the no-toner state is detected during the copy operation, the operation is continued or interrupted according to the currently used developer and the currently set copy mode, thereby performing the copy operation without degrading the operability of the copying machine.

II Description of Editor

Figure 11:
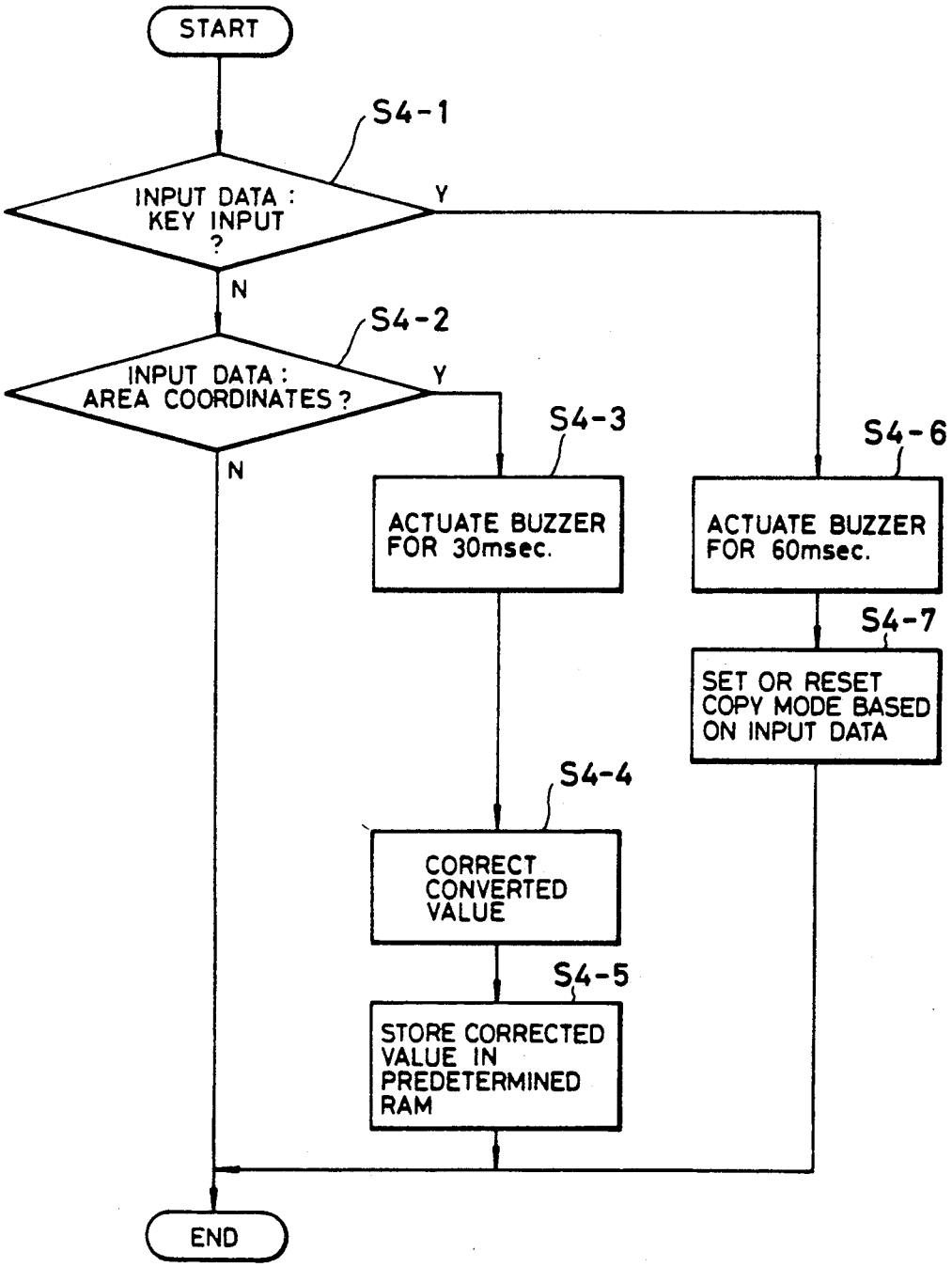
FIGS. 11 to 16 are respectively flow charts for explaining processing of data inputs at the editor.

FIG. 11 is a flow chart of processing of input values from the editor.

The control section 60 determines whether input data is area coordinate data (step 4-2). If the input data is determined to be the area coordinate data in step 4-2, the buzzer is actuated for 30 msec (step 4-3). The input data from the editor is corrected so as to obtain a good image (step 4—4). The corrected value is then stored in the RAM (step 4-5).

However, if the control section 60 determines that the input data is the key input data (step 4-1), the buzzer is actuated for 60 msec (step 4-6). The copy mode is set or reset on the basis of the input data (step 4-7).

Figure 12:
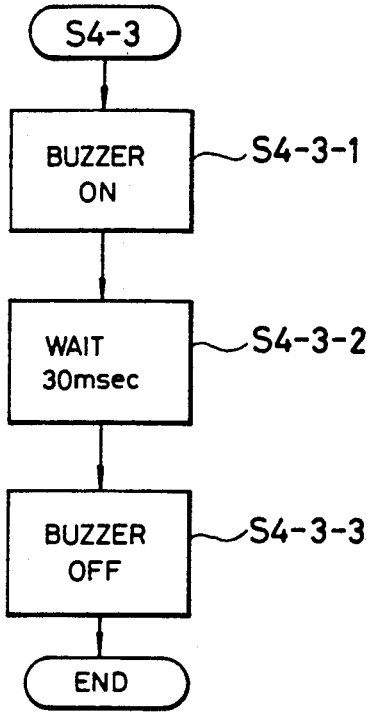

The detailed operations in step 4-3 to 4-7 will be described. FIG. 12 is a flow chart for explaining the detail of step 4-3. The buzzer is turned on (step 4-3-1) to generate a buzzer tone. The buzzer is kept energized for 30 msec (step 4-3). When the period of 30 msec has elapsed, the buzzer is turned off (step 4-3-3).

Figure 13:
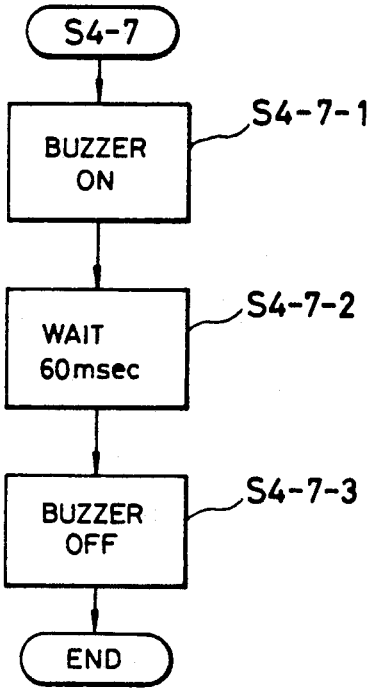

FIG. 13 is a detailed flow chart of step 4-7. The buzzer is turned on (step 4-7-1) to generate a buzzer tone. The buzzer is kept energized for 60 msec (step 4-7-2). When the period of 60 msec has elapsed, the buzzer is turned off (step 4-7-3). As shown in steps 4-3 and 4-7, the buzzer energization time varies on the basis of the copy mode input and the area coordinate data. The buzzer ON times allow the user to recognize different types of inputs so as to reduce input errors. In another arrangement, different ON and flickering times of LEDs may be used instead of using different buzzer energization times.

Figure 14:
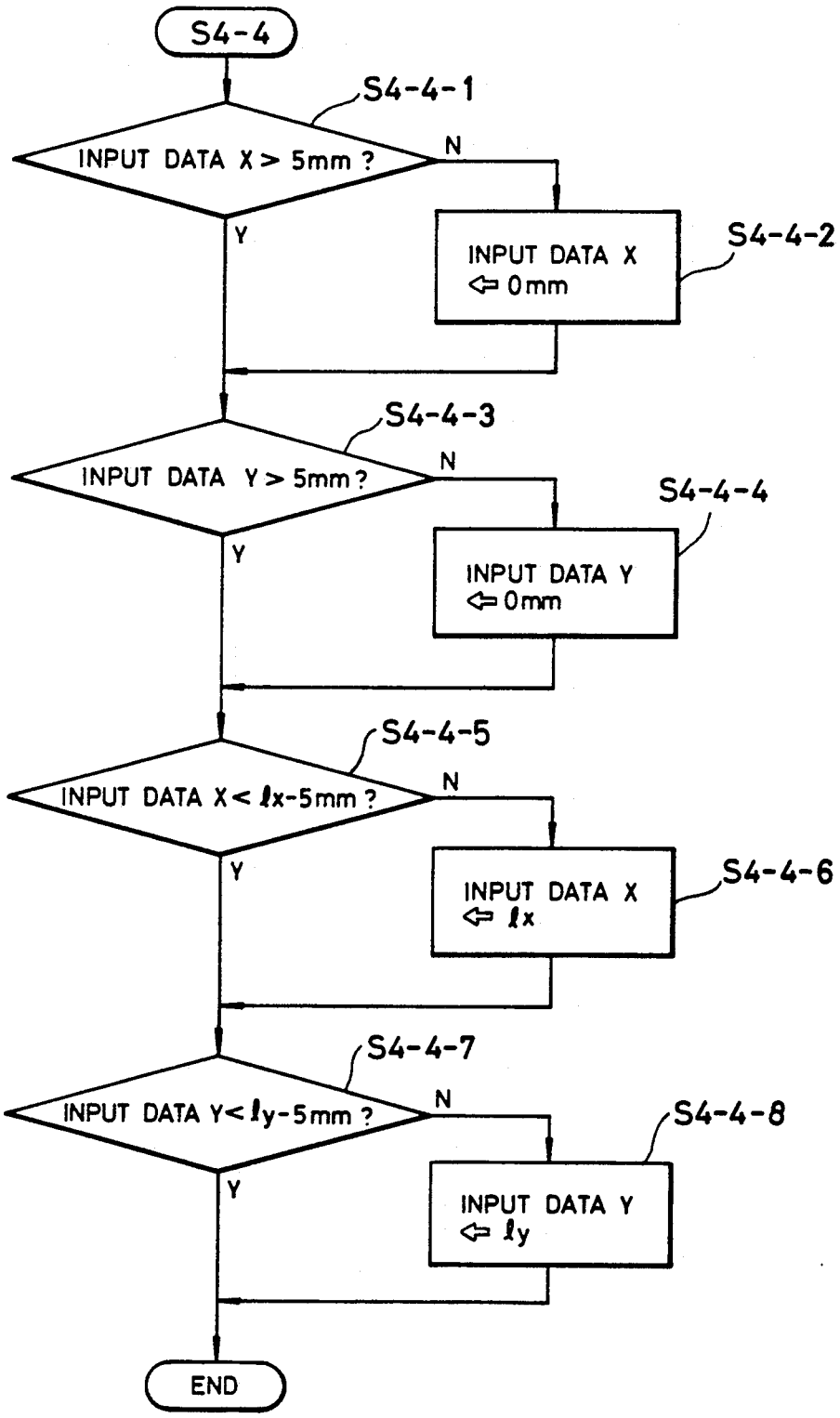

FIG. 14 is a detailed flow chart of step 4—4. Assume that a possible length of the editor along the X direction is lx and that a possible length along the Y direction is ly. The control section 60 determines whether the input data X along the X direction represents a point falling within the range between the boundary of the editor area and the boundary smaller than the editor boundary by 5 mm on each side (step 4-4-1). If YES in step 4-4-1, the input data X is set to be zero (step 4-4-2). The control section 60 then determines whether the input data Y represents a point falling within the range between the editor boundary and the boundary smaller than that by 5 mm on each side (step 4-4-3). If YES in step 4-4-3, the input data Y is set to be zero (step 4-4-4). However, if the input data X represents a value larger than (lx−5 mm) (step 4-4-5), the input data X is set to be lx (step 4-4-6). If the input data Y represents a value larger than (ly −5 mm) (step 4-4-7), the input data Y is set to be ly (step 4-4-8). The above correction is performed so as not to form an excessive image at the edge of the copy sheet because of errors upon designation of a masking or trimming area at the edge of the designation surface of the editor.

In another arrangement, if an original size can be detected (e.g., a plurality of original sensors are arranged under the original glass plate, and the original size is detected by a combination of outputs from these sensors), the length lx along the X direction and the length ly along the Y direction are set to be the size of the original size. In this case, correction operations in steps 4-4-6 and 4-4-8 cannot be effectively performed for the originals smaller than the size of lx times ly since correction is performed regardless of the original size. However, if the original size can be detected, correction operations in steps 4-4-6 and 4-4-8 can be performed on the basis of the original size. Therefore, the better resultant image by masking or trimming can be produced.

The data corrected in step 4-4 is stored in the RAM. By trimming/masking image forming techniques to be described later, masking or trimming of a plurality of independent areas or overlapping areas can be performed.

Figure 15:
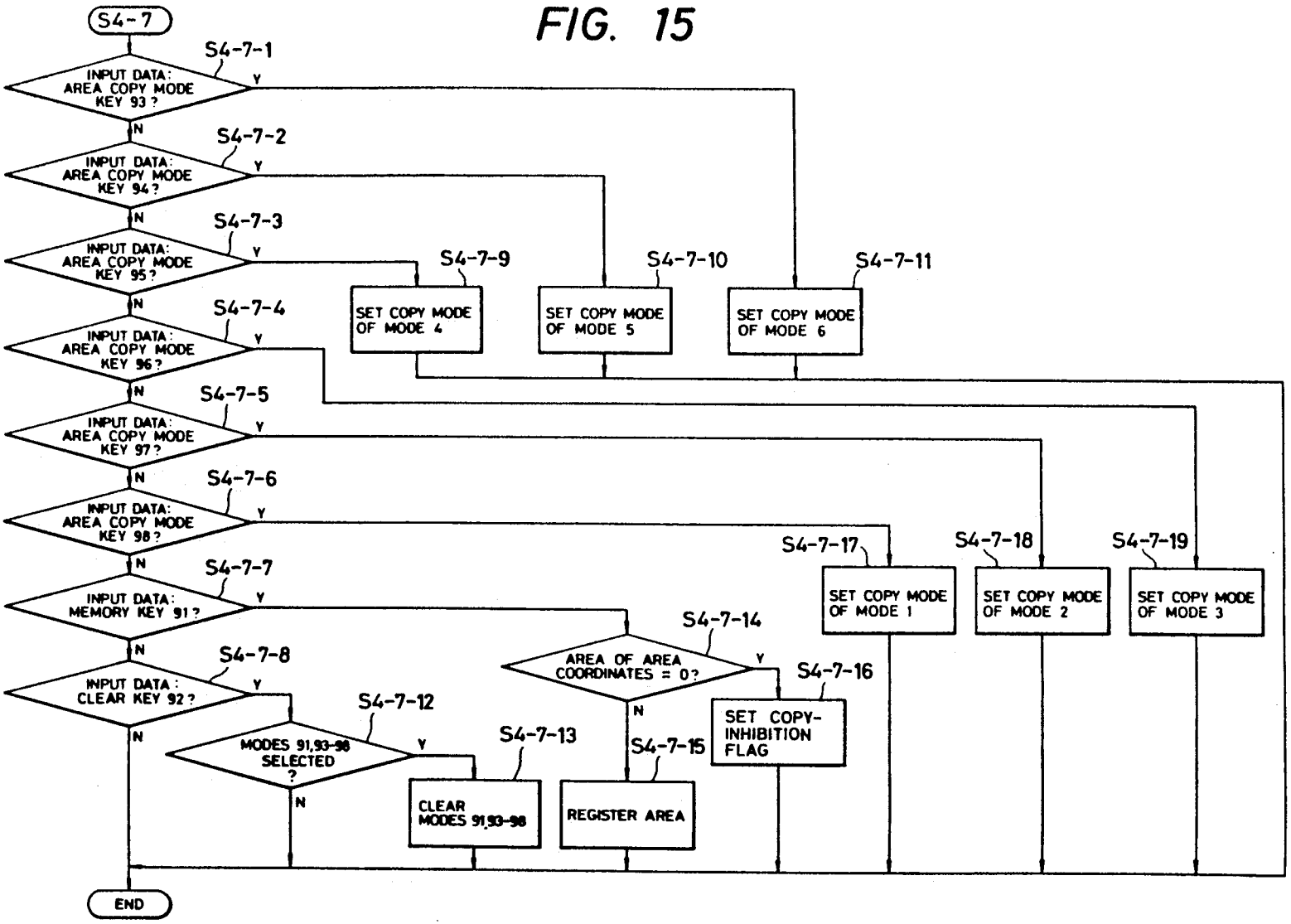

FIG. 15 is a flow chart showing the operation wherein area coordinates, the color mode, multi-copy mode can be designated at the editor.

If the input data is discriminated to be entered by the area copy mode key 93 (FIG. 5-1) (step 4-7-1), mode 6 is selected (step 4-7-11).

If the input data is discriminated to be entered by the area copy mode key 94 (step 4-7-2), mode 5 is selected (step 4-7-10).

If the input data is discriminated to be entered by the area copy mode key 95 (step 4-7-3), mode 4 is selected (step 4-7-9).

If the input data is discriminated to be entered by the area copy mode key 96 (step 4-7-4), mode 3 is selected (step 4-7-19).

If the input data is discriminated to be entered by the area copy mode key 97 (step 4-7-5), mode 2 is selected (step 4-7-18).

If the input data is discriminated to be entered by the area copy mode key 98 (step 4-7-6), mode 1 is selected (step 4-7-17).

If the input data is discriminated to be entered by the memory key 91 (step 4-7-7), the control section 60 then discriminates whether the area of the registered designated area is zero (step 4-7-14). If the area is discriminated to be zero, the control section 60 sets a copy inhibition flag (step 4-7-16). However, if the area is discriminated not to be zero, the control section 60 registers the area (step 4-7-15). The area can be calculated by coordinates of two points of the designated area.

If the input data is discriminated to be entered by the clear key 92 (step 4-7-8), the control section 60 discriminates that one of the mode keys 91 and 93 to 98 is selected (step 4-7-12). If one of the keys is discriminated to be selected, the corresponding mode is cleared.

As is apparent from the above description, the area of area designation, the color mode, or the multi-copy mode can be designated at the editor.

The two-sided copy mode may also be easily selected at the editor.

Figure 16:
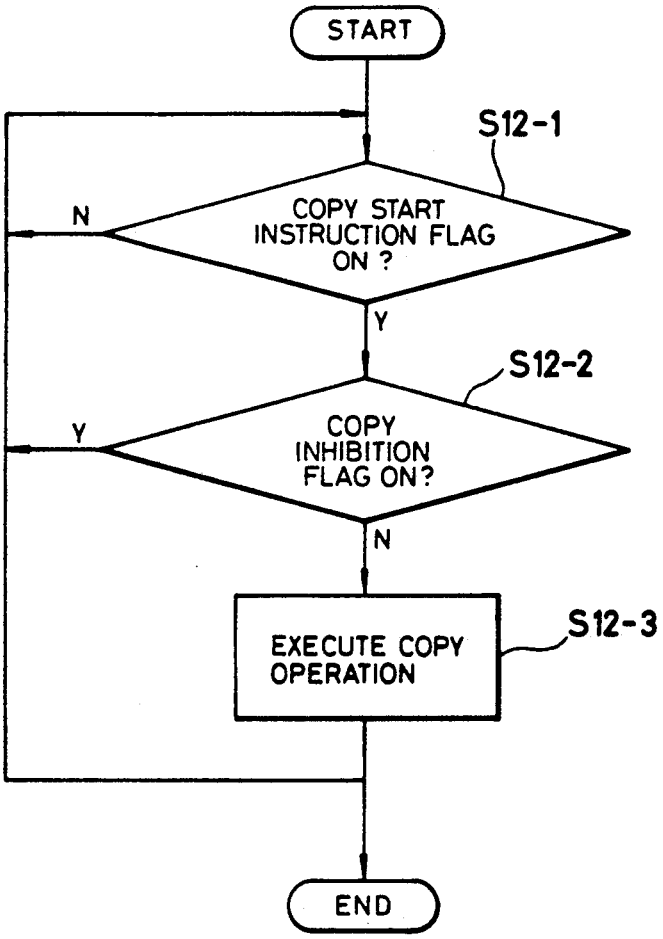

FIG. 16 is a flow chart for explaining the operation wherein the copy operation is not performed when the area of area designation is zero. When the copy key 117 is turned on, the copy operation start flag is set. The control section 60 determines whether the copy start instruction flag is set (step 12-1). If YES in step 12-1, the control section 60 discriminates whether the copy inhibition flag is set (step 12-2). If YES in step 12-2, copy operation is started (step 12-3).

This step is performed to inhibit the copy operation when an invalid area is registered. If the invalid area registration is executed because of a user error, the error is signalled to the user.

In the above embodiment, when the input data represents a point falling within the range between the editor boundary and the boundary smaller than that by 5 mm on each side, the input data is corrected. If the user wishes to change the correction range of the input value, the following procedures are required. The user performs the following sequential key input [*] [1] [*] (i.e., the asterisk key 121, the [1] key in the ten-key pad 122, and the asterisk key 121 are sequentially depressed) to set the mode for changing the correction range of the editor input. Subsequently, the user performs the following key input [3] [*] (the [3] key in the ten-key pad 122 is depressed, and the asterisk key 121 is depressed). In this case, the range is changed from 5 mm to 3 mm. However, if the [0] key in the ten-key pad 122 is depressed in place of the [3] key therein, the correction range of the editor is changed to 0 mm. This indicates that the correction of the editor input is not executed. When the editor input is corrected in the manner described above, the value of 5 mm in steps 4-4-1, 4-4-3, 4-4-5, and 4-4-7 of the flow chart of FIG. 14 has changed.

Description of Area Designation by Key

Figure 17:
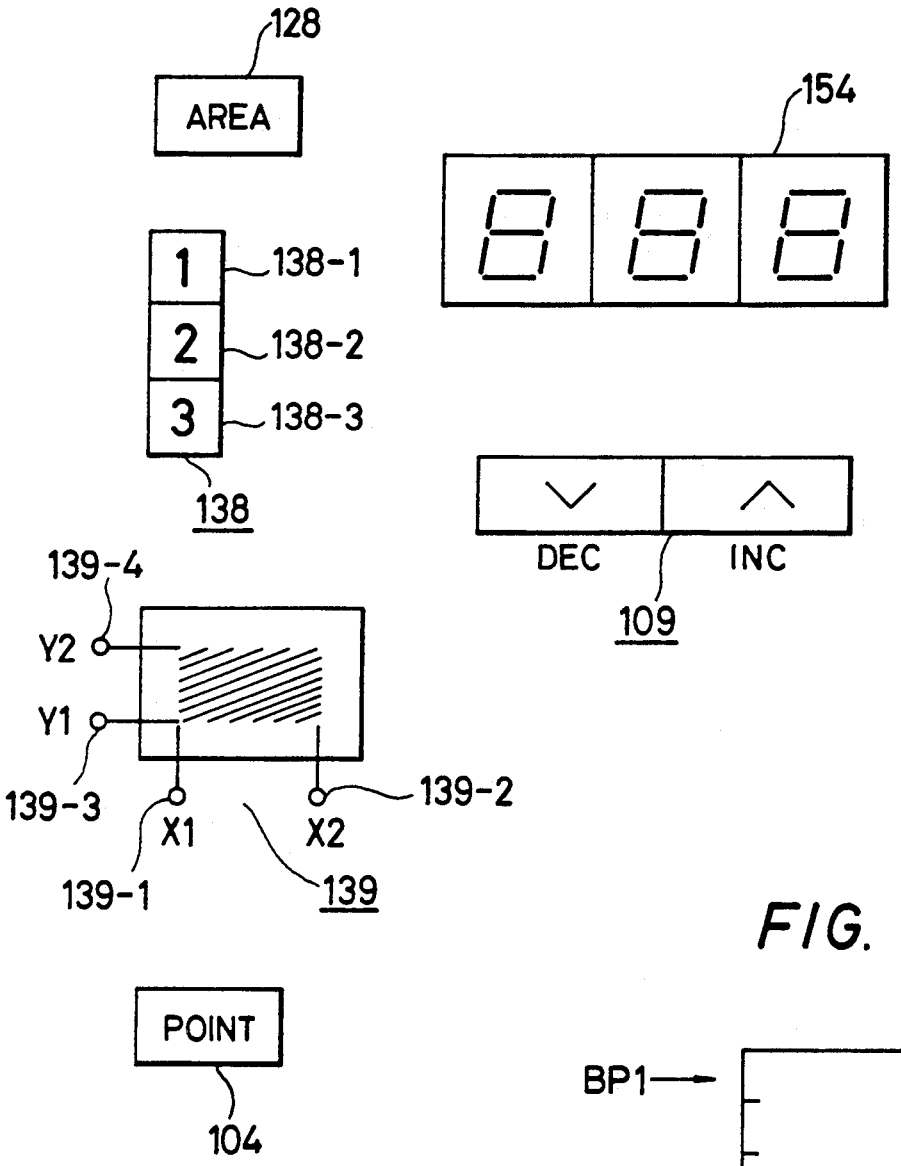
FIG. 17 is a view for explaining area designation with a key.
Figure 18:
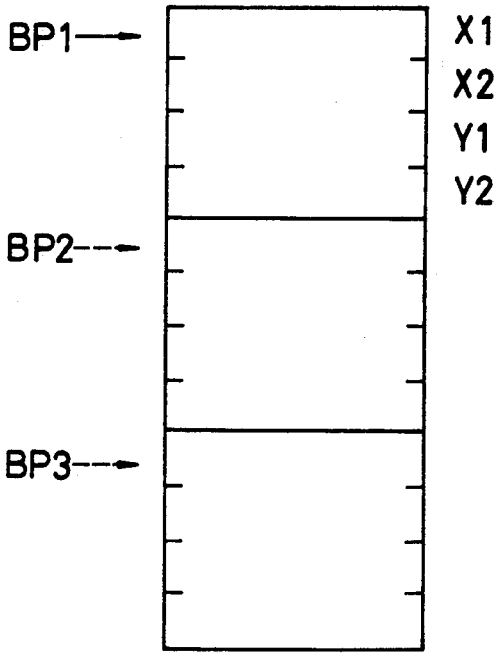
FIG. 18 is a memory map showing the position of base pointers.

The area designation by a key and coordinate inputs will be described with reference to FIGS. 17 and 18. Three rectangular areas each represented by two diagonal points are prestored in an area memory (not shown). Even if the copying machine is used for the first time, data is prestored. When the user designates the area, he must select a combination of the areas stored in the memory. More specifically, the area or combinations thereof are area 1, a combination of area 1 and area 2, and a combination of area 1, area 2, and area 3. An area designation operation will be described below. When the area key 128 is depressed once, the LED 138-1 (FIG. 17) is turned on. In this state, only area 1 is valid. When the area key 128 is depressed for the second time, the LEDs 138-1 and 138-2 are turned on. In this state, area 1 and area 2 are valid. When the area key 128 is then depressed for the third time, the LEDs 138-1, 138-2, and 138-3 are turned on. In this state, area 1, area 2, and area 3 are valid. When the area key 128 is depressed for the fourth time, all the LEDs 138 are turned off, and the area designation is released.

Four coordinate data signals are stored in each of the three areas. .The operation for updating these data signals will be described below.

The area key 128 is depressed to designate the area to be updated. When the area key 128 is depressed for the first, second, and third times, area 1, area 2, and area 3 are selected. As shown in FIG. 18, the base pointer BP representing the data to be updated is designated. It should be noted that the ON/OFF operations of the LEDs 138 are the same as in valid area designation.

When the area to be updated is designated, the user depresses the point key 104 to select the coordinate data to be updated. When the point key 104 is depressed, the LED 139-1 flickers. The base pointer is designated as X1, so that the coordinates of point X1 can be input. In this case, the currently stored X1 data is displayed on the magnification LED display 154 in millimeters. It should be noted that data X1 represents the x-coordinate at the lower left corner of the area, that data X2 represents the x-coordinate at the upper right corner of the area, that data Y1 represents the y-coordinate at the lower left corner of the area, and that data Y2 represents the y-coordinate at the upper right corner of the area. The data X1 can be updated by using the ten-key pad 122 or the zoom magnification key 109. In order to update the value by using the zoom magnification key 109, the value displayed on the LED display 154 is incremented or decremented.

When the point key 104 is then depressed, the data displayed on the display 154 is stored as the data of point X1. At the same time, data of point X2 is displayed on the display 154. The base pointer is then updated from X1 to X2. In addition, the operation of the LED 139-1 is changed from flickering to lit, and the LED 139-2 for X2 flickers. When data updating for X2 is required, the same operation as described above is performed. By depressing the point key 104, the data can be updated in an order of Y1 and Y2. When the point key 109 is depressed to store the data of Y2, all LEDs 139-1 to 139-4 for X1 to Y2 are turned off. When the base pointer is not selected, i.e., all the LEDs 138-1 to 138-3 are turned off, the data of X1 to Y2 cannot be updated even if the point key 104 is depressed.

When the point key 104 is depressed, the LEDs 138 of the selected area flicker, and the value of the base pointer can be checked. When storage up to the data of Y2 is completed, the LEDs 138 of the selected area are changed from flickering to lit. However, the base pointer is changed unless the area key 128 is depressed.

When the area key 128 is depressed while one of the LEDs 139 for X1 to Y2 flickers or is lit, the base pointer is shifted to the next area. However, if the base pointer is designated for area 3, the data updating mode is reset.

Description of Blank Exposure

Control of the LED array 14 will be described in the area designation copy mode.

Figure 19:
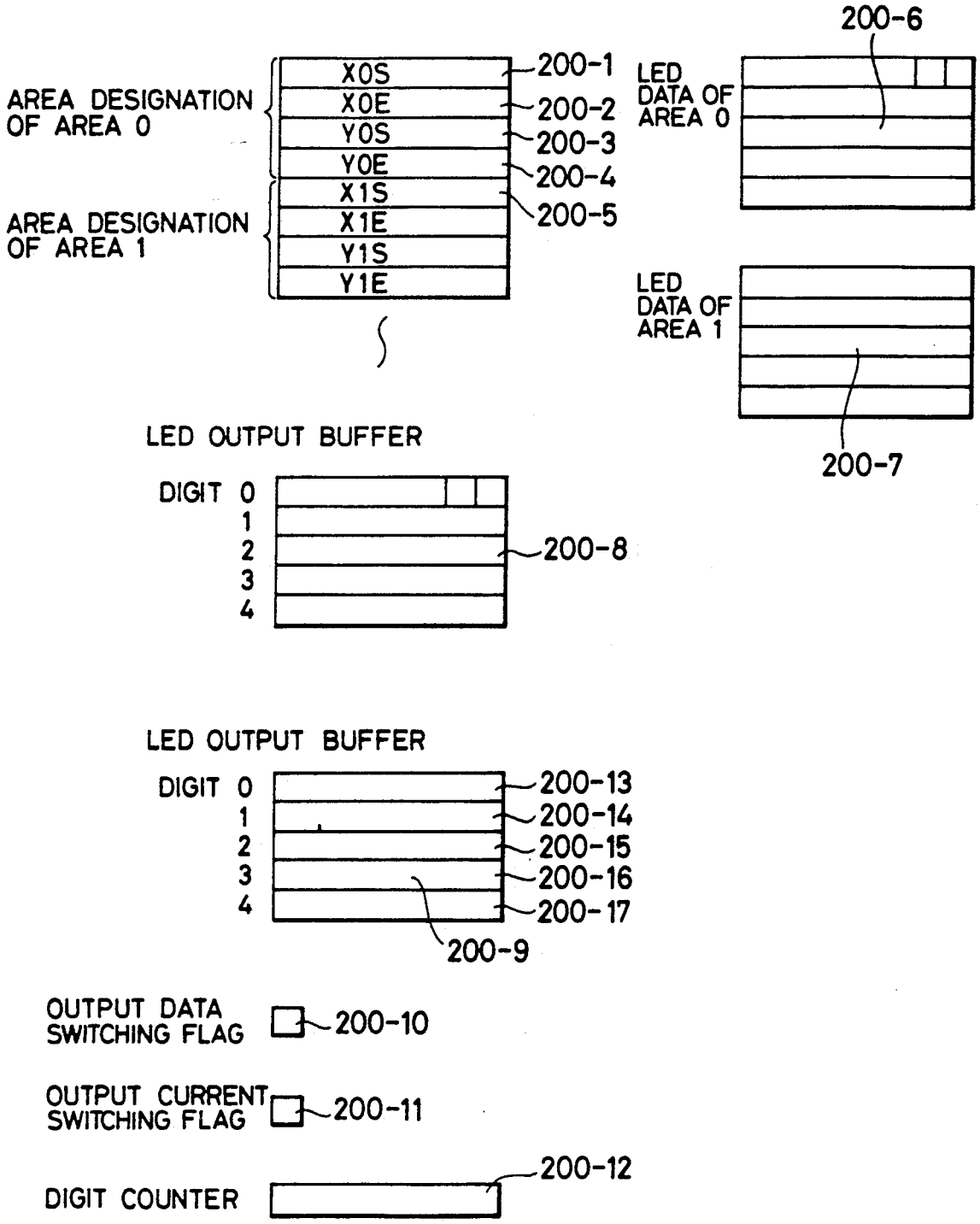
FIG. 19 is a memory map of a RAM for storing LED array control data.

FIG. 19 shows part of the memory map of the RAM to assure the area required for control. For illustrative convenience, the number of areas subjected to area designation is 2. A memory area 200-5 stores data of the area set by the operating section 100 or the editor 70. A memory area 200-1 stores data of area 0 along the X direction (i.e., the scanning direction of the optical system). A memory area 200-2 stores end data of area 0 along the X direction. A memory area 200-3 stores start position data of area 0 along the Y direction (the vertical direction). A memory area 200-4 stores end data of area 0 along the Y direction. In each memory area, four data signals are stored. This is also the case for area 1. A memory area 200-6 stores LED ON/OFF data corresponding to the data stored in the memory areas 200-3 and 200-4. In this embodiment, the memory area 200-6 comprises $5\times24$ bits, and each bit corresponds to one LED.

If data "100" is stored in the memory area 200-3 (Y0S) and "200" is stored in the memory area 200-4 (Y0E), LEDs in the LED array 14 are arranged in pitches of 2.5 mm. The 40th (=100/2.5) bit to the 80th bit of the memory area 200-6 are set at logic "1", and other bits are set at logic "0".

A memory area 200-7 stores data corresponding to Y-direction data of area 1 in the same manner as described above. A memory area 200-8 is used to update the lighting state of the LED array and has the same number of bits as that of each of the memory areas 200-6 and 200-7. A memory area 200-9 stores dynamic lighting status data of the LED array. In a manner to be described later, data stored in the memory area 200-9 is output in correspondence with each digit, thereby driving the transistors 82. Memory areas 200-10 and 200-11 respectively store an output-data-switching flag and an output-current-switching flag, both of which are used to update the lighting state of the LED array. A memory area 200-12 serves as a digit counter used for controlling which digit is output.

Figure 20:
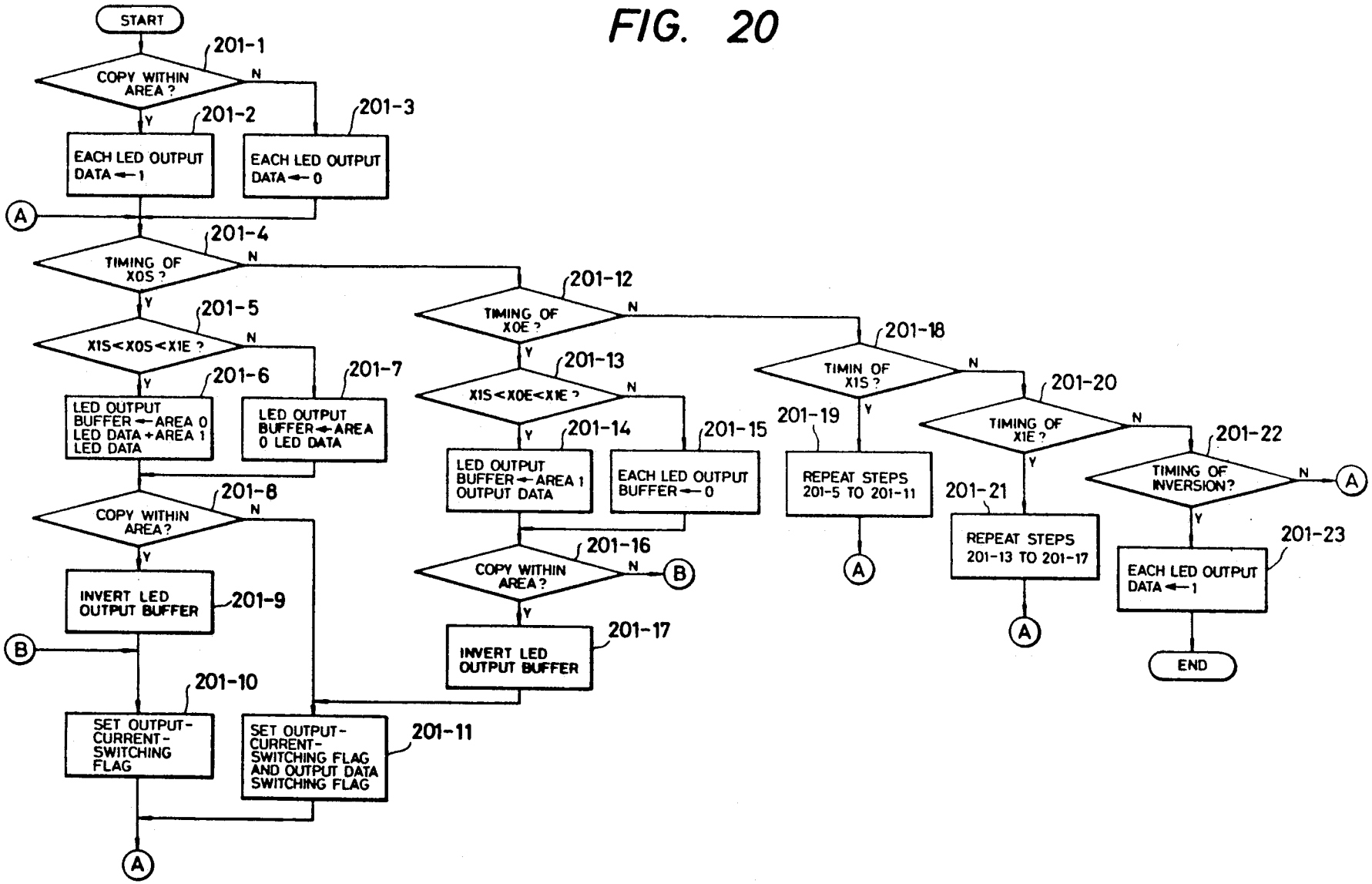
FIGS. 20 and 21 are flow charts for explaining LED array control.

FIG. 20 is a flow chart showing how the LED array 14 is controlled. When copy operation is started, the optical system starts scanning of the original along the X direction. The control section 60 determines in step 201-1 whether the copy within the area is set. If YES in step 201-1, the flow advances to step 201-2 to set all "1"s in the output data from the memory area 200-9. In this state, all LEDS in the LED array 14 are turned on, and the image is entirely erased. However, if NO in step 201-1, the flow advances to step 201-3, and all "0"s are set in the output data from the memory area 200-9. In this case, all LEDs in the LED array 14 are turned off, the image is entirely produced along the Y direction. The control section 60 determines in step 201-4 whether the current timing is an X-direction timing of area 0. If NO in step 201-4, the flow advances to step 201-12. The control section 60 determines in step 201-12 whether the current timing is the X-direction end timing of area 1. If NO in step 201-12, the flow advances to step 201-18 to determine whether the current timing is the X-direction start timing of area 1. If NO in step 201-18, the control section 60 determines in step 201-20 whether the current timing is the X-direction end timing of area 1. If NO in step 201-20, the flow advances step 201-22 to determine whether the current timing is the optical system inversion timing. If NO in step 201-22, the flow advances to step 201-4. In this manner, the current timing is not any timing to be processed, the loop of steps 201-4, 201-12, 201-18, 201-20, 201-22, and 201-4 is repeated.

If the current timing is determined to be the X-direction start timing of area 0, the flow advances from step 201-4 to step 201-5, and a series of operations are performed.

The control section 60 determines in step 201-5 whether the value of the X-direction start data falls within the range between the start data value and the end data value. If YES in step 201-5, the flow advances to step 201-6. In this case, since area 0 overlaps area 1, a logical OR of the LED data of area 0 from the memory area 200-6 and the LED data of area 1 from the memory area 200-7 is set in the memory area 200-8 serving as an LED output buffer. The flow then advances to step 201-8. However, if NO in step 201-5, the X-direction start position of area 0 completely overlaps that of area 1. Therefore, the contents of area 0 from the memory area 200-6 are stored in the LED output buffer 200-8 without modifications. The flow then advances to step 201-8. The control section 60 determines in step 201-8 whether the copy within the area is performed. If YES in step 201-8, the flow advances to step 201-9. In step 201-9, the output-current-switching flag is set in the memory area 200-11 in step 201-10, and the flow returns to step 201-4. As described above, when "100" and "200" are respectively stored in the memory areas 200-3 and 200-4, the corresponding LEDs along the Y direction are turned off, and the remaining LEDs are turned on. Therefore, only the image within the predetermined area is output. In a manner to be described later, since only the output-current-switching flag is set in the memory area 200-10, the previous lighting state of the LED array 14 is maintained, and one period of digit 0 to digit 4 is subjected to high power lighting. Thereafter, the lighting state of the LED array 14 is switched. However, If NO in step 201-8, the flow advances to step 201-11. The output-data-switching flag and the output-current-switching flag are respectively set in the memory areas 200-10 and 200-11. In this case, the LED output buffer is not inverted, so that when "100" and "200" are respectively set in the memory areas 200-3 and 200-4, only the LEDs corresponding to "100" to "200" along the Y direction are turned on, and the corresponding image is erased. Since both the output-data-switching flag and the output-current-switching flag are respectively set in the memory areas 200-10 and 200-11, the lighting state of the LED array 14 is switched from the timing at which the next digit 0 is output, and the high power lighting state is obtained for one period. Thereafter, the flow returns to step 201-4.

An operation will be described wherein the current timing is determined to be the X-direction end timing of area 0. The flow advances from step 201-12 to step 201-13. The control section 60 determines in step 201-13 whether or not the X-direction end timing of area 0 along the X direction falls within the range between the start and end positions of area 1. If YES in step 201-13, the flow advances to step 201-14. Since the X-direction end position of area 0 is included in area 1 although copy of area 0 is completed, LED data of area 1 from the memory area 200-7 is stored in the LED output buffer 200-8. However, if NO in step 201-13, the flow advances to step 201-15. In this case, the X-direction end position of area 0 is not included in any area, all bits of the LED output buffer 200-8 are set at logic "0". The control section 60 then determines in step 201-16 whether or not the copy within the area is performed. If NO in step 201-16, the flow advances to step 201-17, and the contents of the LED output buffer 200-8 is inverted. In step 201-11, the output-data-switching flag and the output-current-switching flag are respectively set in the memory areas 200-10 and 200-11, and the flow returns to step 201-4. However, if NO in step 201-16, the flow advances to step 201-10. In this step, only the output-current-switching flag is set, and the flow returns to step 201-4.

If the X-direction start timing of area 1 is obtained, the flow advances from step 201-18 to step 201-19. In step 201-19, the control section 60 performs the same processing as in the case wherein the current timing is the X-direction start timing of area 0. This processing can be performed by replacing only area number 0 with 1, and a detailed description thereof will be omitted.

If the control section 60 determines that the current timing is the X-direction end timing of area 1, the flow advances from step 201-20 to step 201-21. The same processing as in the case wherein the current timing is the X-direction end timing of area 0 is performed. When scanning operation of the optical system advances and the inversion timing thereof reaches, the flow advances from step 201-22 to step 201-23. All bits of the LED output data from the memory area 200-9 are set at logic "1", and all LEDs of the LED array 14 are turned on to erase the unwanted image. The optical system is then moved backward to complete one copy cycle. It should be noted that if the number of areas exceeds 3 or more, the same operation as described above can be performed.

Figure 21:
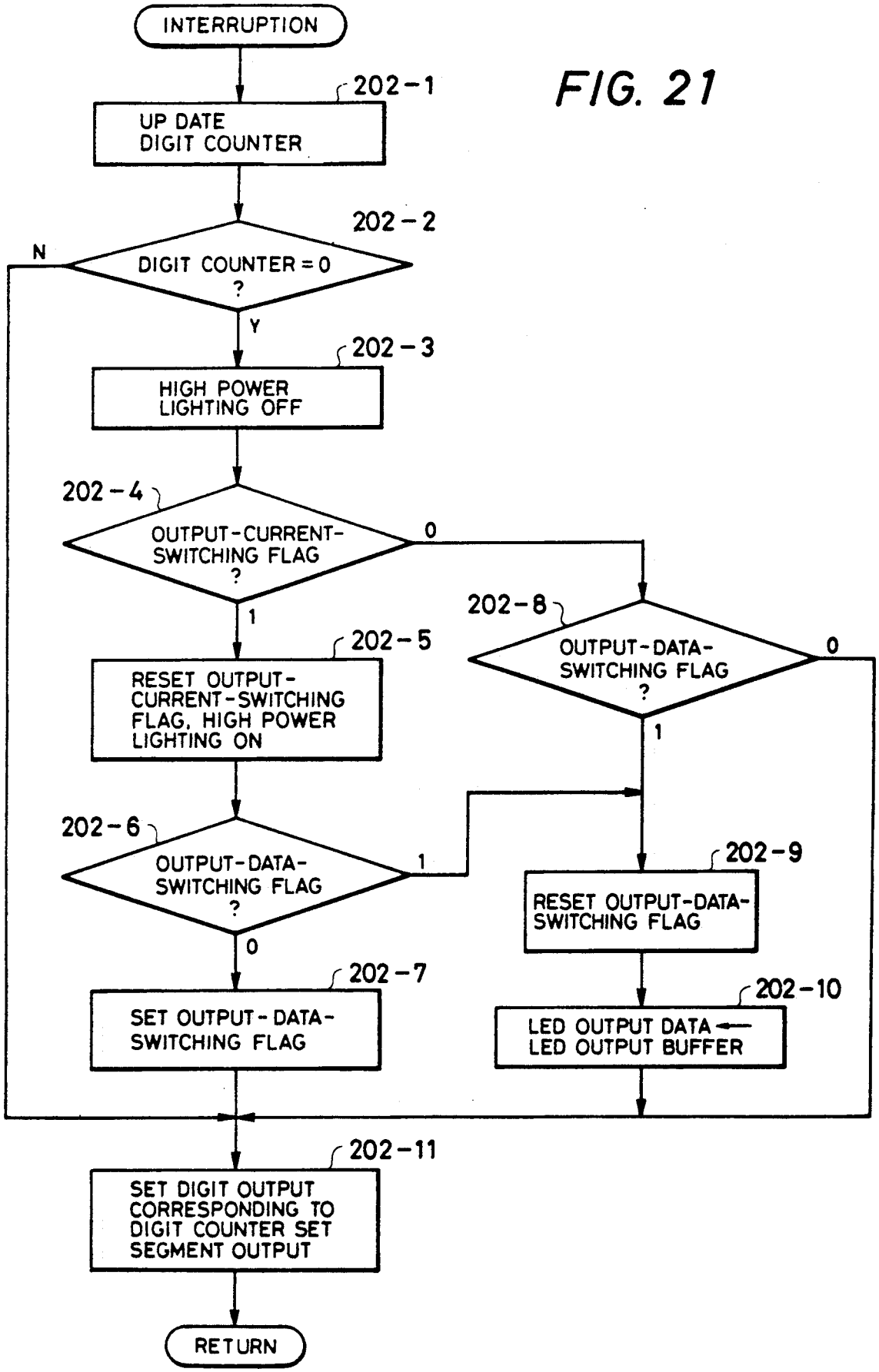

The operation for controlling dynamic driving of the LED array 14 will be described with reference to FIG. 21. This routine is started in response to a timer interruption for every 1 msec.

The operation will be first described wherein neither the output-current-switching flag nor the output-data-switching flag are not set in the memory areas 200-11 and 200-10 respectively. In step 202-1, the memory area 200-12 as the digit counter is updated. In this embodiment, the used digits are digit 0 to digit 4. The count of the digit counter 200-12 is updated from 0 to 4. If the count of the digit counter is not zero, the flow advances to step 202-11. However, if zero, the flow advances to step 202-3, and high power lighting is disabled. The steps advance in an order of steps 202-4, 202-8, and 202-11. The digit and segment outputs corresponding to the count of the digit counter 200-12 are set. For example, the count of the digit counter 200-12 is zero, digit 0 is turned on. The segment output is data in the memory area 200-13, and this data corresponds to digit 0 of the LED output data of the memory area 200-9. If logic "1", then the corresponding LEDs are turned on. However, if logic "0", then the corresponding LEDs are turned off. The count of the digit counter is sequentially updated. In the next timing, digit 1 is turned on in step 202-11, and the segment output is the data in the memory area 200-14, and this data corresponds to digit 1 in the LED output data of the memory area 200-9.

An operation will be described wherein both the output-current-switching flag and the output-data-switching flag are respectively set in the memory areas 200-11 and 200-10. The same processing as described above is performed until the count of the digit counter 200-12 is 0. When the count is 0, the flow advances from step 202-2 to step 202-3, and high power lighting is disabled. The previous state is the high power lighting OFF state. In this case, this state is of no significance.

The flow advances from step 202-4 to step 202-5, and high power lighting is enabled. The output-current-switching flag in the memory area 200-11 is reset. The flow then advances from step 202-6 to step 202-9, and the output-data-switching flag in the memory area 200-10 is reset. In step 202-10, the content of the output buffer 200-8 is set as the LED output data in the memory area 200-9. Processing is then performed in step 202-11. When the count of the digit counter 200-12 is zero, the flow advances from step 202-2 to step 202-3, and high power lighting is disabled. The output-current-switching flag and the output-data-switching flag have been already reset, so that the flow advances in an order of steps 202-4, 202-8, and 202-11, and normal processing is performed. The output state of the LED array at the timing of digit 0 is switched, and high power lighting is performed for the subsequent one period.

Figure 22:
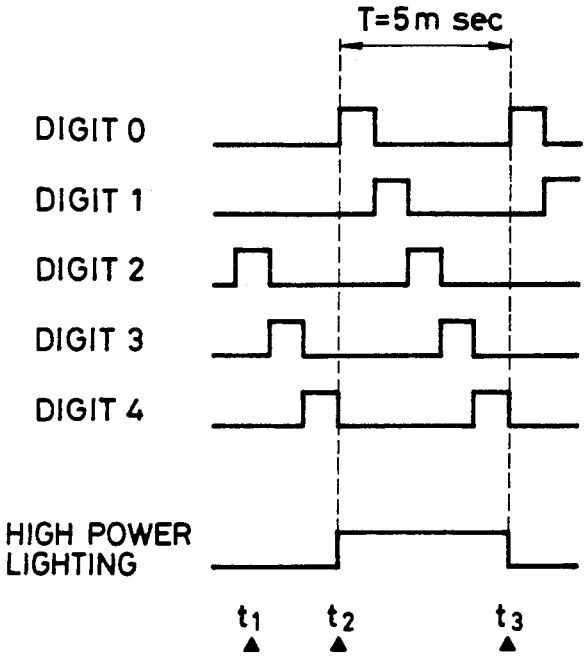
FIGS. 22 and 23 are respectively a timing chart and a view for explaining high power lighting of the LED array.

An operation will be described wherein only the output-current-switching flag in the memory area 200-11 is set. When the count of the digit counter 200-12 is zero, the flow advances from step 202-2 to step 202-3, thereby disabling high power lighting. The flow advances from step 202-4 to step 202-5, and the operation described above is performed. The flow advances from step 202-6 to step 202-7, and the output-data-switching flag in the memory area 200-11 is set, and the flow is ended through step 202-11. When the count of digit counter 200.12 is 0, the flow advances from step 202-2 to step 202-3, and high power lighting is disabled. The flow advances in an order of steps 202-4, 202-8, and 202-9, and the output-data-switching flag in the memory area 200-10 is reset. The contents of the LED output buffer 200-8 are set in the memory area 200-9 in step 202-10, and the output state of the LED array 14 is switched. Therefore, the previous one-period output state of the LED array 14 is maintained, and high power lighting is enabled from the timing of digit 0. Thereafter, the output state of the LED array 14 is updated. The updating timings of the digit outputs, high power lighting and LED output data are shown in FIG. 22. Referring to FIG. 22, time t1 is the start or end timing of each area. In this case, the output-current-switching flag in the memory area 200-11, the output-data-switching flag, and the LED output buffer 200-9 are reset in the image conversion mode.

Figure 23:
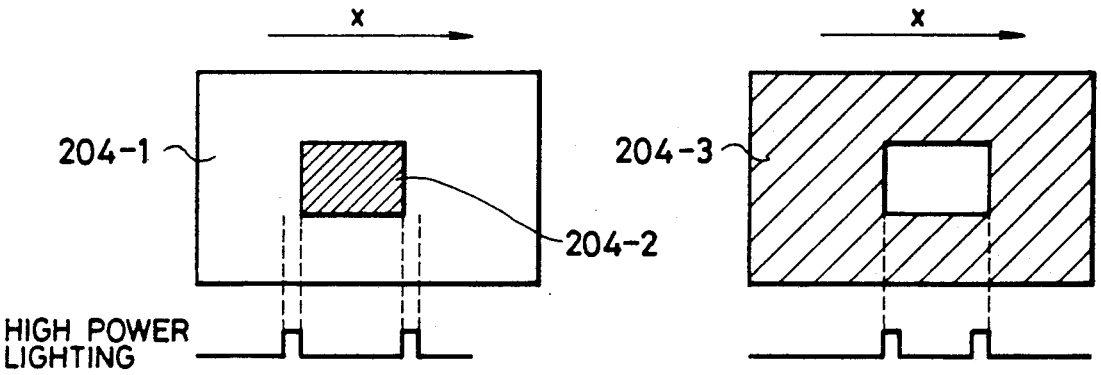

High power lighting is enabled at an output timing t2 of the first digit 0. After the lapse of one period T, high power lighting is disabled. The LED output data is updated at time t2 or t3 according to the image conversion mode and the area start or end position. LED output data updating at time t2 is performed for the area end timing in the case of copy within the area and the area start timing in the case of copy outside the area. LED output data updating at time t3 is performed for the area end timing in the case of copying outside the area and the area start timing in the case of copying within the area. As shown in FIG. 23, in either copying within the area or copying outside the area, high power lighting can be enabled for the nonimage area side at the boundary between an image area 204-2 and a nonimage area 204-1, thereby guaranteeing the sharp edge. The lighting state of the LEDs is changed in response to the timing of digit 0, so that the edge can be made linear. This state is shown in FIG. 24.

Figure 24:
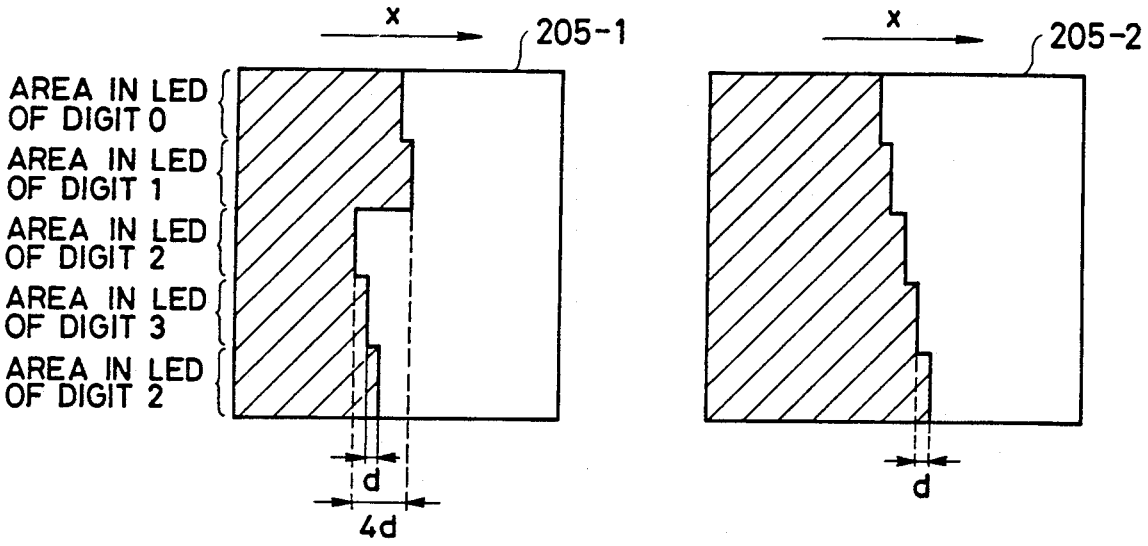
FIG. 24 is a view showing a state of erasure by LED lighting.

FIG. 24 shows a case wherein the OFF state of all LEDs is switched to the ON state of all LEDs at a timing of digit 2. Reference symbol d denotes a distance at which the drum travels for 1 msec. As shown in FIG. 24, an error in a maximum of 4*d* occurs between digit 1 and digit 2. However, according to the present invention, traveling of the drum is synchronized with digit 0, so that the error is always given as d, as indicated by case 205-2. Therefore, the boundary can be smoothly observed. In addition, the LED array can be obliquely arranged to further improve linearity.

Figure 25:
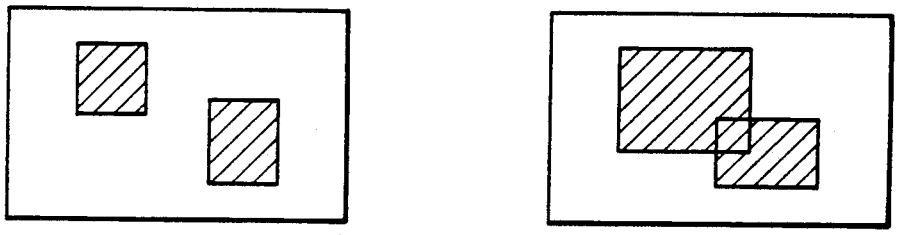
FIGS. 25 and 26 are views showing outputs by designation of a plurality of areas.

FIG. 25 shows output results when the two regions are used for copying within the area. The hatched area is an output image. The logical OR of the two regions is calculated. Therefore, even if the two areas overlap each other or are separated from each other, each image of only a desired portion can be obtained.

Figure 26:
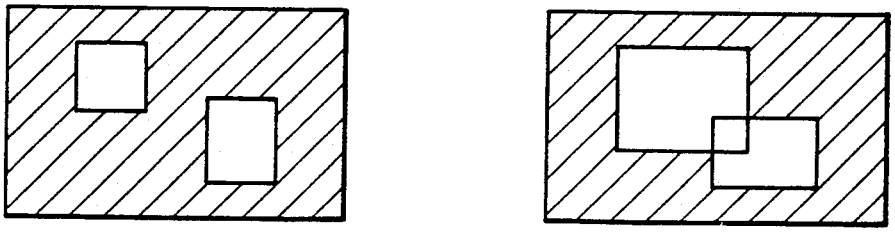

FIG. 26 is a view showing output results when two areas are used in copying outside the area. The hatched portions constitute output images. In the same manner as in copying within the area, each of images of desired areas can be obtained even if the two areas overlap each other or are separated from each other.

III Description of Editor

Figure 27:
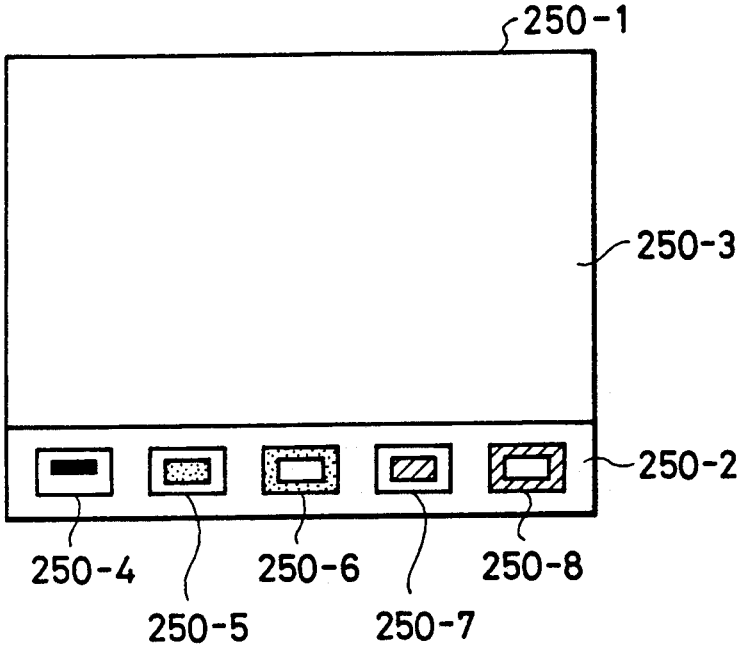
FIG. 27 is a view showing another editor.

Another embodiment will be described wherein area designation is different from that described above. FIG. 27 shows an editor 250-1. The editor 250-1 includes an image conversion mode setting section 250-2 and an area designation section 250-3. The mode setting section 250-2 includes a paint-out designation portion 250-4, a portion 250-5 for designating a color within the area, a portion 250-6 for designating a color outside the area, a portion 250-7 for designating black within the area, and a portion 250-8 for designating black outside the area. After the user designates desired two points in the area designation section 150-3, a desired mode setting portion is depressed to set one area (i.e., a rectangle defined by two diagonal points), and the corresponding mode is registered. Paint-out designation by the portion 250-4 allows paint-out of the designated area with a designated color regardless of the image of the original. Color designation within the area by the portion 250-5 allows copying of an image within the designated area with a color toner. Color designation outside the area by the portion 250-6 allows copying of an image of the outside the designated area with a designated color. Black designation within the area by the portion 250-7 allows copying of an image within the area with black. Black designation outside the area by the portion 250-8 allows copying of an image outside the designated area with black.

Figure 28:
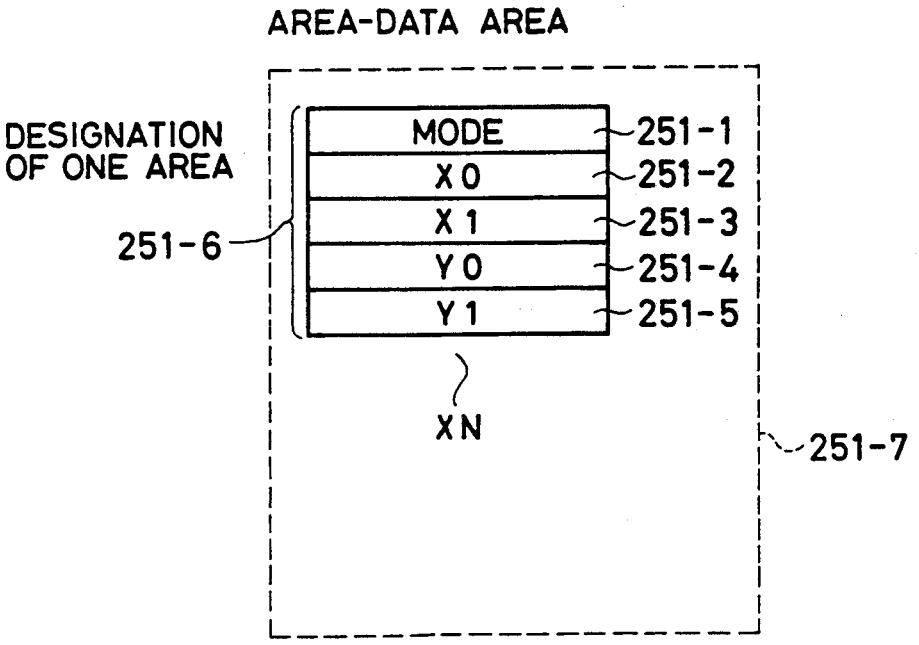
FIG. 28 is a memory map of a memory for storing area data.

FIG. 28 shows an area-data area 251-7 for storing designated area data in the RAM. Each data 251-6 for designation of one area consists of designated mode data 251-1 representing., e.g., a mode for designating with red an image within the area and with black an image outside the area, and coordinate data 251-2 to coordinate data 251-5 of the designated area. The area-data area 251-7 includes a plurality of data each representing the designation of one area. The user depresses two desired points on the area designation section 250-3 of the editor 250-1 with a pen (not shown) and then depresses a desired portion of the mode designation section 250-2, so that point data is stored as the coordinate data 251-2 to 251-5.

Figure 29:
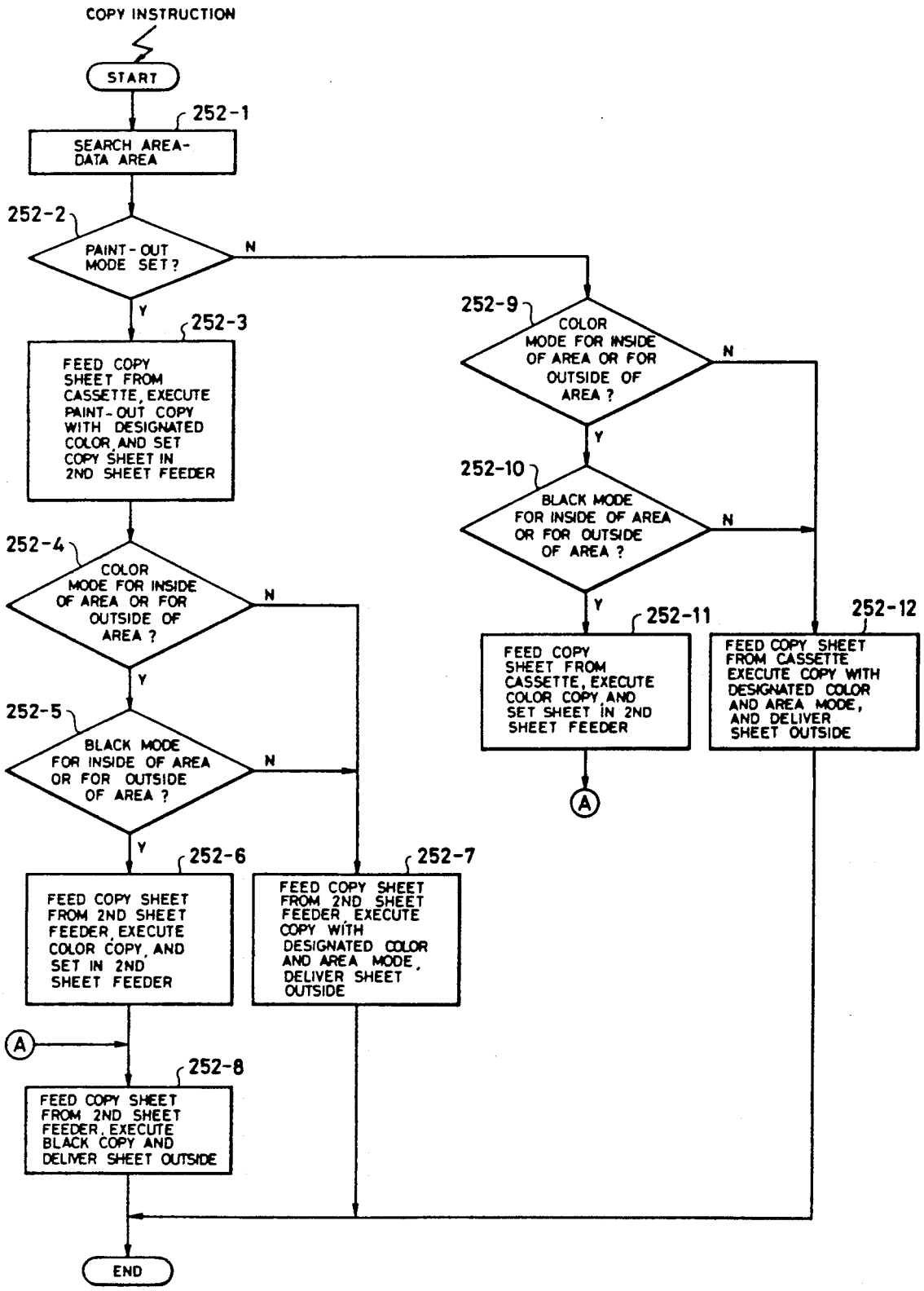
FIGS. 29 and 30 are flow charts showing copy operation in the area designation mode.
Figure 32:
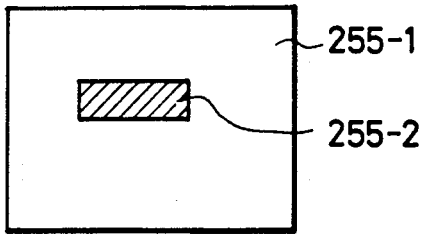

The copy operation after input of a copy instruction will be described with reference to FIG. 29. In step 252-1, the control section 60 searches the mode data 251-6 in the area-data area 251-7. The control section 60 then checks in step 252-2 whether the paint-out mode is set. The following description will be made when the control section 60 determines that the paint-out mode is set. In step 252-3, a transfer sheet is fed from the corresponding cassette, and paint-out copy operation is performed such that the area designated as the paint-out area is painted out with a designated color (to be described later). Next, a so-called overlap operation will be described. The transfer sheet is set in the second sheet feeder 23 such that the copied surface faces downward. In this case, as shown in FIG. 32, only a designated portion 255-2 of the transfer sheet is painted out with the designated color, the other portion is kept white. The control section discriminates in step 252-4 whether the color mode within or outside the area is set. If NO in step 252-4, the flow advances to step 252-7. However, if YES in step 252-4, the control section 60 determines in step 252-5 whether or not the black color mode within or outside the area is designated. If NO in step 252-5, the flow advances to step 252-7. However, if YES in step 252-5, the flow advances to step 252-6.

Therefore, if color and black copy operations are to be performed, the flow advances to step 252-6. However, if either a color or black copy operation is to be performed, the flow advances to step 252-7. In step 252-6, the transfer sheet is fed from the second sheet feeder and color copy operation in the area designation mode is performed for the designated area. The resultant transfer sheet is delivered to the second sheet feeder again such that the copied surface faces downward. In step 252-8, the transfer sheet is fed from the second sheet feeder to perform black copy operation for the designated area in the area designation mode. The copied transfer sheet is delivered outside the copying machine, and the copy operation is completed.

In this case, as shown in FIG. 32, a paint-out operation is performed on one surface of the transfer sheet, and a black copy operation is then performed on the same surface.

However, in step 252-7, the transfer sheet is fed from the second sheet feeder, and a copy operation is performed for the area with the designated color. The copied sheet is delivered outside the copying machine.

An operation will be described wherein the paint-out mode is not set. The flow advances from step 252-2 to step 252-9. In step 252-9, the control section 60 determines whether the color mode for the inside or the outside of the area is set. If NO in step 252-9, the flow advances to step 252-12. However, if YES in step 252-9, the flow advances to step 252-10. The control section 60 determines in step 252-10 whether the black mode for the inside or the outside of the area is set. If YES in step 252-10, the flow advances to step 252-11. However, if NO in step 252-10, the flow advances to step 252-12. In other words, when both color and black copy operations must be performed, the flow advances to step 252-11. However, when either a color or black copy operation is performed, the flow advances to step 252-12. In step 252-11, the copy sheet is fed from the cassette, and the copy operation is executed for the designated area. The copied sheet is delivered to the second sheet feeder 23 such that the copied surface faces downward. In step 252-8, the copy sheet is fed from the second sheet feeder in the same manner as described above. Copy operation is executed with black, and the copied sheet is delivered outside the copying machine. If the flow advances to step 252-12, the sheet is fed from the cassette and copy operation for the designated area is executed with the designated color. The copied sheet is delivered outside the copying machine.

Figure 30:
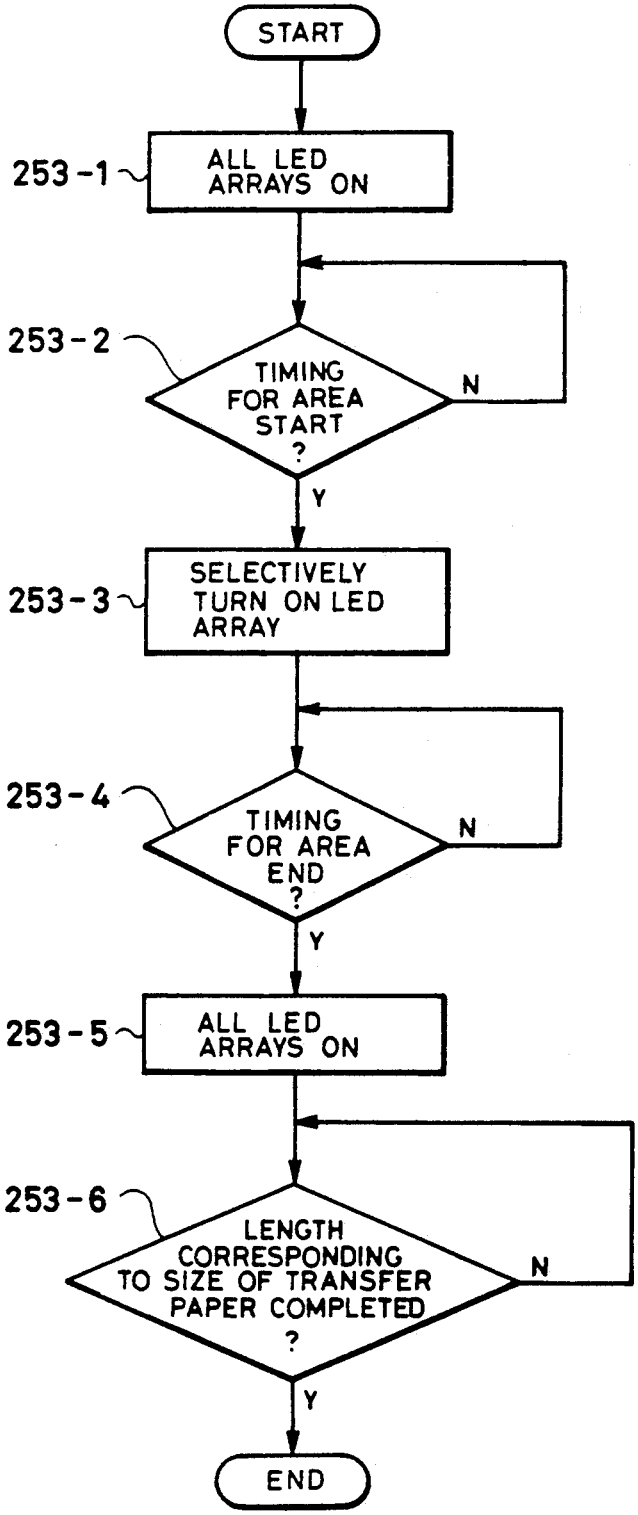

Paint-out copy operation will be described below. In order to paint out an area, the, exposure lamp 24 is kept off. In this case, a paint-out latent image is formed on the photosensitive drum 20. Therefore, as described with reference to area copy, the LED array 14 is selectively turned on at the time corresponding to the designated area to erase an unwanted latent image to form a pattern image. Therefore, the desired portion can be output as a paint-out image, and this operation is shown in the flow of FIG. 30. In step 253-1, all LEDs of the LED array 14 are turned on, and a transfer sheet is then fed at a predetermined time.

The control section 60 then determines in step 253-2 whether the current timing is the area start timing. If NO in step 253-2, the operation in this step is repeated. Thereafter, when the current timing reaches the area start timing, the LEDs of the LED array 14 which correspond to the designated area are selectively turned on on the basis of the coordinate data along the Y direction. The control section 60 then determines in step 253-4 whether the current timing reaches an X-direction end timing. When the X-direction end timing is obtained, all LEDs of the LED array 14 are turned on to erase the image throughout the area. The control section 60 then determines in step 253-6 whether or not development of the area corresponding to the transfer sheet size is completed. This determination is performed by counting the pulses in step 253-6. If YES in step 253-6, one cycle is completed.

Figure 31:
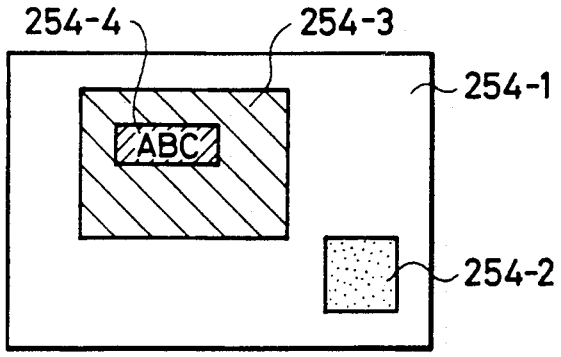
FIGS. 31 and 32 are views showing outputs in the area designation mode.

A copy output is illustrated in FIG. 31. An area 254-4 is a color paint-out area, and an area 254-3 is copied with black. The latter is also true for the image within the area 254-4. As is apparent from FIG. 31, a black letter string "ABC" (corresponding to the original) is copied within the paint-out area 254-4. An area 254-2 is copied with a designated color, and an image of other areas is erased. In order to obtain the above copy, the following operations are required. The user places an original on the editor 250-1 and specifies two diagonal points of the area 254-4. The paint-out mode is set by the portion 250-4. Two diagonal points of the area 254-3 are depressed, and the portion 250-5 is depressed. Two diagonal points in the area 254-2 are depressed. Finally, the portion 250-7 is depressed. The original is then set on the original plate and the copy key is depressed. Upon these input operations, the paint-out portion as the area 254-4 is first copied, and the area 254-2 is then copied with the specified color. Finally, the area 254-3 is copied with black, and the copy operation is automatically ended. In this manner, above complicated copy procedures can be simplified with easy manipulations. Since the paint-out copy is first performed, the original can be copied on the paint-out image. For example, in order to emphasize a title, the paint-out mode can be conveniently used. Furthermore, the color, black, and paint-out area designation operations can be sequentially performed before actual copying. Therefore, the user need not set the same original on the editor or the original plate by a plurality of times. In this manner, the load for manual operation can be reduced with simple operations, and the design concept of this copying machine is well matched with the human conceptual sequence.

Since the LED array has a narrow irradiation width, a thin line such as an underline can be easily drawn. In this case, the y-coordinates of the designated area are kept unchanged.

In the output result of FIG. 31, one color image within the designated area, one black image within another designated area, and one paint-out image within still another designated area are obtained. As previously described, each of a plurality of areas may be designated for different types of images, i.e., a black image, a color image, and a paint-out image. Only the modes (FIG. 27) for one area are registered. However, the output position on the transfer sheet may also be designated.

Copy magnification data and transfer sheet position data are added to the mode data 251-1 (FIG. 28). Assume that two areas are registered such that images within the designated areas are copied with a designated color, and that one area has a magnification of 100% (this area is referred to as area 1) and the other area has a magnification of 64% (this area is referred to as area 2). In this case, the operations in step 252-6 and 252-11 in the flow chart of FIG. 29 are performed as follows. Region 1 is copied with the designated color at the magnification of 100%, and the copied sheet is then set in the second sheet feeder 23. The magnification is then changed, the copy sheet is fed from the second sheet feeder 23, and area 2 is copied with the designated color at a magnification of 64%. The copied sheet is delivered in the second sheet feeder 23 again. A difference between the copy position designation value and the area position value is calculated, and the feed timing of the transfer sheet is changed by this difference, thereby designating the copy position on the transfer sheet (only the X-direction position in this embodiment). Even if the position is designated, the above operation can be achieved. For example, when a shift of the feed timing of the transfer sheet by area position designation is different from that of other areas, exposure/scanning can be performed twice to perform a multi-copy operation.

If multi-copy operation is repeated for a single transfer sheet, the sheet is often damaged and the transporting state is degraded. In this case, paper jam tends to occur. In addition, the image transfer properties are degraded to result in a poor image. Therefore, every time the area is registered, the control section calculates the number of multi-copy cycles. If the count exceeds a predetermined value, its registration is inhibited, and an alarm display is executed.

In the above embodiment, images of the designated images are multi-copied on a single transfer sheet. However, the images of the respective areas may be copied on different transfer sheets. In this mode, it is possible to output the image of the designated area at the distal end or the central portion of the transfer sheet. The asterisk key 121, the [2] key on the ten-key pad 122, and the asterisk key 121 are sequentially depressed to copy the images of the designated areas on different transfer sheets. Furthermore, the asterisk key 121, the [3] key on the ten-key pad 122, and the asterisk key 121 are sequentially depressed to align the image with the distal end of the transfer sheet. Moreover, the asterisk key 121, the [4] key on the ten-key pad 122, and the asterisk key 121 are sequentially depressed to output the image of the designated area at the center of the transfer sheet.

At the start of copy operation, copy operation is performed on the basis of the mode data and the coordinate data set at the start of the area-data area in FIG. 28. The transfer sheet is then delivered outside the copying machine. If the mode set at the start of the area-data area is given by the key input sequence [*] [3] [*], the feed timing of the transfer sheet is delayed by X0. However, if the mode set at the start of the area-data area is given by the key input sequence [*] [4] [*], the following calculation is performed.

$$T=(X1+X0)/2-l/2$$

where l is the transfer sheet size.

As a result, if the value T is positive, the feed timing of the transfer sheet is delayed by T. However, if the value T is negative, the feed timing is advanced by $|T|$.

By referring to the second area designation data in the area-data area of FIG. 28, if it is registered, copy operation is performed in the same manner as described above, and the copied sheet is delivered outside the copying machine. The copy operations are sequentially performed for all data registered in the area-data area of FIG. 28, and the series of copy cycles are completed.

According to the present invention as described above, if the user wishes to file newspaper columns in units of items, the user can designate a plurality of pieces of news at once. In this case, these pieces of news can be copied on different transfer sheets by a single copy instruction sequence. In addition, the news can be conveniently copied at a desired position of the transfer sheet.

Figure 33:
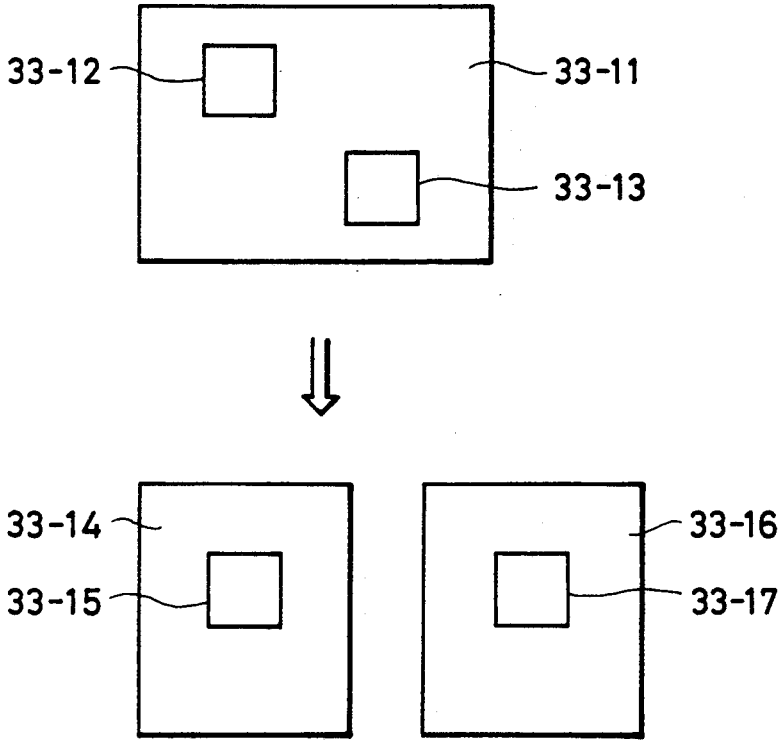
FIG. 33 is a view showing output by a designation of an area.

FIG. 33 shows an output result wherein images of two separate areas are output at centers of different transfer sheets. Areas 33-12 and 33-13 in an original 33-11 are designated. The image of the area 33-12 is copied at a central portion 33-15 of a transfer sheet 33-14. The image of the area 33-13 is copied at a central portion 33-17 of a transfer sheet 33-16.

Description of Copy Transporting Path

In this embodiment, the copying machine has two copy sheet refeeding mechanisms for setting the two-sided copy and multi-copy modes. More specifically, the copying machine includes the second sheet feeder 23 and the middle tray 40. One of the feeder 23 and the tray 40 is selected according to a given copy mode.

The control section 60 determines an optimal transporting path according to a copy paper size and the set number of copies. On one hand, the second sheet feeder 23 is an indispensable refeeding unit for achieving the two-sided and multi-copy modes. Since width-direction registration can be easily performed for the second sheet feeder 23 by a mechanism (to be described later), the feeder 23 provides a wide paper size margin. However, two or more sheets cannot be stored therein. On the other hand, a plurality of sheets can be stacked on the middle tray 40. However, the width-direction registration of the middle tray 40 is predetermined.

Figure 34:
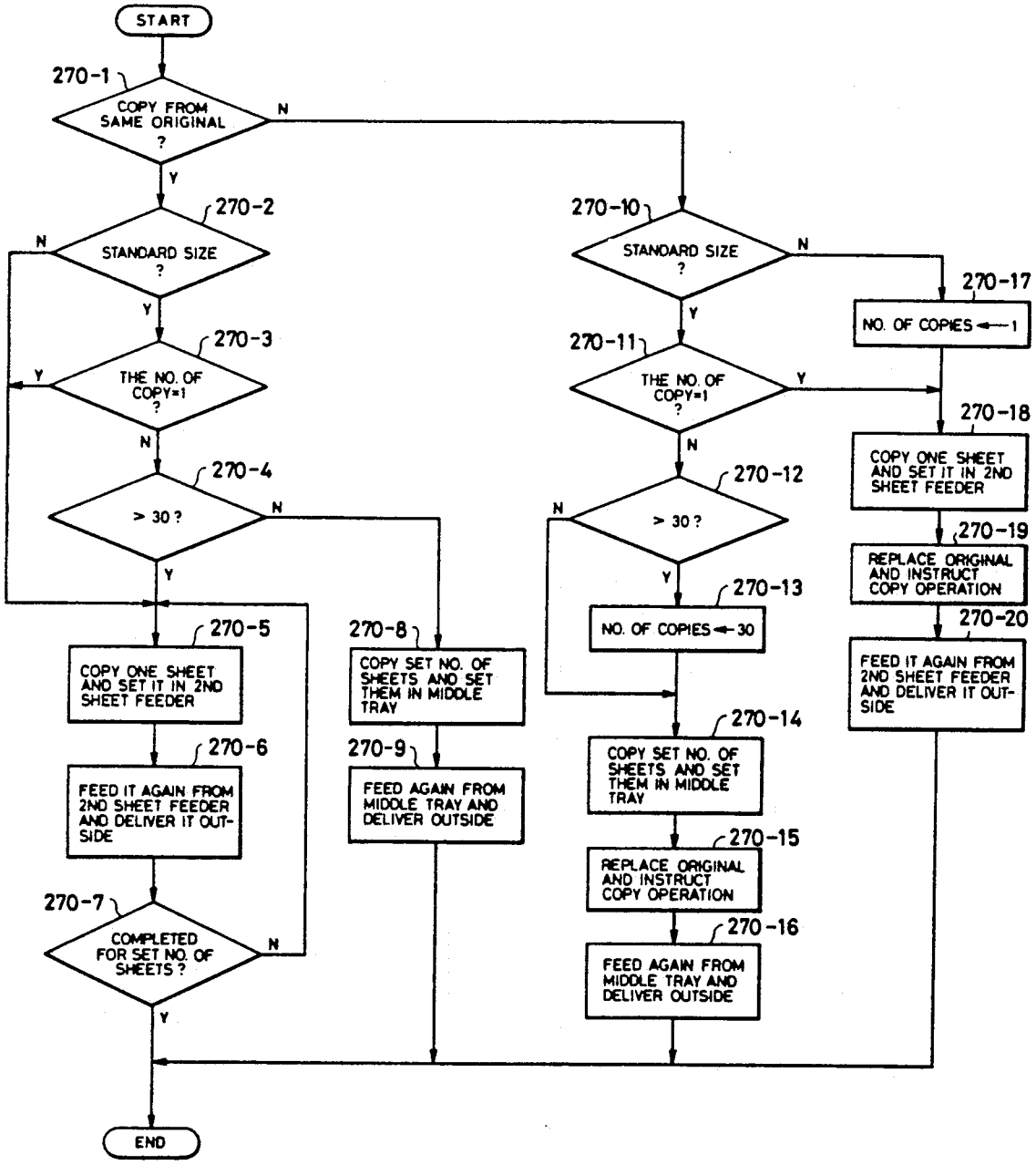
FIG. 34 is a flow chart showing a copy operation according to different transfer paper sizes and different set numbers of copies.

Paper path selection in the two-sided copy or multi-copy mode will be described with reference to FIG. 34.

When the copy operation is started in response to a copy instruction, in step 270-1, the control section determines whether two-sided copy/multi-copy mode is set for the same original, i.e., without replacing originals. The case wherein a predetermined area of a single original is copied with the designated color, and the other area of the same original is copied with black is determined to be YES. If YES in step 270-1, the control section 60 determines in step 270-2 whether or not the original has a standard size. If NO in step 270-2, the flow advances to step 270-5. Unconditionally, the second sheet feeder 23 is selected. However, if YES in step 270-2, the flow advances to step 270-4. The control section 60 determines in this step whether or not the set number of copies is one. If YES in step 270-4, the flow advances to step 270-5. However, if NO in step 270-4, the control section 60 determines in step 270-4 whether the number of copies exceeds the maximum number (i.e., 30 sheets) of sheets to be stacked on the middle tray 40. If YES in step 270-4, the flow advances to step 270-5. However, if NO in step 270-4, the flow advances to step 270-8. In step 270-5, one sheet is copied, and the copied transfer sheet is set in the second sheet feeder 23. In step 270-6, the sheet is fed from the second sheet feeder 23 again, and copy operation is executed. Finally, the copied sheet is delivered outside the copying machine.

The control section 60 determines in step 270-7 whether copy operation for the set number of sheets is completed. If NO in step 270-7, the loop of steps 270-5, 270-6, and 270-7 is repeated until the copy operation for the set number of copies is completed. However, if the flow advances to step 270-8, the middle tray 40 is used, and the corresponding copy operation is performed. Copy operation for the set number of copies is performed in step 270-8, and the copied transfer sheets are set on the middle tray 40. The sheets are then fed again from the middle tray 40, copy operation for the set number of sheets is completed, and the copied sheets are delivered outside the copying machine.

If NO in step 270-1, the flow advances to step 270-10. The control section 60 determines in step 270-10 whether the original has the standard size. If NO in step 270-10, the set number of copies is set to be one in step 270-17. The flow advances to step 270-18. The second sheet feeder 23 is selected.

However, if NO in step 270-11, the middle tray 40 is selected. The control section 60 then determines in step 270-12 whether the set number of sheets is less than 30. If NO in step 270-12, "30" is set as the number of copies in step 270-13.

In step 270-14, the number of sheets is set and the sheets are set on the middle tray 40 in the same manner as in step 270-8. When the original is replaced with another original in step 270-15 and a copy instruction is output, the same copy operation as in step 270-9 is performed in step 270-16. However, if the second sheet feeder 23 is selected, the same copy operation as in step 270-5 is performed in step 270-18. When the original is replaced with another original in step 270-19 and a copy instruction is output, the same copy operation as in step 270-6 is performed in step 270-20 and is completed.

In this embodiment as described above, in the multi-copy or two-sided copy mode together with a mode using an original having a size excluding the standard size, i.e., in paper feeding from a universal cassette or hand-insertion tray, as well as in the single copy mode, the sheet is not fed to the middle tray 40 but to the second sheet feeder 23. The sheet is then fed again from the second sheet feeder 23. However, in feeding of standard originals or copy of a plurality of sheets, the sheets are temporarily stacked on the middle tray 40 and then fed to the second sheet feeder 23.

Selection of one of the two transporting paths described above is not decided by the user but automatically determined by the program sequence. The user need not select the optimal path. The sequence program allows proper control using an optimal transporting path. It is possible to execute copy by using the second sheet feeder without using the middle tray when a plurality of originals having sizes excluding the standard sizes are used. In this case, each transfer sheet is fed to the second sheet feeder each time. Furthermore, inconvenience (e.g., an excessively small size) associated with the transfer sheets is discriminated, and the sheet can be delivered outside the copying machine without executing the two-sided copy/multi-copy processing, thereby preventing unnecessary trouble.

Figure 35:
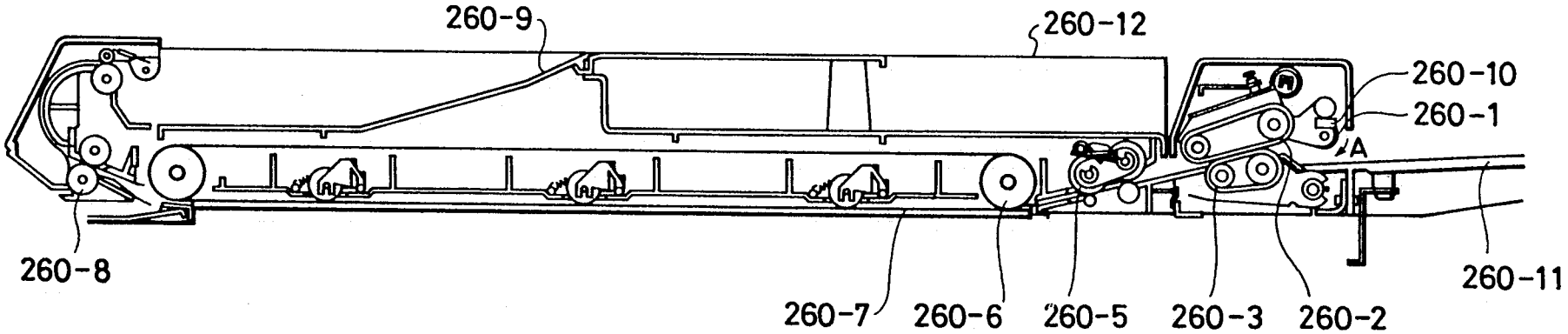
FIG. 35 is a sectional view showing a system configuration of an automatic document feeder.

An automatic document feeder (to be referred to as an ADF) can be attached to the copying machine of this embodiment. FIG. 35 shows an ADF. Various types of ADFs have been proposed. The operation of an ADF will be briefly described below. Referring to FIG. 35, an ADF 260-12 can set a plurality of originals thereon and automatically feed them. The ADF 260-12 includes an original tray 260-11 for receiving originals, an original sensor 260-10 for detecting an original, an original feed auxiliary roller 260-1 for feeding the originals one by one, an upper belt 260-2, a lower belt 260-3, original feed rollers 260-5, a drive roller 260-6, a conveyor belt 260-7 driven by the drive roller 260-6, delivery rollers 260-8, and a delivery tray 260-9.

When the originals are set on the original tray 260-11, the original sensor 260-10 detects them. A motor (not shown) is driven in response to the copy instruction, and the respective drive components are actuated. The original feed auxiliary roller 260-1 is rotated in a direction of arrow A by a mechanism (not shown) to feed one original to the original feed rollers 260-5. The original feed auxiliary roller 260-1 is moved upward. Thereafter, the original is transported by the original feed rollers 260-5 and the conveyor belt 260-7. The original is stopped when the distal end thereof reaches the reference position of the original plate 5 of FIG. 1.

The original is exposed with light upon movement of the optical system. When a predetermined number of originals are exposed, the ADF is energized again. In this case, when the original sensor 260-10 detects an original, original feeding is performed in the same manner as described above. At the same time, the original set on the original plate 5 is delivered through the delivery rollers 260-8 onto the delivery tray 260-9. The next original is then subjected to copy operation. Such a cycle is repeated until no originals are left on the original tray 260-11. When the last original is set on the original plate 5 and predetermined original exposure is completed, the original sensor 260-10 does not detect any originals. Original feeding is not performed. The original is delivered onto the delivery tray 260-9, and the series of operations are completed.

Figure 36:
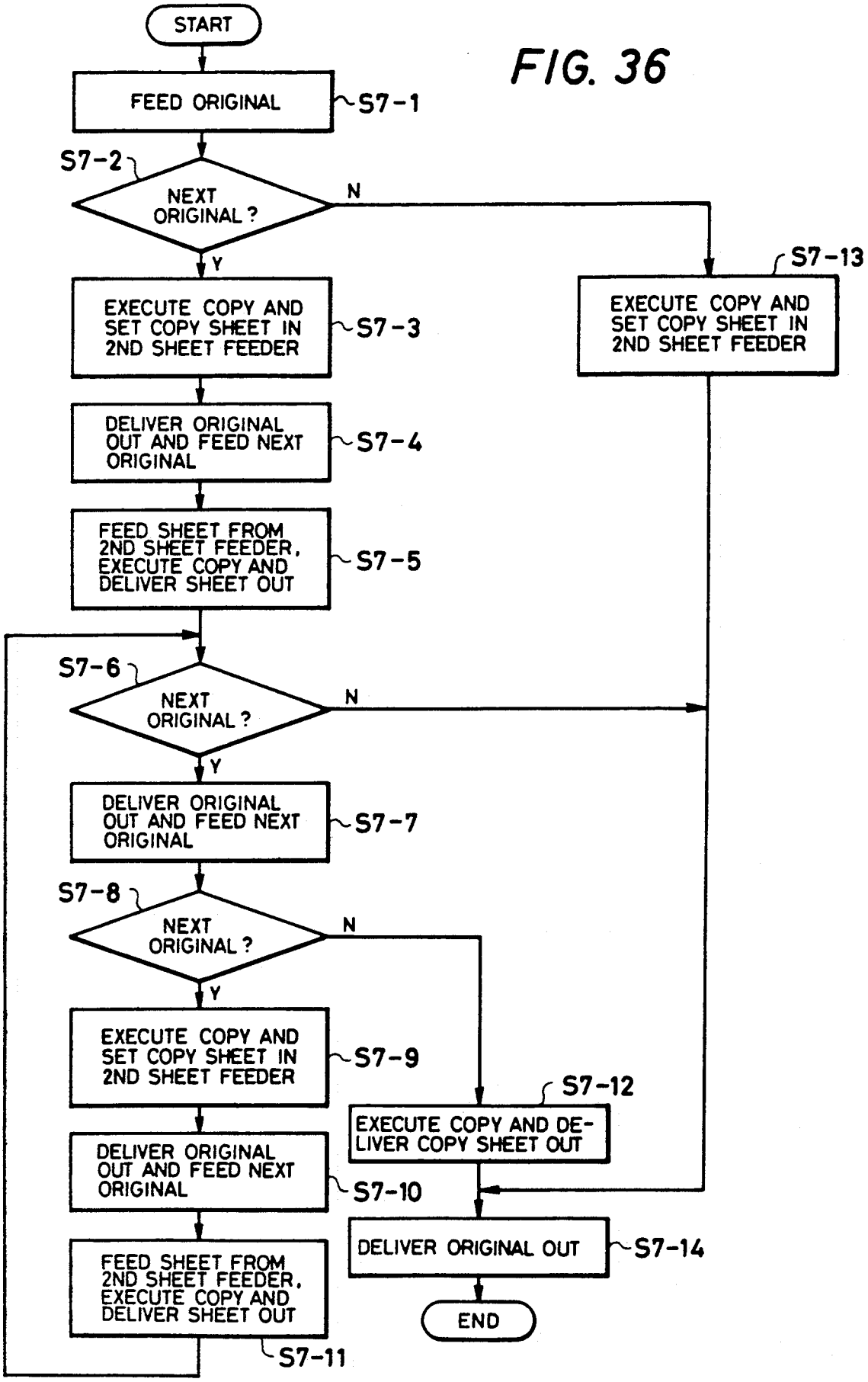
FIGS. 36 and 37 are respectively views showing copy operations when the automatic document feeder is used.

FIG. 36 is a flow chart for explaining the operation wherein different copy operations are performed on the basis of different numbers of originals set on the ADF in the two-sided copy or multi-copy mode.

An original is fed (step 7-1) and set at a predetermined position. In this case, the original sensor 260-10 detects a single or plurality of originals set on the original tray 260-11 (step 7-2).

An operation will be described wherein the number of detected originals is one.

If NO in step 7-2, the number of originals is determined to be one. First-side copy operation is completed, and the transfer sheet is fed to the second sheet feeder 23 (step 7-13). The original is delivered outside after it is exposed with light (step 7-14). The transfer sheet held in the second sheet feeder is subjected to second-side copy operation in response to the next copy start instruction. When the second-side copy operation is completed, the copy cycle is completed.

An operation will be described wherein the number of detected originals is two or more. If YES in step 7-2, the number of originals set in the ADF is determined to be two or more. First-side copy operation is completed, and the transfer sheet is transported to the second sheet feeder 23 (step 7-3). The exposed original is delivered outside, and the next original on the original tray 260-11 is fed (step 7-4). Second-side copying is performed, and the copied transfer sheet is delivered outside the copying machine (step 7-5). The control section 60 determines in step 7-6 whether the next original is present on the original tray 260-11. If NO in step 7-6, the original is delivered outside (step 7-14), and the copy cycle is completed.

However, if the original is placed on the original tray 260-11, it is delivered outside, and the next original is fed (step 7—7). The control section 60 then determines in step 7-8 whether the next original is placed on the original tray 260-11. If YES in step 7-8, first-side copy operation is performed, and the copied transfer sheet is transported to the second sheet feeder 23 (step 7-9). The original is then delivered outside, the next original is fed, and second-side copy operation is performed. Finally, the transfer sheet is delivered outside the copying machine. The operations from step 7-6 are executed again.

If NO in step 7-8, the transfer sheet is delivered outside the copying machine upon completion of the first-side copy operation (step 7-12). The original is delivered outside (step 7-14), and the copy cycle is completed.

The different copy cycles based on different numbers of originals placed on the ADF have been described above. These operations provide the following effects.

For example, if the two-sided copy or multi-copy mode is set using a combination of a large original such as a newspaper which cannot be fed by the ADF and an original capable of being fed by the ADF, the transfer sheet is delivered outside the copying machine in the conventional copying machine if the number of originals is one. In this manner, in the conventional copying machine, the ADF cannot be used for the above purpose in the two-sided or multi-copy mode.

In the same reason as described above, a two-sided original cannot be copied on two surfaces of a single transfer sheet by using the ADF in the conventional copying machine.

In order to form a multi-copy or two-sided copy by using two originals in a combination of masking/trimming copy mode, area designation cannot be simultaneously performed for two originals in the conventional copying machine. Therefore, the originals must be set one by one, and thus the desired copy cannot be obtained using the ADF in the conventional copying machine according to the same reason as described above. However, according to the present invention, the above conventional drawback can be eliminated. In addition, if the number of a plurality of originals is an odd number, the last copy is delivered outside the copying machine. Therefore, the copying machine of the present invention can be conveniently used.

When the operations in steps 7-13 and 7-14 are completed, the transfer sheet is placed in the second sheet feeder 23. The subsequent operations will be described with reference to the flow chart of FIG. 37.

Upon depression of the reset key 119 (step 7-15), the transfer sheet in the second sheet feeder 23 is transported along the paper path for second-side copy operation. In this case, however, the copy operation is not performed, and the transfer sheet is delivered outside the copying machine (step 7-21).

If the copy key 117 is depressed (step 7-16) and an original is present on the original tray 260-11 of the ADF (step 7-17), the original is fed (step 7-18) and second-side copy operation is performed. Thereafter, the transfer sheet is delivered outside the copying machine (step 7-19). The original is then delivered outside, thereby completing the series of operations (step 7-20).

However, if the control section 60 determines in step 7-17 that there is no original, the control section 60 determines that the original is manually set on the exposure surface of the original plate. Second-side copy operation is performed, and the copied transfer sheet is delivered outside the copying machine (step 7-20). As a result, the series of copy operations are completed.

Description of Sequence

The sequence will be described with reference to FIGS. 38 to 62.

Figure 38:
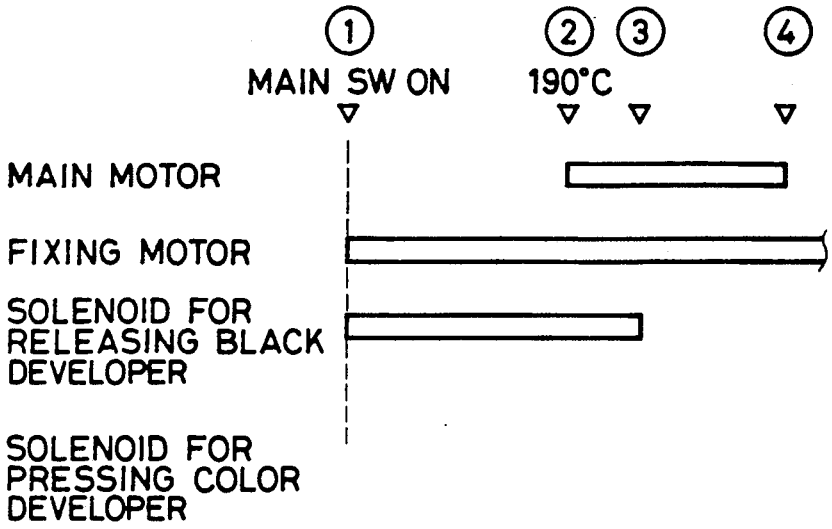
FIGS. 38 to 48, 50 to 52, 54, 55, 57 to 59, 61, and 62 are timing charts of the respective components of the copying machine.
Figure 39:
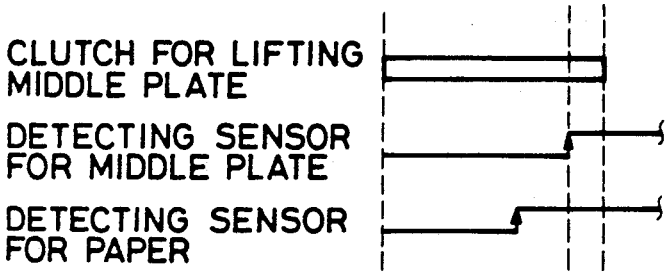
Figure 40:
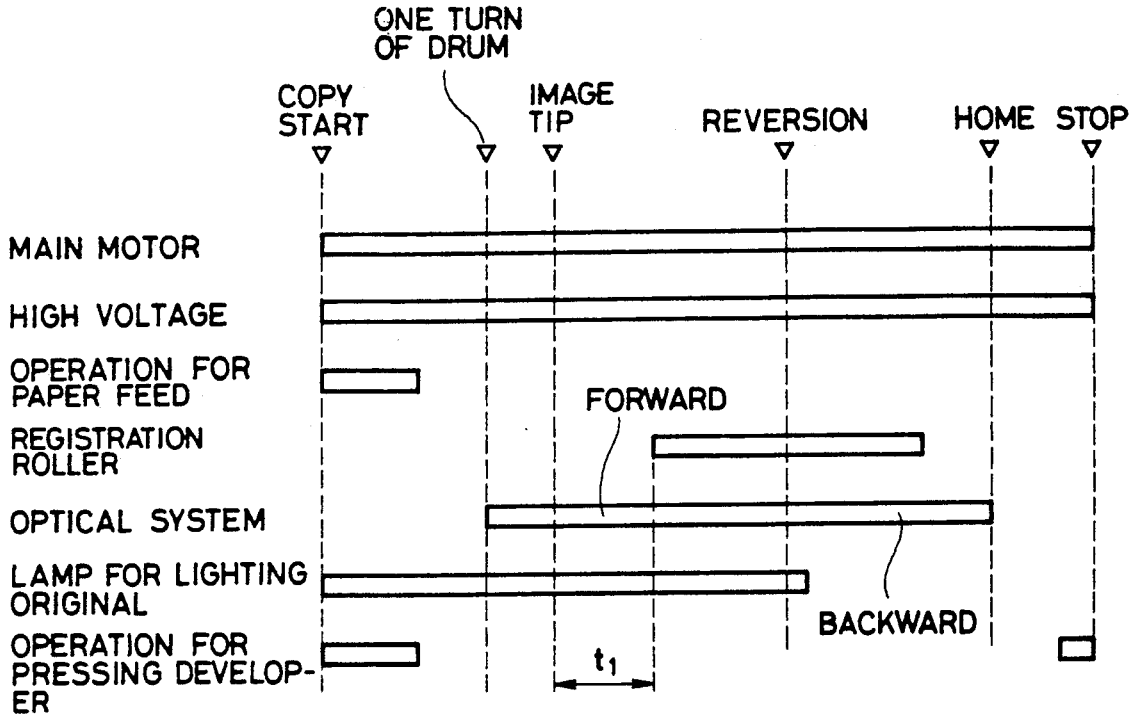

The operation at the time of power ON operation will be described. FIG. 38 is a timing chart for explaining the operation at the power ON operation. When the main switch SW is turned on, the fixing heater and the solenoid 31 for releasing the black developer are turned on. When the temperature of the fixing unit reaches 190° C., the motor is rotated. The solenoid 30 for pressing the color developer is turned off when one second (time③) has elapsed. The black developer is temporarily moved to the release position and then comes near the drum. When the drum turned once, the main motor is turned off. If the middle plate of the cassette is located at the lower position upon rotation of the motor is started at time②, the middle plates in the upper and lower cassettes are lifted, and this state is shown in FIG. 39. When the middle plates are completely lifted, the main motor is stopped (time④).

FIG. 39 is a timing chart for explaining lifting of the middle plate. The middle plates of the upper and lower cassettes are operated at identical timings. When the clutch for lifting the middle plate is actuated, each middle plate is lifted. An output from the detecting sensor for the middle plate is set at logic "1". After the lapse of 0.1 sec., the clutch for lifting the middle plate is turned off. Upon lifting of each middle plate, the detecting sensor for paper detects the presence of transfer sheets. If a transfer sheet is present on the middle plate, the output from the detecting sensor for paper is set at logic "1"" before the output from the detecting sensor for the middle plate is set at logic "1". If the output from the detecting sensor for paper is set at logic "0" at the time when the output from the detecting sensor for the middle plate is set at logic "1", the paper absence LED is turned on. If any cassettes are not attached to the copying machine, this operation is not performed.

The copy operation will be described below. When the copy key is depressed, the main motor, the high voltage unit, the lamp for lighting the original are turned on. Paper feed and developer pressing operations are then initiated. After one turn of the drum, the optical system is moved forward. When the period t1 has elapsed after the image tip sensor detects the tip or leading end of the image, the registration rollers are turned on. Thereafter, the registration rollers are turned off on the basis of the paper size. When the optical system reaches the inversion position, the optical system is moved backward. After the lapse of 0.2 second, the lamp for lighting the original is turned off. When the optical system returns to the home position, the optical system is stopped, and the drum starts rotation When the transfer sheet is delivered outside the copying machine, the motor, the high voltage unit, and the like are turned off. If the color copy mode is set, the operation for pressing the color developer is performed as follows.

Figure 41:
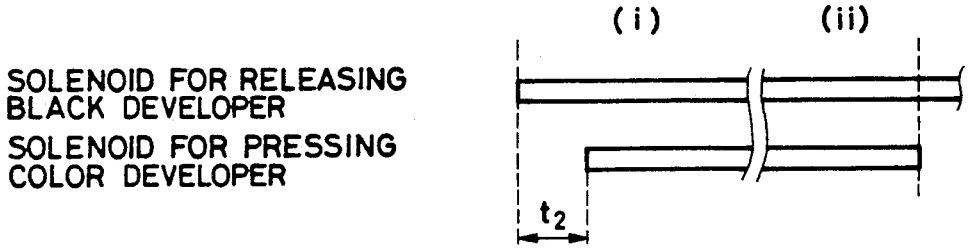

The operation for pressing the color developer will be described. FIG. 41 is a timing chart for explaining the operation when the color copy mode is set from the state wherein the black developer is set. The solenoid 31 for releasing the black developer is turned on to separate the black developer from the drum. After the black developer is separated from the drum, the solenoid 30 for pressing the color developer is turned on to bring the color developer into contact with the drum. When copy operation is completed, the solenoid for pressing the color developer is deenergized to separate the color developer from the drum. At this time, the black developer is kept separated from the drum at the end time of the color copy mode in order to smoothly supply the color toner (ii). In this state, both the black and color developers are separated from the drum. It should be noted that the black developer is kept in contact with the drum when black copy operation is completed.

Figure 42:
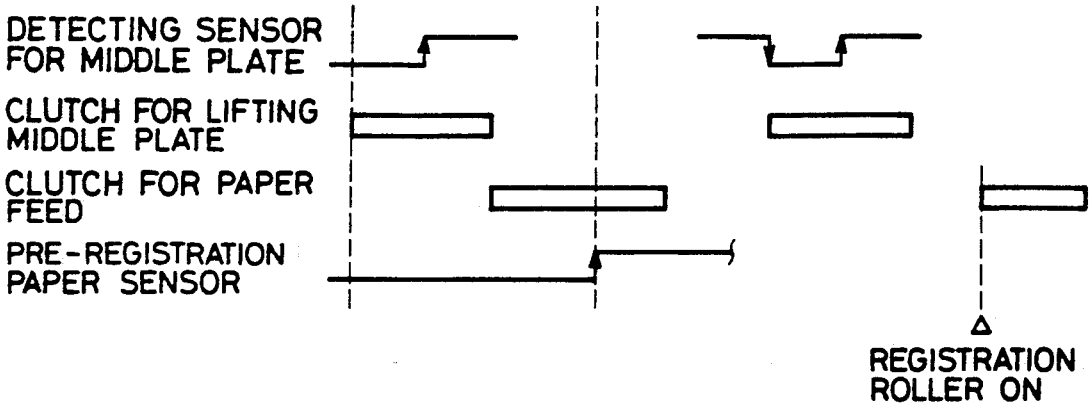

Paper feed operation will be described with reference to a timing chart of FIG. 42. When the output from the detecting sensor for the middle plate is set at logic "0" at the copy start time, the middle plates are lifted in the same manner as described with reference to FIG. 39. The clutch for paper feed is turned on upon completion of lifting of the middle plates, and the transfer sheet is being fed. When the transfer sheet reaches the pre-registration paper sensor S7, the output therefrom is set at logic "1". When a predetermined period of time has elapsed, the clutch for paper feed is turned off. The transfer sheet abuts against the registration rollers 12 and forms a loop. Upon formation of the loop, the transfer sheet is stopped. Along with the progress of copy operation, the clutch for paper feed is turned on for a predetermined period of time upon ON operation of the registration rollers, thereby reducing the paper feed load of the registration rollers. Control of the middle plates is performed in asynchronism with copy operation. When the output from the detecting sensor for the middle plate is set at logic "0", the clutch for lifting the middle plate is turned on. This clutch is turned off when 0.1 second has elapsed after the output from the detecting sensor for the middle plate is set at logic "1". The presence/absence of the cassette is always detected. As soon as the cassette is detached from the copying machine, lifting of the middle plate is immediately stopped.

Paper feed operation in the hand-insertion copy mode will be described below. A clutch for lifting a tray of hand-insertion is turned on upon the start of copy operation to lift the hand-insertion tray. When the tray is moved upward and if the transfer sheet is set, the detecting sensor for paper generates an output of logic "1". The clutch for paper feed is turned on when a predetermined period of time has elapsed, and the transfer sheet is fed in the copying machine. When a period t5 required for clamping the next transfer sheet between the rollers has elapsed, the clutch for lifting the tray of hand-insertion is turned off, and the tray of hand-insertion is moved downward. Finally, the output from the detecting sensor for paper is set at logic "0". The transfer sheet is fed to the pre-registration sensor S7, and the pre-registration sensor S7 generates an output of logic "1". When a predetermined period of time has elapsed, the clutch for paper feed is turned off. The transfer sheet abuts against the registration rollers, forms a loop, and is stopped.

Figure 43:
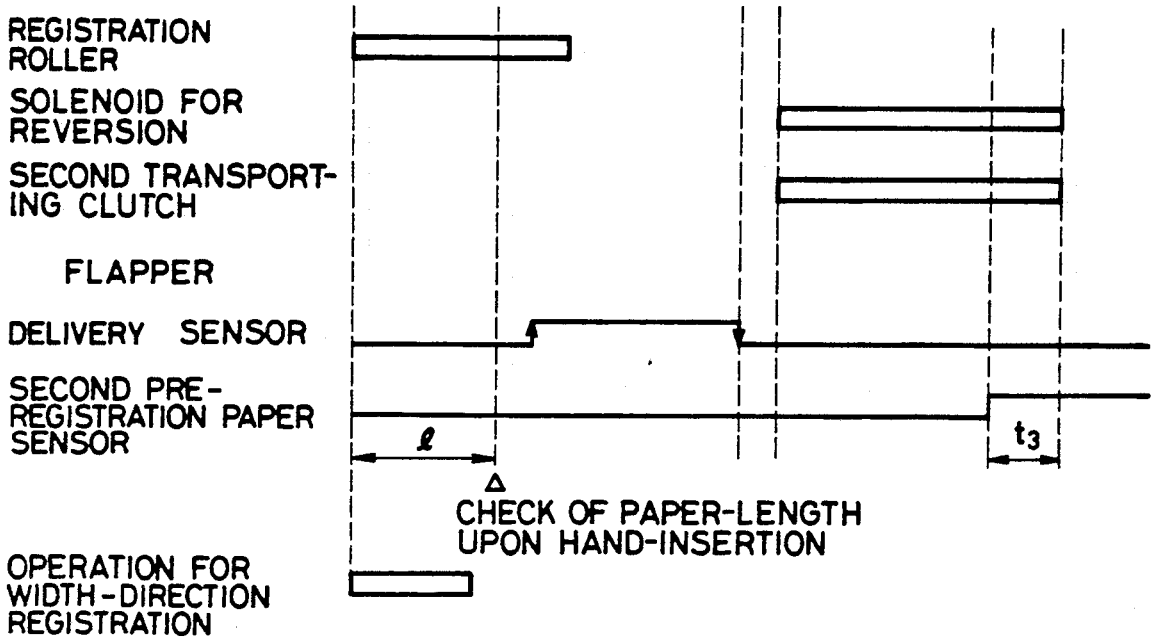
Figure 44:
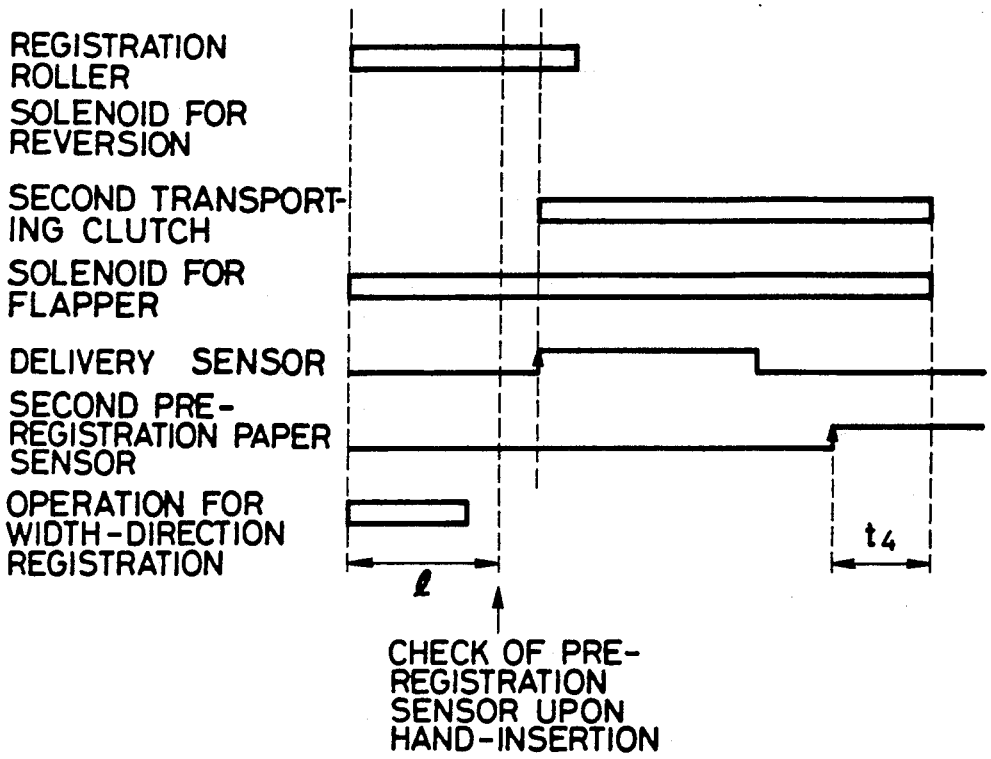
Figure 45:
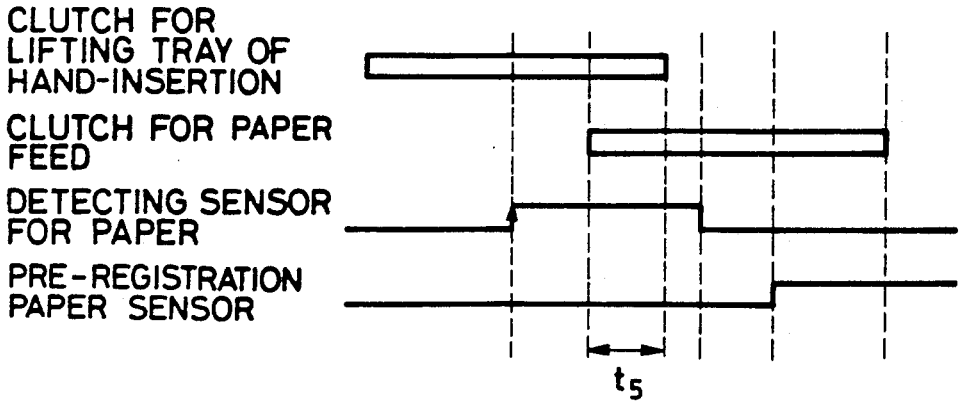

First-side copy operation in the single two-sided copy mode will be described below. The operations of the high voltage unit, the lamp, the optical system, and paper feeding are the same as described above. The operation of the transfer sheet upon ON operation of the registration rollers 12 will be described with reference to a timing chart of FIG. 43. Referring to FIG. 43, upon operation of the registration rollers, the transfer sheet is fed to the fixing unit. When the transfer sheet then passes through the delivery sensor S4, the output from the delivery sensor S4 is changed in the sequence of logic "0", logic "1", and logic "0". In this case, a width-direction registration means (to be described later) is moved to the home position. When a predetermined period of time has elapsed, i.e., when the transfer sheet is clamped by the delivery rollers 27 at a sheet position about 10 mm before the trailing end thereof, a solenoid for reversion is turned on to switch back the transfer sheet. In this case, a second transporting clutch is also turned on. The transfer sheet is fed to the second sheet feeder 23, and an output from the second pre-registration sensor S5 is set at logic "1". When a predetermined period of time has elapsed, the second transporting clutch is turned off. The transfer sheet abuts against the second registration rollers 37, forms a 15-mm loop, and is stopped. The solenoid for reversion is also deenergized. The second sheet feeder 23 can feed only a transfer sheet having a length of about 180 mm or more. In the hand-insertion copy mode wherein the size of the transfer sheet is unknown, the control section determines the output from the pre-registration sensor S7 when a transporting time corresponding to a distance $l = 180\text{ mm} - 24\text{ mm}$ (24 mm is a distance between the pre-registration paper sensor S7 and the registration rollers 12) upon ON operation of the registration rollers 12 has elapsed. If the section 60 determines that there is no transfer sheet, the sheet has a size of 180 mm or less. Thereafter, the switch-back operation is not performed, and the transfer sheet is delivered outside the copying machine. However, if the control section 60 determines that there is a transfer sheet, the sheet has a length of 180 mm or more. Therefore, the predetermined operations are performed.

First-side copy operation in the single multi-copy mode will be described below. In particular, a description is concentrated on the operation of the transfer sheet upon ON operation of the registration rollers with reference to a timing chart of FIG. 44. The registration rollers 12 and a flapper solenoid (not shown) are turned on. A width-direction registering means (i.e., the second registration rollers 37) is moved to the home position. When the transfer sheet is moved by a distance l, the pre-registration sensor is checked in the two-sided copy or hand-insertion copy mode. If the pre-registration sensor does not detect the transfer sheet, the flapper solenoid is turned on, and the transfer sheet is delivered outside the copying machine. When the transfer sheet is transported and the output from the delivery sensor S4 is set at logic "1", the second transporting clutch is turned on. The transfer sheet is fed to the second sheet feeder 23. When a predetermined period t4 has elapsed after the output from the second pre-registration sensor S5 is set at logic "1", the second transporting clutch is turned off. The transfer sheet abuts against the second registration rollers 37, forms a loop, and is stopped. The curled state and its direction of the transfer sheet are different from those in the two-sided copy mode. Therefore, the period t4 between the timing for setting the output from the second pre-registration sensor S5 to be logic "1" and the timing for stopping the transfer sheet is different from that in the two-sided copy mode.

Figure 46:
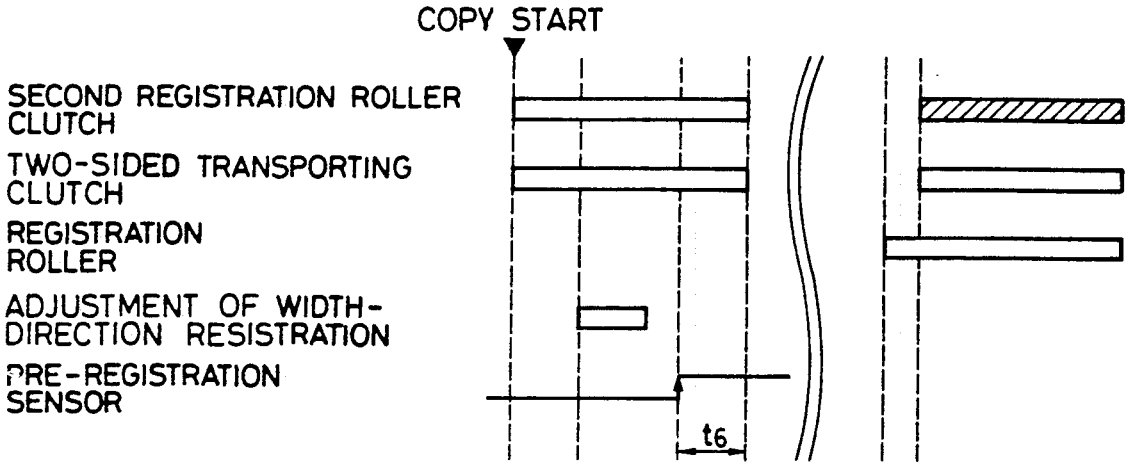
Figure 47:
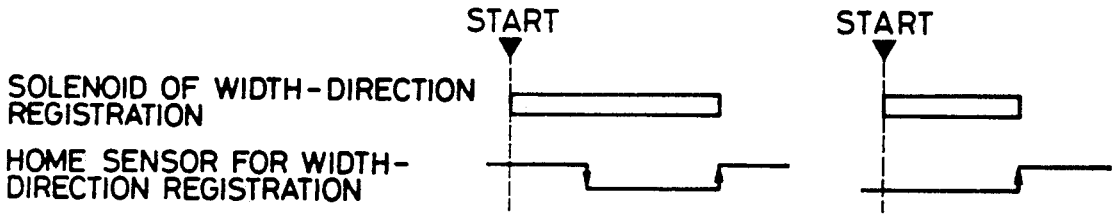

Second-side copy operation in the single two-sided or multi-copy mode will be described with reference to FIG. 46. In this case, the transfer sheet has reached in the second sheet feeder 23. The sheet then has abutted against the second registration rollers 37, has formed a loop, and has been stopped. When the copy operation is started, a second registration-roller clutch and a two-sided transporting clutch are turned on, so that the transfer sheet is moved toward the first registration rollers 12. When 0.1 sec has elapsed, width-direction registration operation is started (to be described later) in a state wherein the transfer sheet is clamped between the second registration rollers at a sheet position 17 mm from the tip of the transfer sheet. When a period t6 has elapsed after the output from the first pre-registration sensor S7 is set at logic "1", the second registration-roller clutch and the two-sided transporting clutch are turned off. The transfer sheet abuts against the first registration rollers 12, forms a loop, and is stopped. Thereafter, the optical system is moved forward, and a timing for turning on the registration rollers 12 reaches. After the transfer sheet is fed by about 5 mm, the second registration-roller clutch and the two-sided transporting clutch are turned on to reduce the size of the loop by 5 mm, and the transfer sheet is fed in the two-sided copy mode. However, in the multi-copy mode, only the two-sided transporting clutch is turned on, and the transfer sheet is pulled by the registration rollers 12. The second registration rollers 37 serve as a load. The transfer sheet is then fed without a loop. The transfer sheet then passes through the fixing roller and is delivered outside the copying machine. The time t6 for determining the size of the loop at the position in front of the registration rollers is different from the case wherein the sheet is fed from the cassette, since conditions such as warping of transfer sheet are different therefrom.

The operation for setting the second registration rollers in a width-direction home position will be described below. A solenoid for width-direction registration receives the driving force from the main motor through a spring clutch to reciprocate the second registration rollers 37 in the direction of width. A home sensor for width-direction is arranged to detect a position of the second registration rollers. A paper sensor for width-direction registration is also arranged to detect a transfer sheet clamped between the second registration rollers. Although the second registration rollers 37 may be reciprocated along the axial direction of the drum, they can be stopped by control along one direction. More specifically, as shown in a timing chart of FIG. 47, if the output from the home sensor for width-direction registration is set at logic "1", the rollers are stopped in the output logical sequence of "1", "0", and "1". However, if the output is set at logic "0", the rollers are stopped in a logical sequence of "0" and "1".

Figure 48:
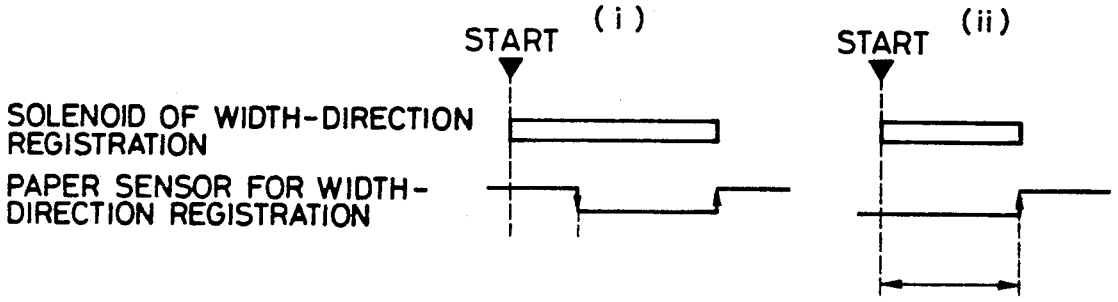
Figure 49:
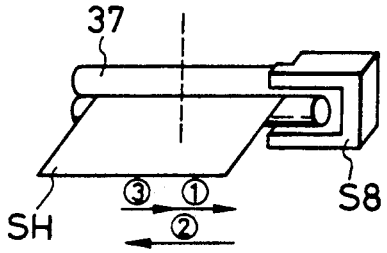
FIG. 49 is a schematic view showing a second sheet feeder.
Figure 50:
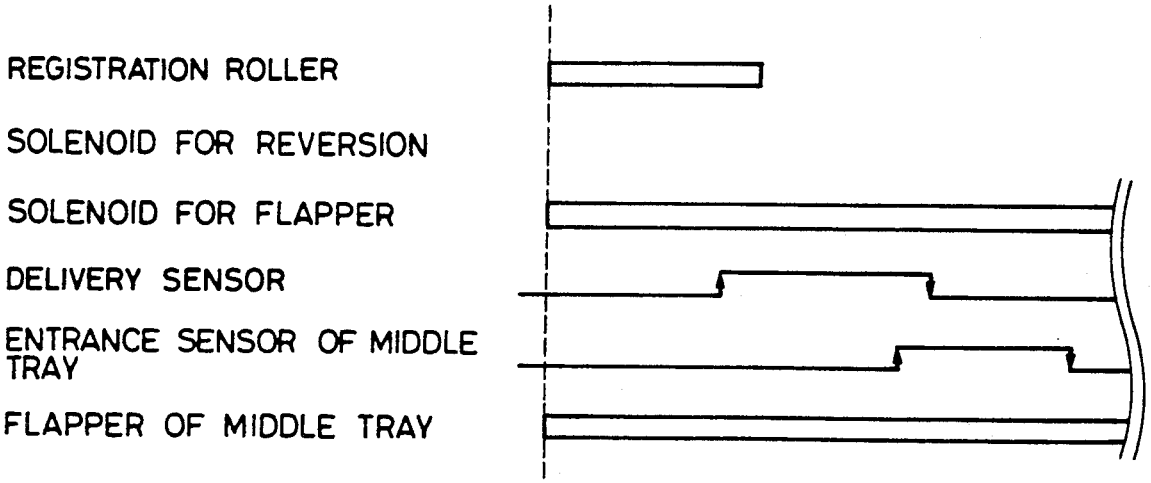

Width-direction registration adjustment will be described below. Referring to FIG. 49, the arrangement illustrates the second registration rollers 37, the paper sensor S8 for width-direction registration, and the transfer sheet SH. When the second registration rollers 37 are set in the home position, they are stopped at the central point in the operating range. When the solenoid for width-direction registration is turned on, the rollers are reciprocated in a direction sequence of ①,②,③, and ④. When the transfer sheet is clamped between the second registration rollers 37 while they are stopped in the home position, the paper sensor S8 for width-direction registration detects or does not detect the transfer sheet. The case wherein the paper sensor S8 for width-direction registration detects the paper will be first described. As shown in FIG. 48(*i*), the rollers are stopped when the logical sequence of the paper sensor for width-direction registration is given as "1", "0", and "1". When the transfer sheet is fed at the paper sensor side, the output from the sensor may be always set at logic "1". In this case, in order to stop the transfer sheet at an optimal position, the following operation is performed. As shown in FIG. 49, the transfer sheet is separated farthest from the sensor when the rollers are moved in the sequence of ① and ②. In this case, if an output from the paper sensor S8 is set at logic "1", the rollers are moved in the direction indicated by arrow ③, so that the output from the paper sensor S8 is not set at logic "0". Therefore, the rollers are immediately stopped to provide the optimal sheet position. If a time for one period of width-direction movement of the registration rollers 37 is given as T, and if the output from the paper sensor S8 for width-direction registration is not set at logic "0" upon movement for a period of time (i.e., $\frac{3}{4}$ T) corresponding to arrows ① and ②, the rollers are immediately stopped.

The operation will be described wherein the output from the paper sensor S8 for width-direction registration is first set at logic "0". As shown in FIG. 48(ii), the second registration rollers are stopped when the output from the paper sensor S8 for width-direction registration is given in a logical sequence of "0" and "1". If the transfer sheet is fed a significant distance away from the paper sensor S8 for width-direction registration, the output from the paper sensor S8 may be kept at logic "0". In order to stop the second registration rollers at an optimal position, if the output from the paper sensor S8 is not set at logic "1"even if the rollers are moved by a period $\frac{1}{4}$T corresponding to arrow ① in FIG. 49, the rollers are immediately stopped.

First-side copy operation in the two-sided copy mode using the middle tray will be described. The operations of paper feeding, the high voltage unit, and the optical system are the same as those described above. Therefore, a description will be concentrated on the operation of the transfer sheet upon ON operation of the first registration rollers 12 with reference to a timing chart of FIG. 50. The flapper solenoid (not shown; this solenoid is used to actuate the flapper 29) and a middle tray flapper 49 are turned on simultaneously when the first registration rollers are rotated. The transfer sheet fed out from the first registration rollers 12 passes through the fixing roller 25 and is directly transported toward the middle tray 40. The entrance sensor S19 of the middle tray 40 detects the number of transfer sheets stored in the middle tray. When the number is detected, the operation is stopped.

Figure 51:
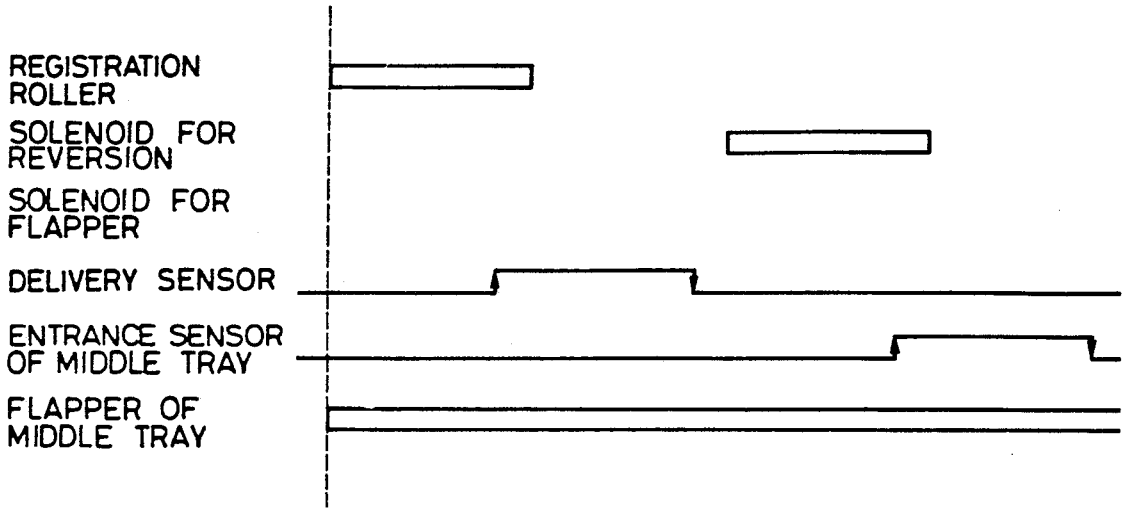

First-side copy operation in the multi-copy mode using the middle tray will be described with reference to a timing chart of FIG. 51. The middle tray flapper 49 and the first registration rollers are simultaneously actuated to form a path for transporting the transfer sheet to the middle tray 40. The transfer sheet is fed out by the first registration rollers and passes through the paper delivery sensor S4. In this state, the solenoid of reversion is turned on to switch back the transfer sheet in the same manner as in the single two-sided copy mode. The transfer sheet is transported to be stored in the middle tray 40. At this time, the number of transfer sheets are counted by the entrance sensor S19 of the middle tray 40. When the count is detected, the operation is stopped.

Figure 52:
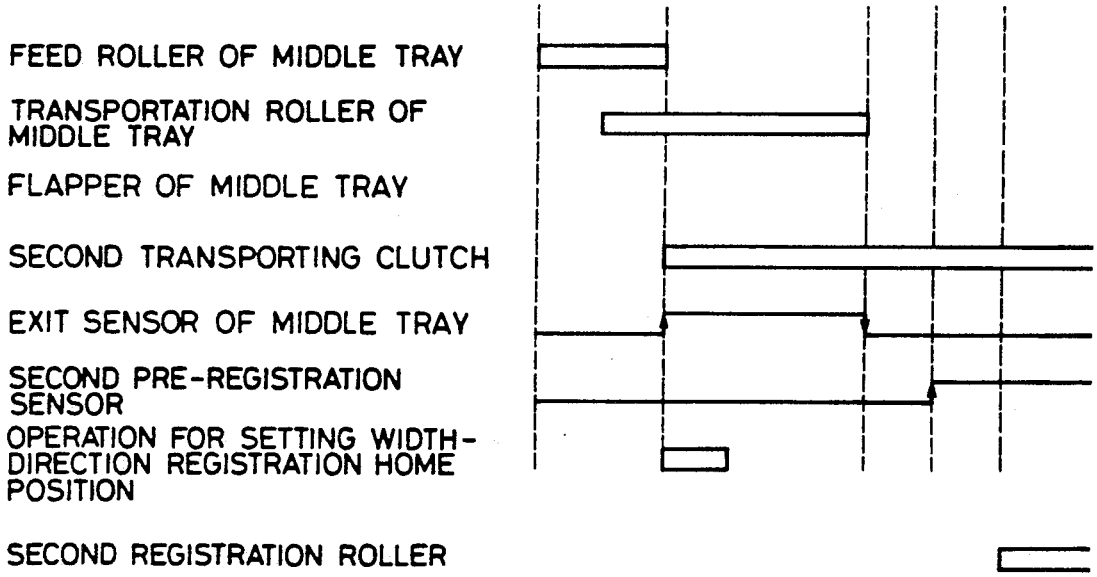

Second-side copy operation in the multi-copy or two-sided copy mode using the middle tray will be described below. Transfer sheets are stocked in the middle tray. Each transfer sheet is transported to the second sheet feeder 23, as shown in FIG. 52. When a solenoid (not shown) of the feed roller of the middle tray is turned on, paper feed roller 56 is moved downward by a driving means (not shown) to contact the uppermost transfer sheet. Thereafter, the solenoid of feed roller of the middle tray is turned on to feed the transfer sheet onto a transporting path 59 by feed rollers 57 of the middle tray 40. When the tip of the transfer sheet reaches the exit sensor S21 of the middle tray 40, the solenoid of the feed roller of the middle tray 40 is turned off to move the feed roller 56 upward. Therefore, the feed roller 56 is separated from the uppermost transfer sheet. A second transporting clutch (not shown) is turned on to set the second registration rollers 37 to the home position. The transfer sheet reaches the second pre-registration sensor S5. When a predetermined period of time has elapsed, the transfer sheet abuts against the second registration rollers 37 and forms a loop. Thereafter, the second registration rollers 37 are turned on to feed the transfer sheet toward the registration rollers 12. Thereafter, the same operation as in second-side copy operation in the single multi-copy or two-sided copy mode is performed.

Figure 53:
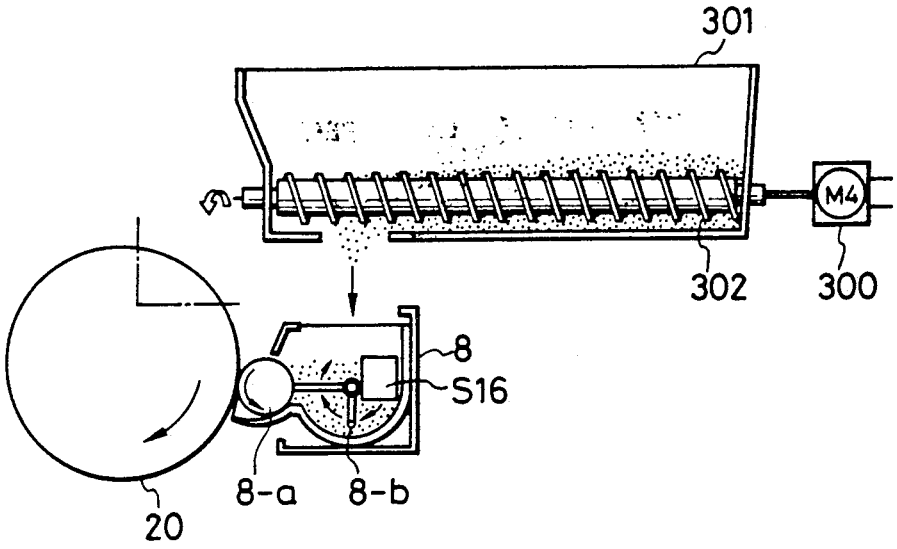
FIG. 53 is a view showing a system configuration of a developer.

The operation for feeding the black toner from a hopper to the black developer 8 will be described below. Referring to FIG. 53, the arrangement includes a hopper 301, and a screw 302 for stirring the toner in the hopper 301 and supplying the toner to the black developer 8. The screw 302 is driven by a hopper motor 300. The black developer 8 includes the toner sensor S16 for detecting the presence/absence of the toner in the black developer 8, a stirring rod **8-*b* for stirring the toner, and a developer sleeve 8-*a*. The stirring rod 8-*b* is driven by the main motor 18, and the operation cycle is 4 seconds. When the toner sensor S16 detects the absence of the toner, the hopper motor 300 is rotated to replenish the developer with the toner. If the toner sensor S16 does not detect the presence of toner even after the hopper motor 300 is driven for a certain period of time, the control section 60 determines that the toner is not present in the hopper 301, and the no toner LED is turned on to signal to the user that the toner is absent in the hopper 301**. Control of toner detection will be described in detail below.

Figure 54:
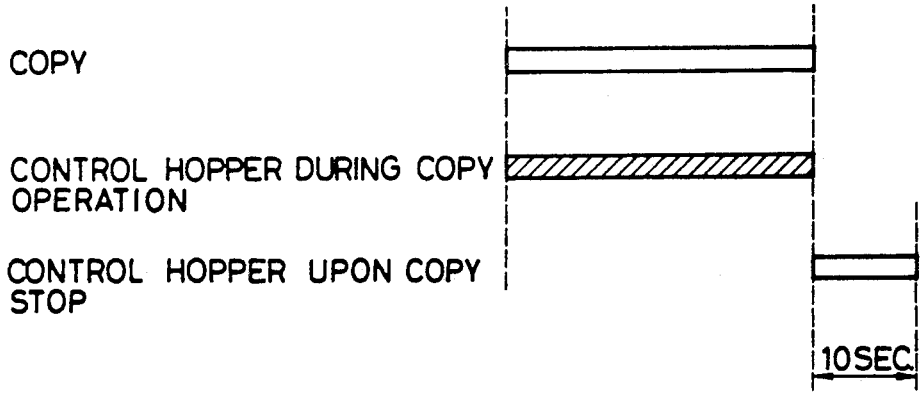
Figure 55:
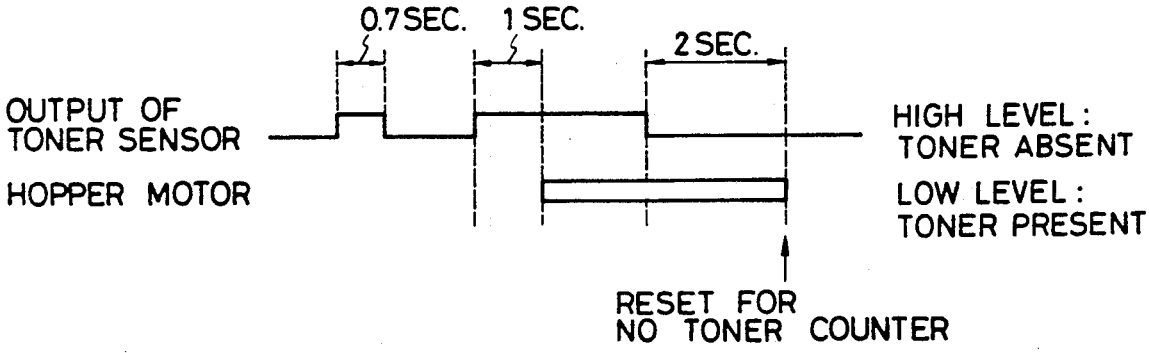

Control during copy operation is different from control during no-copy operation. During the no-copy operation, when the toner sensor S16 detects the absence of toner, as shown in FIG. 54, the hopper motor 300 is rotated for 10 seconds. In this case, if the toner sensor S16 detects the presence of toner, no operation is performed.

Control of the hopper motor 300 during the copy operation will be described below. Upon rotation of the stirring rod **8-*b*, the rod 8-*b* is accidentally brought into contact with the toner sensor S16, and the sensor output represents the presence of toner although the hopper 301 is actually empty. In this case, a maximum of 1-sec output is generated by the toner sensor S16. The toner sensor output may often represents the absence of toner although the toner is present since the toner near the toner sensor S16 is removed by the stirring rod 8-*b*. In this case, a maximum of 2-sec output is generated by the toner sensor S16. As shown in FIG. 53, when the no-toner signal continues for one second or more, the hopper motor 300 is driven. When the toner signal continues for 2 seconds or more, the control section 60 determines that there is a toner in the developer. In this case, the hopper motor 300 is stopped and a no-toner counter (to be described in detail later) is reset. However, if no toner is left in the hopper, the toner sensor S16 does not generate a signal representing the presence of toner even if the hopper motor 300 is rotated. Therefore, the no-toner state in the hopper is detected. The time for rotation of the hopper motor 300 is counted by the no-toner timer of the hopper. When a total period of the operation of the non-toner timer reaches 18 seconds, the control section 60 determines that there is no toner in the hopper 300**, and the no-toner LED is turned on. The no-toner timer is reset when the power switch is turned on or the tone is detected during the copy operation.

Figure 56:
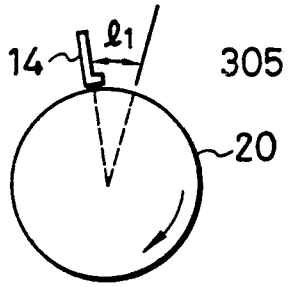
FIG. 56 is a view showing a LED array and exposing position.
Figure 57:
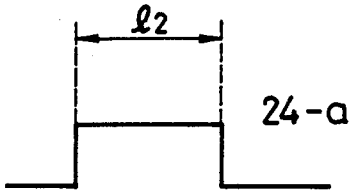
Figure 58:
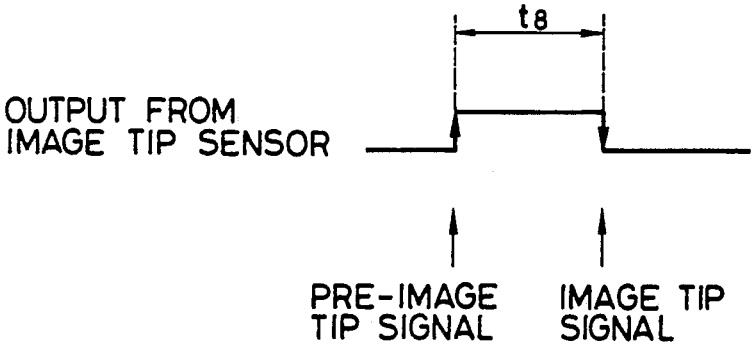

The operation of the blank LED array 14 will be described below. The LED array 14 is used to prevent the toner from being attached to the unnecessary portion of drum 20. In addition, the LED array 14 is also used to form a binding margin or to erase an image within or outside the designated area in the area designation mode (i.e., masking or trimming). The control timings of the LED array 14 are derived from a signal from the image tip sensor S2 for detecting the position of the optical system 24. A light-shielding plate **24-*a* (FIG. 57) is mounted on the optical system 24 to shield light emitted to the image tip sensor S2, thereby obtaining the signal from the image tip sensor S2. The length of the light-shielding plate 24-*a* is l2, and a signal is generated, as shown in FIG. 58, when the optical system is moved forward. Referring to FIG. 58, the leading edge of the image tip sensor output is defined as a pre-image tip signal, and the trailing edge is defined as an image tip signal. The tip of the original is exposed with light in response to the image tip signal. A period T8 is given as l2/Vk where Vk is the speed of the optical system. As shown in FIG. 56, the relationship between the blank LED array 14 and an optical path 305 of the light reflected by the original is given such that the array 14 is located in the upstream position by l1 with respect to the path 305**. Therefore, blanking control must be advanced by l1/Vp for the original if the process speed is given as Vp.

Control for forming a 2-mm margin at the leading edge or tip of a transfer sheet will be described below.

Figure 59:
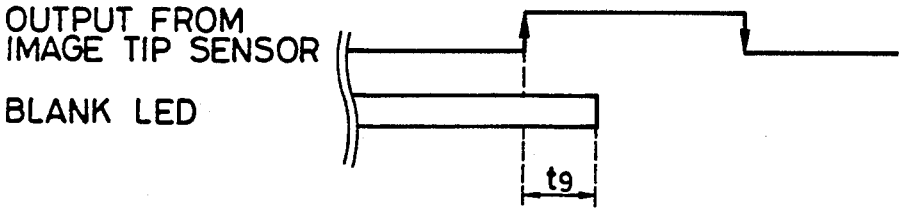

As shown in FIG. 59, the optical system is scanned to turn off the LED array 14 when the period t9 has elapsed upon generation of the pre-image tip signal. In this case, the period t9 is given as follows: $t9 = l2 + 2/Vk = l1/Vp - \alpha/Vp$ where $\alpha$ is ½ of the lighting width of the blank LED array 14. Therefore, the optimal margin at the leading edge of the transfer sheet can be obtained on the basis of a given magnification. In the reduction copy mode where the speed Vk of the optical system is large, l2 is set so as not to obtain a negative value of T9. Since the width $\alpha$ is not predetermined due to variations in light amounts, the width can be adjusted at the operating section 100.

Figure 60:
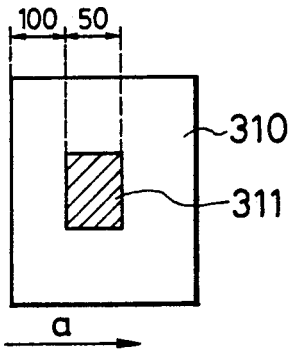
FIG. 60 is a view for explaining blank exposure timing.
Figure 61:
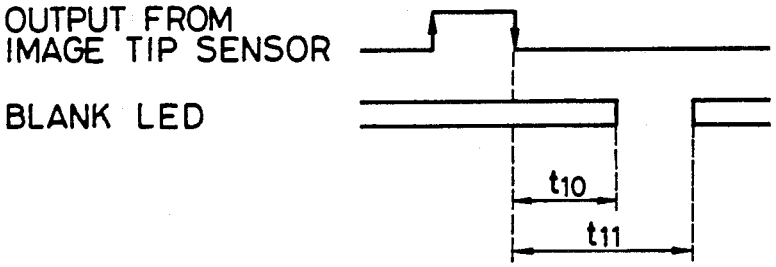

The area designation mode is considered. FIG. 60 shows an original 310 and a trimming area 311. An optical system 24 scans the original 310 in a direction of arrow a. For example, the range of width along the direction of arrow a is preset to be 100 mm to 100 mm. In this case, as shown in FIG. 61, the LED array 14 is turned off when a period t10 has elapsed upon generation of the image tip signal. When a period t11 has elapsed, the LED array 14 is turned on to output an image within only the designated area 311, as shown in FIG. 60. In this case, the periods t10 and t11 are defined as follows:

$$t10 = (100 \times \text{copy magnification})/Vp - \alpha/Vp$$

$$t11=(150\times\text{copy magnification})/Vp+\alpha/Vp$$

Under these definitions, a desired area can be blank-exposed. If a trimming area is given as an area excluding the area 311 in FIG. 60, the LED array 14 is turned off when the period t9 has elapsed upon generation of the pre-image tip signal, thereby forming a margin at the leading end. When a period t12 has elapsed upon generation of the image tip signal, the blank LED array 14 is turned on. When a period t13 has elapsed, the LED array 14 is turned off In this case, the periods t12 and t13 are defined as follows:

$$t12=(100\times\text{copy magnification})/Vp-\alpha/Vp$$

$$t13=(150\times\text{copy magnification})/Vp+\alpha/Vp$$

Figure 62:
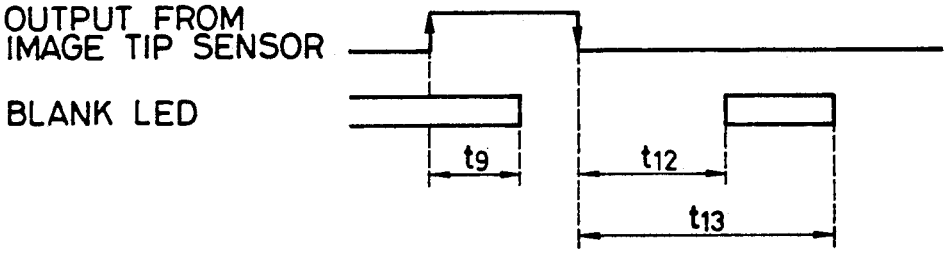

If trimming of an image within the designated area (i.e., white→image) is designated, the term $\alpha$/Vp is subtracted. However, if timing of an image outside the designated area (i.e., image→white) is designated, the term $\alpha$/Vp is added, thereby achieving accurate trimming. As described above, if copy operation of the designated area is executed with different colors at once, the areas are narrowed and subjected to copy operation in order to prevent mixing of the black and color toners. For example, if the area 311 is copied with black and the other area is copied with red in FIG. 60, control in FIG. 61 is performed. The period t10 is prolonged by a period corresponding to 1 mm, and the period t11 is shortened by a period corresponding to 1 mm. In the color copy mode, the blank LED array 14 is controlled, as shown in FIG. 62. The period t13 is prolonged by a period corresponding to 1 mm, thereby forming a 2-mm margin between the black and color areas. Even if misregistration slightly occurs, the black area does not overlap the color area.

Description of Mode Setting

Figure 63:
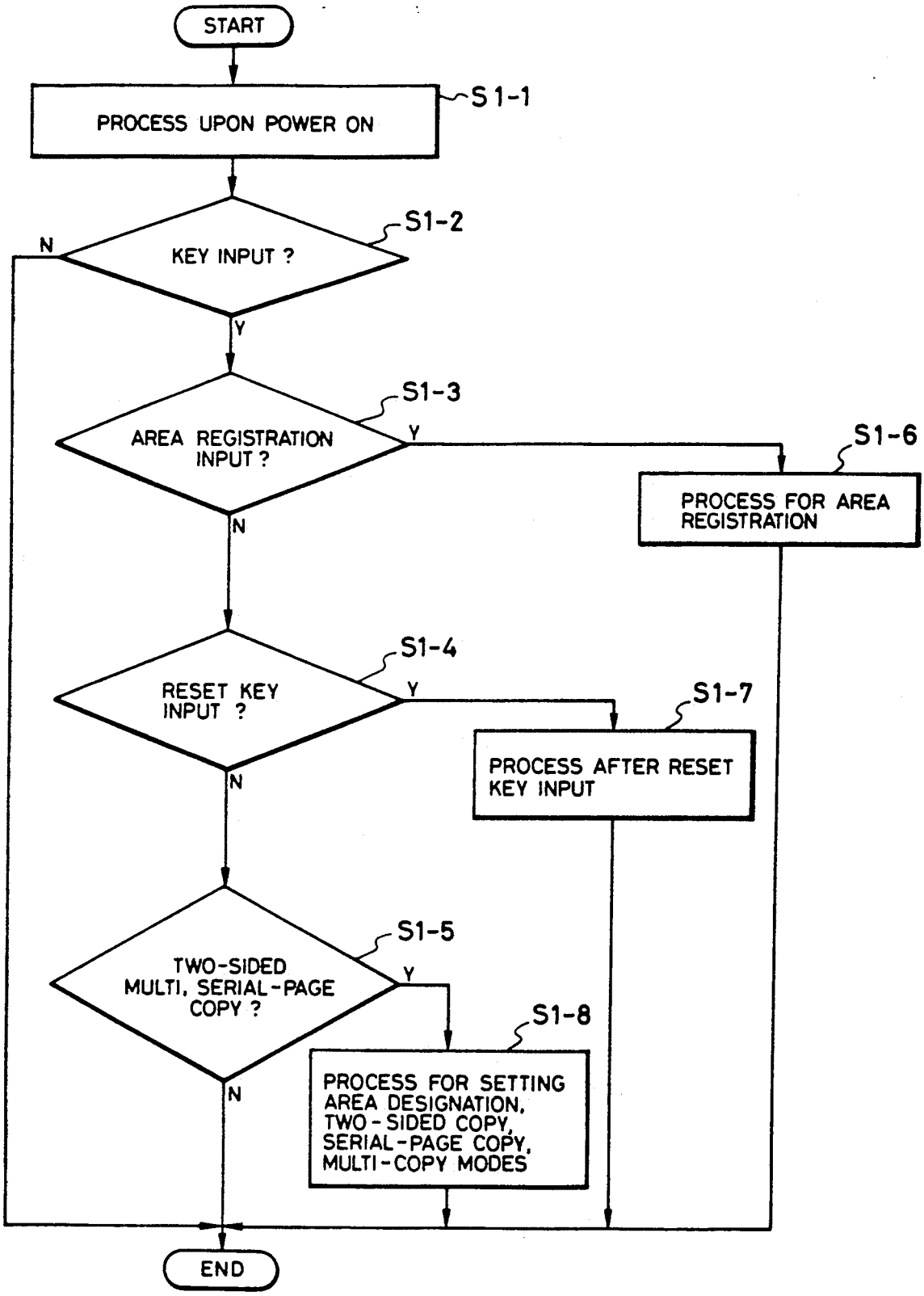
FIGS. 63 to 67 are flow charts for explaining input processing in the initial copy mode.

FIG. 63 is a flow chart for explaining power ON processing, clear processing at the time when the reset key 119 is depressed or when a predetermined period of time has elapsed (i.e., auto clear mode) upon completion of copy operation, and processing of input operations in the two-sided, multi-copy, serial page, and area designation modes.

Figure 64:
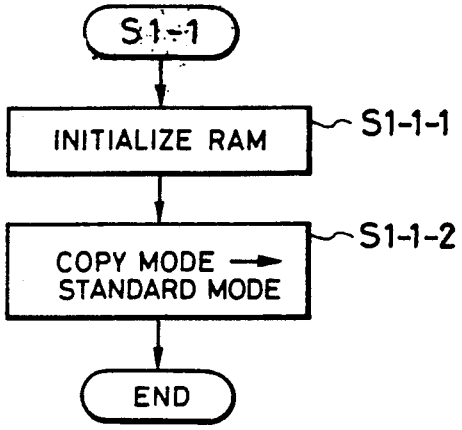

FIG. 64 is a flow chart for explaining the detailed operations in step 1—1. A battery is connected to the RAM 90 to back up the ROM contents even after the power switch is turned off. For this reason, when the power switch is turned on, necessary contents of the RAM 90 must be retained and unnecessary contents must be cleared (step 1-1-1). The copy mode is set in the standard mode (step 1-1-2). This standard mode is the same as that upon depression of the reset key 119. In the standard mode, the set number of copies is one, and the equal copy, the black developer, and the lower cassette are selected.

The control section 60 determines in step 1-2 whether a key input is entered at the operating section 100. The control section 60 then determines in step 1-3 whether the input is an area designation input. If YES in step 1-3, processing in step 1-6 (to be described in detail later) is performed. However, if the input is determined to be an input from the reset key 119 (step 1-4), processing in step 1-7 is performed. However, if the input is determined to be an input from the two-sided key 107, the serial page key 106, the multi-copy key 105, the image conversion key 103, or the binding-margin/frame-erasure key 108, processing in step 1-8 is performed.

Figure 65:
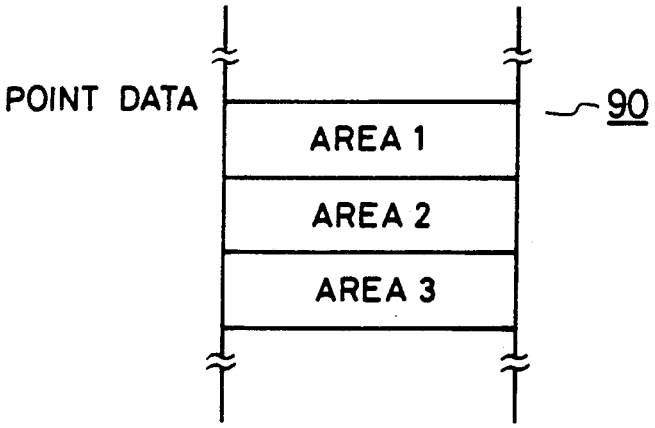

Processing in step 106 will be described below. Area 1, area 2, and area 3 are registered according to a setting method to be described later. In this case, the contents of area 1, area 2, and area 3 are stored in the predetermined memory areas of the RAM 90, as shown in FIG. 65.

Figure 66:
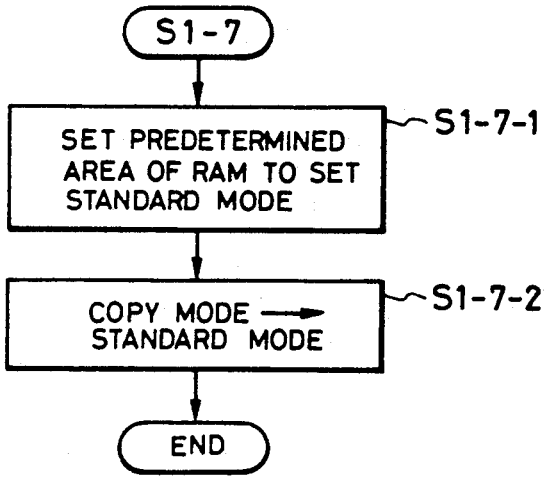

FIG. 66 is a flow chart for explaining detailed operations in step 1-7. The contents of this flow chart will be described below. The contents of the predetermined memory area of the RAM 90 are set to obtain the standard mode (step 1-7-1), and the standard mode is restored (step 1-7-2).

When the copy mode is reset to be the standard mode, registration of area 1, area 2, and area 3 is cancelled. However, RAM data registered in step 1-6 is not cleared in order to prevent the following inconvenience. If the user accidentally depresses the reset key 119, area registration must be performed again. Since the contents of the RAM are not cleared, as described above, the area registration data is not updated until the area registration is corrected.

Figure 67:
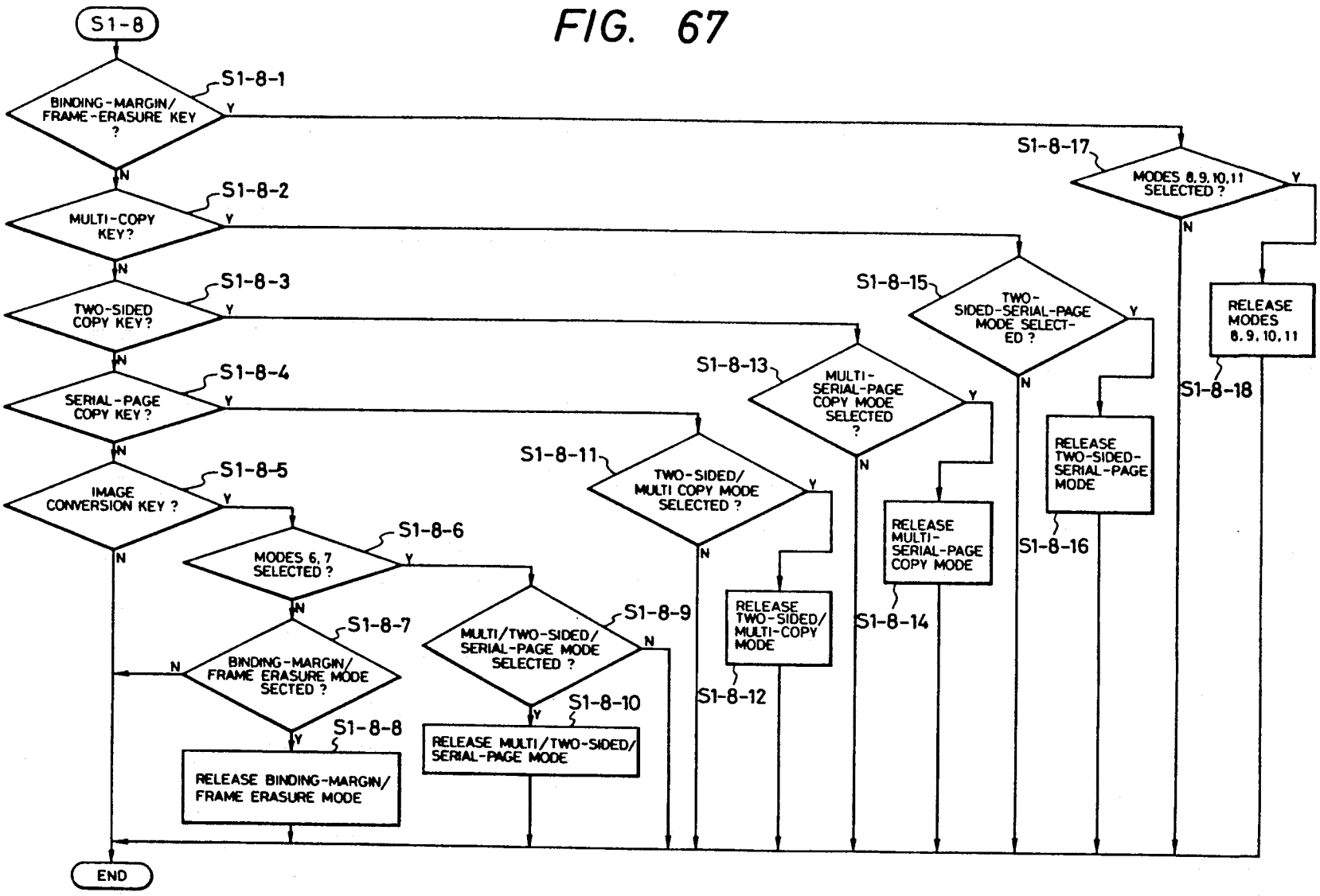

FIG. 67 is a flow chart showing the detailed operations in step 1-8, and the contents of this flow chart will be described below.

When the binding-margin/frame-erasure key is determined to be depressed (step 1-8-1) and if one of mode 8, mode 9, mode 10, and mode 11 is selected (step 1-8-17), the set copy mode is reset (step 1-8-18).

If a multi-copy key input is detected (step 1-8-2) and the two-sided copy or serial page mode is selected (step 1-8-15), the selected copy mode is reset (step 1-8-16).

If a two-sided key input is detected (step 1-8-3) and a multi-copy or serial page mode is selected (step 1-8-13), the selected copy mode is reset (step 1-8-14).

If a serial page key input is detected (step 1-8-4) and a two-sided or multi-copy mode is selected, the selected copy mode is reset (step 1-8-12).

If an image conversion key input is detected (step 1-8-5), mode 6 or mode 7 is selected (step 1-8-6) and multi-copy, two-sided copy, or serial page mode is selected (step 1-8-9), then the combination of copy modes is reset (step 1-8-10).

Under the conditions wherein an image inversion key input is detected (step 1-8-5), neither mode 6 nor mode 7 are not selected (i.e., one of mode 8, mode 9, mode 10, and mode 11 is selected) (step 1-8-6), and the binding margin or frame erasure mode is selected (step 1-8-7), the combination of copy modes is reset (step 1-8-8).

Interlocking (if a given mode is selected, the currently selected mode is reset) of the copy modes has been described above. However, modes not associated with interlocking can be freely combined. For example, the two-sided copy mode may be combined with one of mode 8, mode 9, mode 10, and mode 11. The multi-copy mode may be combined with one of mode 8, mode 9, mode 10, and mode 11. Therefore, the color, multi-copy, or two-side copy mode can be combined with masking, trimming or the like to output a desired image.

Description of Density Correction

Two methods are available to optimize a copy density in conventional copying machines.

The first method is to set an amount of light from a lamp for lighting an original to be a predetermined value. The second method is to set a developing bias voltage to a predetermined value.

A method for effectively controlling these values is given as follows. Data representing optimal combinations of these values is stored in a nonvolatile memory in a copying machine at the time of shipment, and the user operates a density adjustment key according to the favor of the user. In the case that the process means is deteriorated over time and that the standard density cannot be obtained even if the density adjustment key is set at the center (the standard density value), the copying machine may be designed such that a developing bias value can be corrected.

If lamp light amounts and developing bias values are stored in the RAM, the currently set values must be displayed at the time of adjustment for lamp light amount or developing bias value. However, the number of display LEDs cannot be increased without limitations on the operating section of the copying machine due to economical reasons. In addition, the increase in LEDs results in degradation of operability. The exposure light amount is indicated by lighting, and the developing bias value is indicated by flickering.

A method of controlling the exposure light amount and developing bias value will be described with reference to FIGS. 68 to 71.

Figure 68:
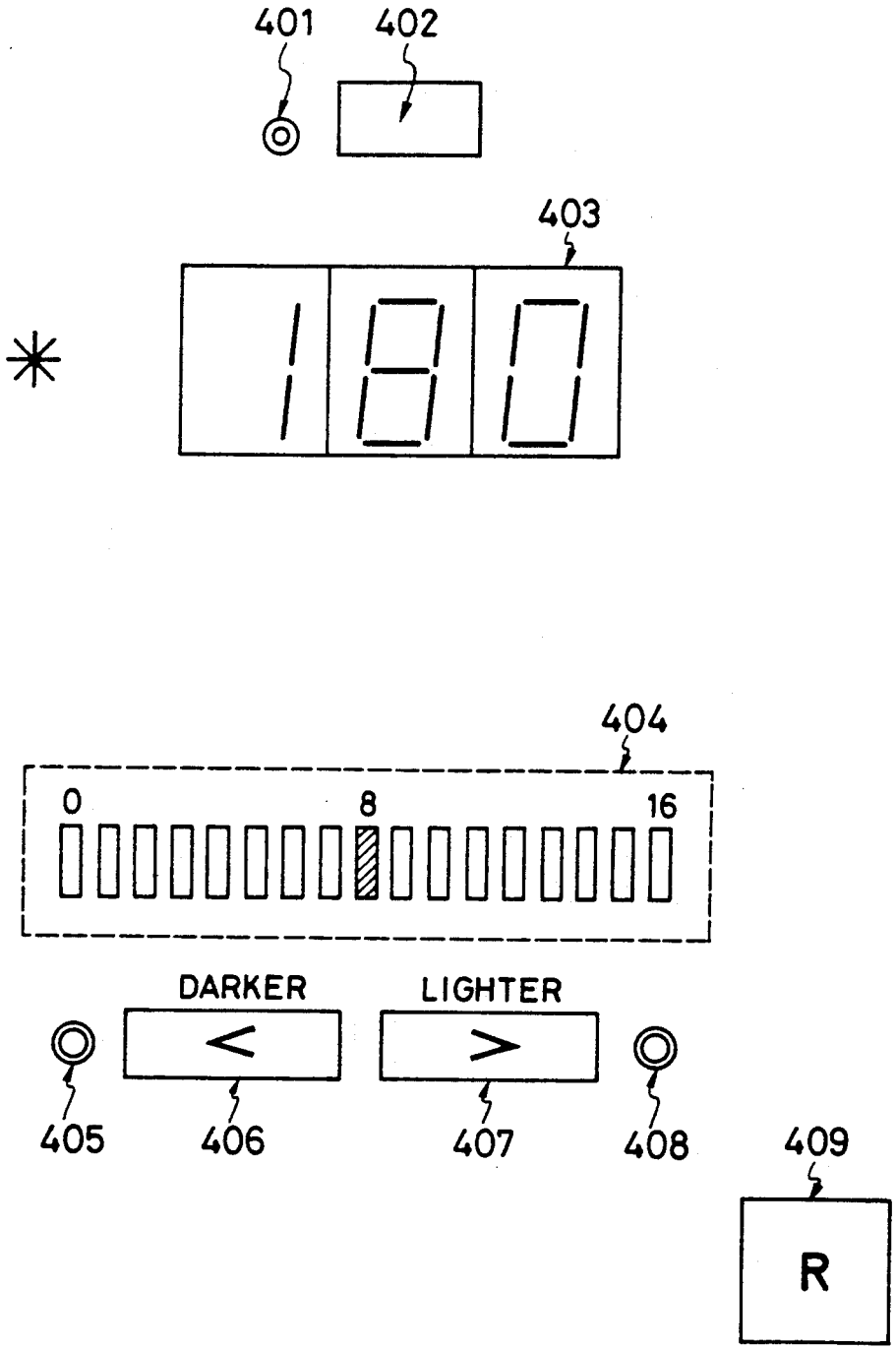
FIG. 68 is a detailed view showing a density control portion of an operation display section in FIG. 3.

Referring to FIG. 68, an arrangement includes three-digit seven-segment LEDs 403 corresponding to the magnification LEDs 154 in FIG. 3. The LEDs 403 can also display a developing bias voltage D-Bis at the time of its adjustment (to be described later). LEDs 404 correspond to density display LEDs 162. Copy density adjustment keys 406 and 407 correspond to the copy density adjustment keys 114, respectively. Keys 405 and 408 correspond to copy density correction keys 115, respectively. Data transfer keys 401 and 402 transfer data from a data ROM 440 (to be described later) to a data ROM 441. A flickering OFF key 409 resets the developing bias value flickering of one of the density indication LEDs 404. The keys 401, 402, and 409 may be arranged on the operating section 100. However, these are not normally used, they are preferably arranged inside the copying machine.

Figure 69:
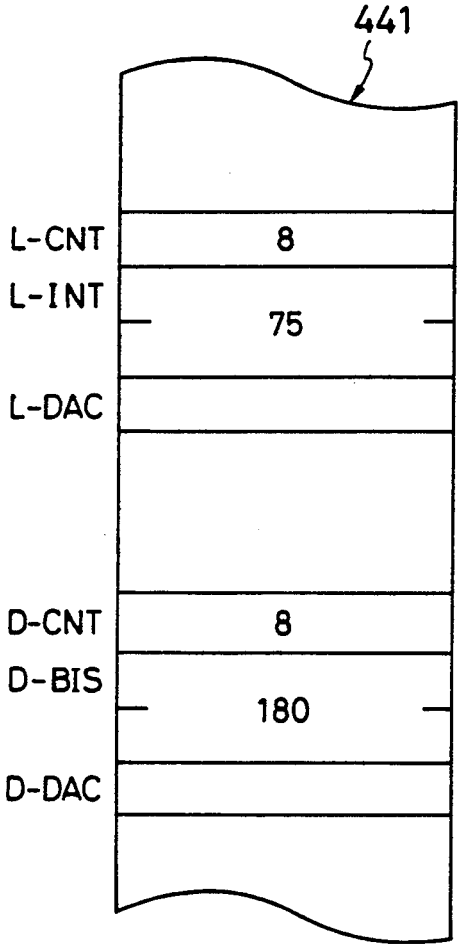
FIG. 69 is a memory map of a data RAM 441.

FIG. 69 shows predetermined areas of the data RAM 441 for adjusting the exposure amount and developing bias value. Values in FIG. 69 are RAM data values backed up by a lithium battery. A data area L-CNT stores an exposure correction index data. A data area L-INT stores lamp control voltage data corresponding to the exposure correction index data. A memory area L-DAC stores a scale-converted value of the L-DAC value so as to set the L-DAC value in an 8-bit D/A converter. Memory areas D-CNT, D-Bis, and D-DAC for developing bias voltage correspond to the memory areas L-CNT, L-INT, and L-DAC, respectively.

Figure 70:
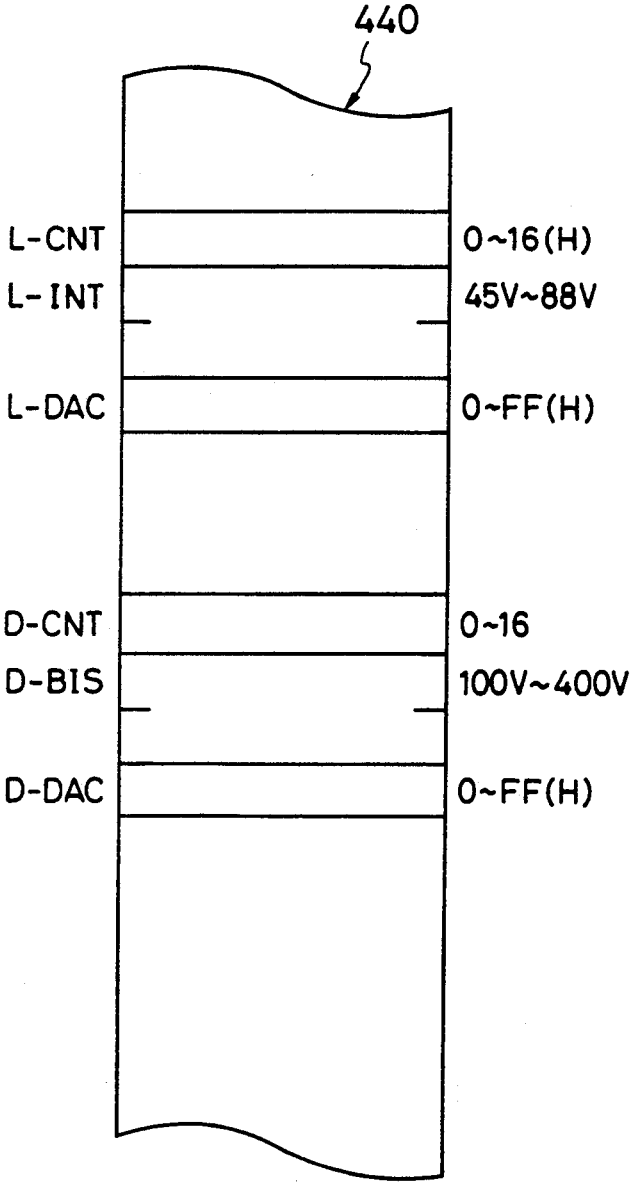
FIG. 70 is a memory map of a data ROM 440.

FIG. 70 shows a memory map of the data ROM 440 for storing standard data of the exposure amount and the developing bias value. Memory areas L-CNT to D-DAC of the ROM 440 correspond to the memory areas I.-CNT to D-DAC of the RAM 441, respectively.

Data in the ROM 440 is preset as standard data at the time of, for example, shipment of the copying machine so as to obtain an optimal copy density. All standard data in the data ROM 440 is transferred to the data RAM 441 upon depression of the data transfer key 402. Upon depression of the data transfer key 401, only the standard data stored in the data areas L-CNT and D-CNT of the data ROM 440 is transferred to the corresponding areas of the data RAM 441.

Figure 71:
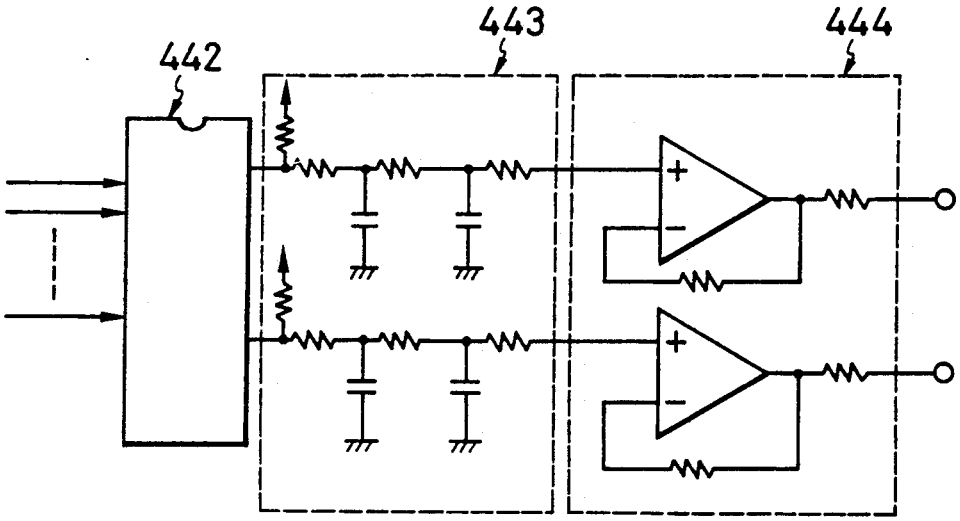
FIG. 71 is a circuit diagram of a circuit for setting a lamp control voltage and a developing bias voltage in a lamp control circuit CVR and a high voltage generator HVT.

The control section 60 determines an optimal exposure value and an optimal bias voltage on the basis of the data stored in the data RAM 441 prior to copy operation. FIG. 71 shows a circuit for respectively setting in the lamp control circuit CVR and the high voltage generator HVT the lamp control and developing bias voltage values respectively set in the data areas L-INT and D-Bis of the data RAM 441. Referring to FIG. 71, when the copy key is depressed to initiate the copy operation, the control section 60 converts the lamp control and developing bias voltages respectively stored in the memory areas L-INT and D-Bis of the data RAM 441 into 8-bit data at predetermined timings. The converted 8-bit data is stored in the areas L-DAC and D-DAC and is output to a pulse width modulator 442. An output from the pulse width modulator 442 is converted into DC data by a filter 443. The DC data is supplied to the lamp control circuit CVR and the high voltage generator HVT through a buffer amplifier 444.

The method of adjusting the lamp control value and the developing bias value will be described according to this embodiment.

Upon depression of the copy density adjustment key 406 or 407, the value in the memory area L-CNT of the data RAM 441 is incremented or decremented by one. One of the segments 404 is shifted and turned on on the basis of the value in the area L-CNT. At the same time, the predetermined value is incremented or decremented in the area L-INT. Upon depression of the data transfer key 402, all data in the data ROM 440 is transferred to the data RAM 441. The standard values are stored in the corresponding areas (e.g., L-CNT=8 and L-INT=75) of the RAM 441. The LED corresponding to the value "8" of the area D-CNT flickers on the segment 404. At the same time, the value "180" in the area D-Bis is displayed on the segment LEDs 403. Upon depression of the copy density correction key 405 or 408, the value in the memory area D-CNT of the RAM 441 is incremented or decremented by one, and the corresponding one LED of the segment LEDs 404 flickers and is shifted in response to updating of the value in the memory area D-CNT. At the same time, the predetermined value is incremented or decremented in the memory area D-Bis of the data RAM 441. It should be noted that the segment LEDs 404 flicker in the developing bias adjustment so as to distinguish this adjustment from the light control value adjustment. More specifically, flickering of the segment LEDs 404 is performed upon depression of the copy density correction key 405 or 408. However, upon depression of the copy density adjustment key 406 or 407, the LEDs 404 are subjected to lighting. If lighting and flickering are simultaneously instructed, the lighting instruction has a priority over the flickering instruction.

Flickering of the segment LEDs 404 can be disabled by the key 9. However, even if the key 9 is depressed during lighting of the segment LED, the lit LED is not turned off. When the copy density correction key 405 or 408 is depressed, the value in the area D-Bis of the data RAM 441, i.e., the developing bias voltage value is displayed on the magnification LEDs 403.

When the copy key is depressed, this displayed is erased and the previous magnification display can be restored. An example of adjustment will be described in detail below. The data transfer key 402 is depressed to initialize the data RAM 441 to cause the segment LEDs 403 to display the standard developing bias value "180". At the same time, the LED corresponding to the standard value "8" flickers. The user properly operates the copy density correction keys 405 and 408 to obtain an optimal density of the standard original.

According to this embodiment as described above, the developing bias shift amount is displayed on the LEDs for displaying the lamp control value. Developing $ bias adjustment can be performed without adding a display device which is normally used.

Description of Auto Paper Selection Mode

Auto paper selection mode (to be referred to as an APS hereinafter) assigned to the copying machine of this embodiment will be described with reference to FIG. 72.

Different types of cassettes (paper sizes) can be attached to the copying machine of this embodiment. The copying machine has the APS function for automatically selecting an optional paper cassette according to the set original size and the designated magnification. Referring to FIG. 72, a key 411, LEDs 412, 413, 414, 415, and 416, and a key 417 correspond to the key 124, the LEDs 165, 156, 157, 158, and 159, and the key 113 in FIG. 3, respectively.

Figure 72:
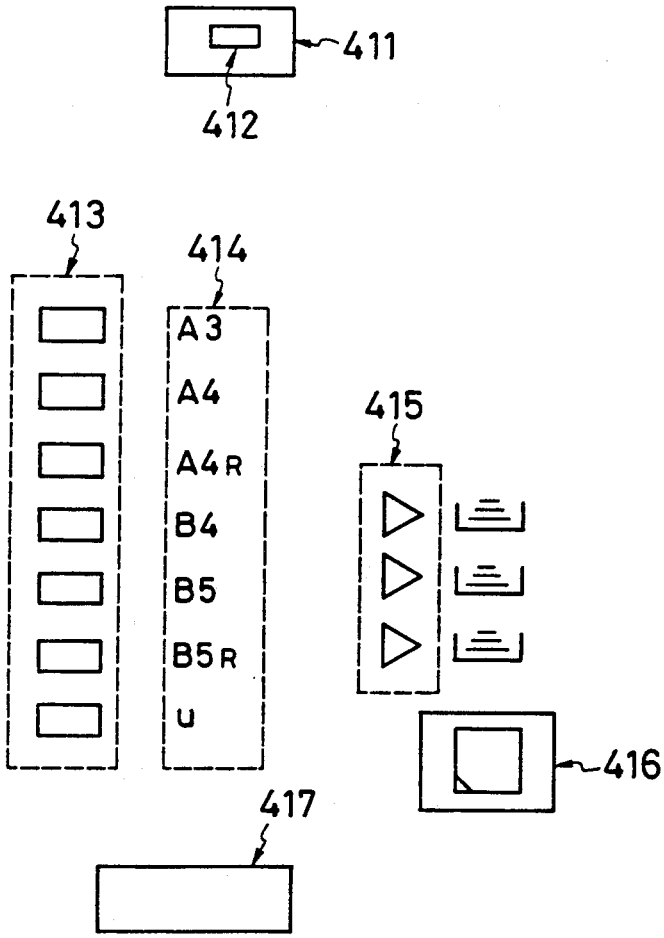
FIG. 72 is a view for explaining an APS mode.

Referring to FIG. 72, the key 411 sets or resets the APS mode. The set/reset state of the APS mode is indicated by the LED 412. The LEDs 414 indicate all cassettes currently attached to the copying machine. One of the LEDs 413 indicates the currently selected paper size among the sizes indicated by the LEDs 414. However, if the sheets are not present in the selected cassette, the corresponding one of the LEDs 413 is not turned on. One of the LEDs 415 indicates the currently selected cassette attaching port (including the hand-insertion port). If the sheets are not present in the selected cassette, the LED 416 is turned on. The key 417 serves as a cassette selection key. Every time the key 417 is depressed, the LEDs 415 are cyclically shifted downward one by one.

In the copying machine of this embodiment, if the APS mode is selected and the cassette selection key 417 is depressed, the APS mode is reset and the LED 412 is turned off. However, when the copy key is depressed while an original press plate 34 is kept open, the original size cannot be detected and the APS mode is cancelled. In this case, the transfer sheet is fed from the lowermost cassette.

The copying machine of this embodiment is designed to solve various kinds of inconvenience occurring at the time of APS mode. The inconvenience includes the case wherein a cassette containing optimal transfer sheets is not present, or the case wherein the original size cannot be detected.

Operations in the case of incapable of smoothly setting the APS mode will be described below.

(1) When an original size cannot be detected, the APS mode is reset, and the predetermined priority cassette (e.g., the lowermost cassette) is selected.

(2) Upon the power ON operation, the auto clear operation, or depression of the reset key 119, when two or more paper cassettes are not attached to the copying machine, the APS mode is reset, and only the cassette attached to the copying machine is selected.

(3) If no cassettes are attached to the copying machine, the APS mode is reset, and the predetermined priority cassette is selected. The absence of sheets is indicated (the LED 416 is lit).

(4) Under the conditions wherein only one paper cassette is attached to the copying machine and the cassette attaching port at which no cassette is present is selected (the LED 416 is being lit), when the APS key 411 is depressed, the LED 412 is turned on in response to the key input signal from the APS key 411. Subsequently, only the cassette attached to the copying machine is then selected, and the LED 416 is turned off. Thereafter, the LED 412 is turned off to reset the APS mode.

Figure 73:
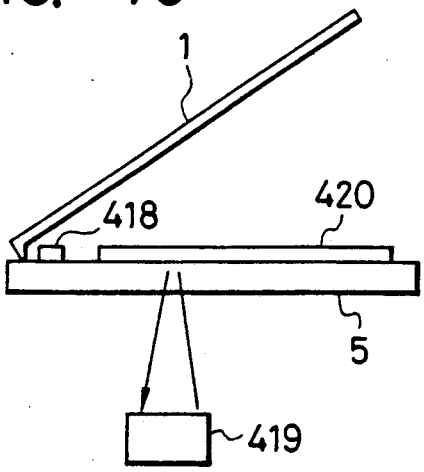
FIG. 73 is a view showing an upper portion of the copying machine in FIG. 1.

A method of detecting an original size will be described below. FIG. 73 shows the upper portion of the copying machine in FIG. 1. The upper portion includes a microswitch 418 for detecting opening/closing of the original plate cover 1, and a sensor 419 for detecting the presence/absence of the original. An original 420 is placed on the original glass plate 5.

Figure 74:
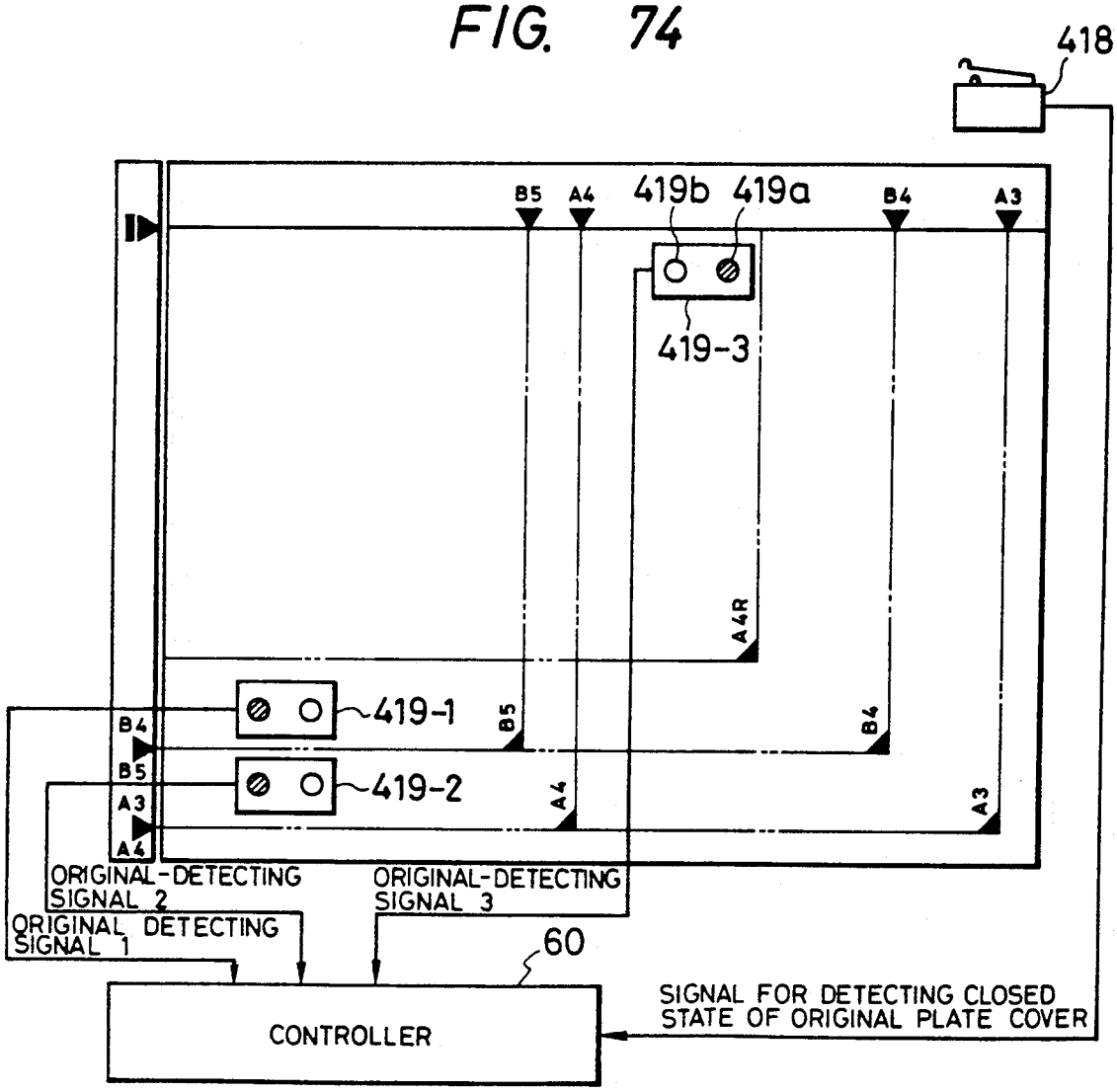
FIG. 74 is a block diagram showing an arrangement of a circuit for detecting an original size.

FIG. 74 is a block diagram showing the schematic arrangement of the upper portion.

Since the auto paper selection function and an auto variable magnification function are provided for this copying machine, an original size must be detected when such a function is used.

Three original detecting circuits 419-1 to 419-3 are arranged below the original glass plate 5 at positions shown in FIG. 74. When the original plate cover is closed, the presence/absence of the original is detected. The control section 60 determines that the original size is one of the standard sizes A3, B4, A4 and B5.

The original detecting circuits 419-1 to 419-3 energizes LEDs **419*a* to emit beams onto an original surface, and beams reflected by the original surface are received by phototransistors 419*b* to detect signals representing the presence/absence of the original. These signals are sent to the control section 60**.

When the original table cover is closed at an angle of about 30° or less, the microswitch 418 arranged on the housing of the copying machine is turned on to detect the original size. The original detecting circuits 419 are included in the sensors S in FIG. 2.

The control section 60 may detect the original size on the basis of combinations of outputs from the original detecting sensors, as shown in FIG. 75.

Original size detection is not limited to the methods described above. For example, an imaging element such as a CCD may be arranged in an optical system to detect an edge of the original and hence the original size.

Description of Memory Diagnosis

Figure 78:
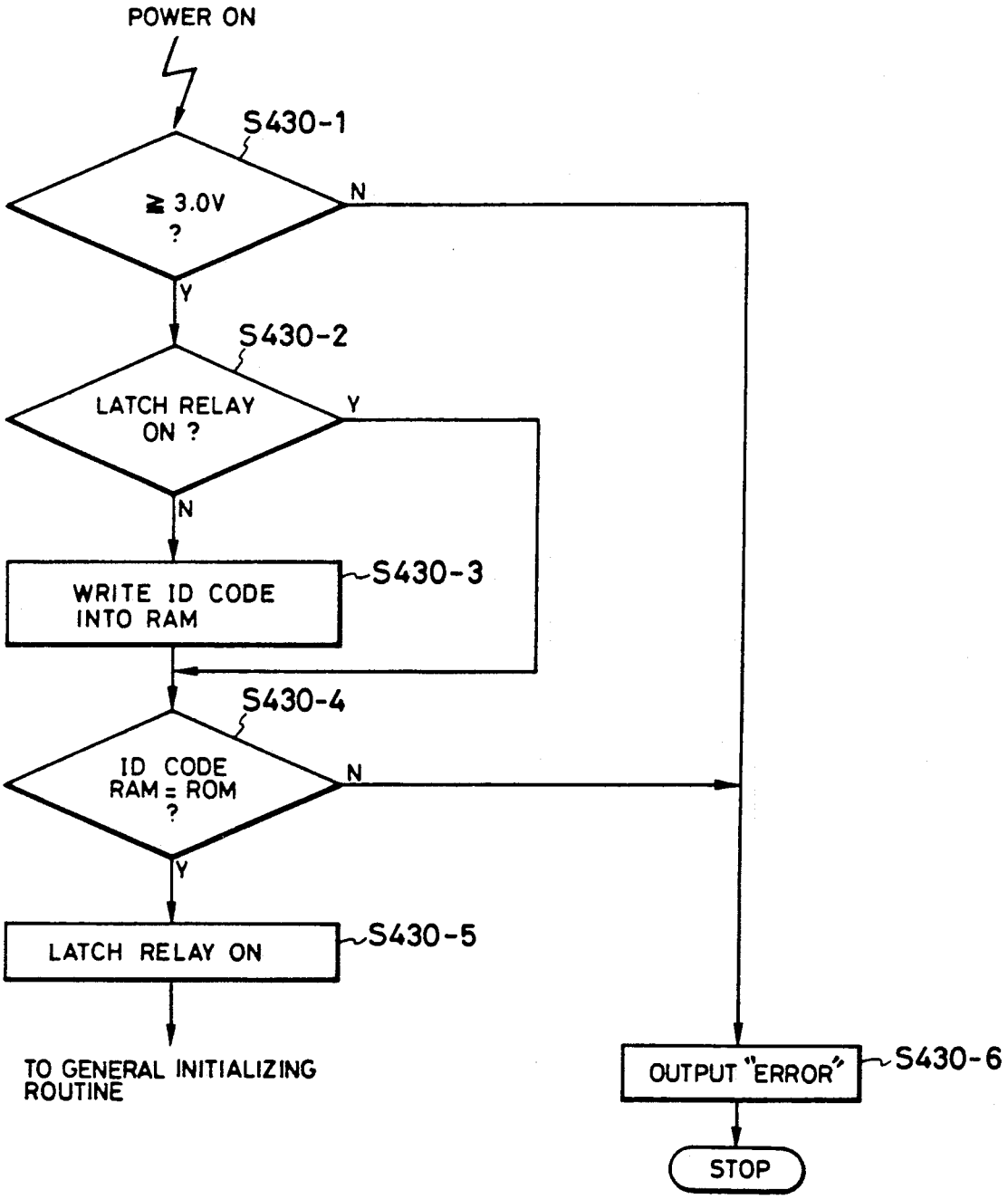
FIG. 78 is a flow chart for explaining the operation of the circuits in FIGS. 76 and 77.

A diagnosis method of a nonvolatile data memory in this embodiment will be described with reference to FIGS. 76 to 78.

The copying machine according to this embodiment has a nonvolatile data memory 421. Various control parameters such as a high voltage output value, an exposure voltage value, and a registration correction value are stored in the memory area of the nonvolatile data memory 421. The control parameters are properly read out to perform copy operation.

The copying machine of this embodiment has a function for diagnosing whether the data read out from the nonvolatile data memory 421 is correct. By this diagnosis function, system reliability can be further improved.

Referring to FIG. 76, an arrangement includes the static RAM 421 (i.e., the nonvolatile data memory) with a standby function to stored various control parameters, a CPU (corresponding to the control section 60 in FIG. 2) for executing various control sequences on the basis of the data read out from the RAM 421, a lithium battery 422 serving as a backup battery of the RAM 421. When a voltage of 5 V is applied to the RAM 421, a chip enable terminal $\overline{CE}$ is set at logic "0", and the RAM 421 can be accessed under the control of the CPU 423. However, the voltage of 5 V is withdrawn from the chip enable terminal $\overline{CE}$ when the power switch is turned off. In this state, the chip enable terminal $\overline{CE}$ is set at high level, a current is supplied from the lithium battery 422 to a port VDD of the RAM 421. Therefore, even if the copying machine is deenergied, the data in the RAM 421 is backed up by the lithium battery 422.

An output voltage of the lithium battery 422 can be monitored when the voltage of +5 V is active under the control of the microprocessor (CPU) 423.

Referring to FIG. 77, a parallel I/O port 428 connected to the CPU 423 can drive a latch relay 426. The state of the latch relay 426 is read out by the CPU 423 through the parallel I/O port 428.

A push switch 427 releases the latch relay 426 and is used to initialize the data RAM 421.

The diagnosis operations of the backup battery 422 and the RAM 421 under the control of the CPU 423 will be described with reference to a flow chart of FIG. 78.

In step 430-1 wherein the power switch is turned on, a voltage of the data retaining power source as the backup battery 422 connected to an A/D conversion input terminal of the CPU 423 is compared with a reference voltage (e.g., 3.0 V). If the voltage at the A/D conversion input terminal is lower than the reference voltage, the flow advances to step 430-6, and a data error is displayed to request the user to perform proper operation.

However, if the CPU 423 determines in step 430-1 that the voltage of the data retaining power source 422 exceeds the reference voltage, the flow advances to step 430-2. The CPU 423 then determines in step 430-2 whether the latch relay 426 is ON. If NO in step 430-2, the flow advances to step 430-3, and data prestored in the ROM is transferred to the predetermined area of the RAM 421. The CPU 423 determines in step 430-4 in response to data read out from the ROM whether the transferred data can be completely read out from the RAM 421. If the CPU 423 determines that the RAM 421 can be normally operated, the coil of the latch relay 426 is energized in step 430-5.

However, if the CPU 423 determines in step 430-2 that the latch relay 426 is ON, the CPU 430 determines that the initialization has already executed. The flow then advances to step 430-4. The predetermined address data of the RAM is compared with that of the ROM. If a coincidence between these address data is established, the CPU 423 determines that the RAM 421 is normally operated.

The present invention is not limited to the embodiments described above. Various changes and modifications may be made without departing the appended claims.

What is claimed is:

1. An image forming apparatus comprising:

exposing means for exposing an original;

designating means for designating an arbitrary area of an original;

image forming means for forming said exposed original image on a recording member, wherein said image forming means includes predetermined image forming means for forming a predetermined image within said designated area without exposing the original by said exposing means, wherein said image forming means includes a first visualizing unit and a second visualizing unit, wherein said first visualizing unit visualizes an image with a first color, and wherein said second visualizing unit visualizes an image with a second color; and control means for controlling said image forming means such that said predetermined image and said original image are formed within said designated area with an overlap operation, wherein said control means controls said image forming mean such that said predetermined image is formed with the first color and such that said original image is formed with the second color.

2. An apparatus according to claim 1, wherein said predetermined image forming means forms a solid image within said designated area.

3. An apparatus according to claim 1, wherein said predetermined image forming means forms an image in the shape of line.

4. An apparatus according to claim 1, wherein said control means controls said image forming means such that after said predetermined image is formed on said recording member, said original image is formed on said recording member.

5. An apparatus according to claim 4, wherein said image forming means includes fixing means for fixing an image formed on said recording member, and said control means controls said image forming means such that after said predetermined image is fixed on said recording member, said original image is formed on said recording member.

6. An apparatus according to claim 1, wherein said control means controls said image forming means such that said predetermined image is formed when said exposing means is turned off.

7. An apparatus according to claim 1, wherein said designating means is able to designate a second area different from said area of said original, and said control means controls said image forming means such that an image of a portion different from said second area of said original is erased.

8. An apparatus according to claim 1, wherein said predetermined image includes a painted out image.

9. An image forming apparatus comprising:

exposing means for exposing an original;

image forming means for forming on a sheet an image of said original exposed by said exposing means, wherein said image forming means includes first visualizing means for forming an image with a first color and second visualizing means for forming an image with a second color;

designating means for independently designating a plurality of arbitrary areas of said original, and for designating an image forming color for each of said designated areas wherein said designating means includes a plane member, and a designating member for designating a surface position of said plane member, and wherein when a designated surface position on the plane member is within an area designating surface area information is outputted and when the designated position on the plane member is within a color designating surface color information is outputted; and control means for controlling said image forming means such that images of a plurality of designated areas according to area information outputted from said designating means are formed with respective colors according to color information outputted from said designating means.

10. An apparatus according to claim 9, wherein said control means comprises a memory for storing data representing positions of the arbitrary areas designated by said area designating means and data representing the designated colors.

11. An apparatus according to claim 9, wherein said control means controls said image forming means such that an image of said area designated prior to color designating operation of said designating means is formed with said designated color.

12. An apparatus according to claim 9, wherein said control means controls said image forming means such that after said first visualizing means forms an image on a sheet, said second visualizing means forms an image on the same sheet.

13. An apparatus according to claim 9, wherein said image forming means includes erasing means for erasing an unnecessary image, and said control means controls said erasing means in response to an area designated by said designating means.

14. An apparatus according to claim 13, wherein said image forming means includes a photosensitive member and charging means for charging a surface of said photosensitive member, and said erasing means discharges electric charge on said surface of said photosensitive member in order to make said surface uncharged state.

15. An image forming apparatus comprising:

exposing means for exposing an original;

image forming means for forming on a sheet an image of said original exposed by said exposing means, wherein said image forming means includes first visualizing means for forming an image with a first color and second visualizing means for forming an image with a second color;

area designating means for designating a selected area of said original mode designating means graphically displayed for designating an image forming mode for the area designated by said area designating means, wherein said mode designating means is capable of selecting one of a first mode in which an inside image of the designated area is formed with the first or second color, a second mode in which an outside image of the designated area is formed with the first or second color, and a third mode in which the inside image of the designated area is formed with the first color and the outside image of the designated area is formed with the second color; and control means for controlling said image forming means such that the image in an area designated by said area designating means is formed in the image forming mode designated by said mode designating means.

16. An apparatus according to claim 15, wherein said control means controls said image forming means such that after said first visualizing means forms an image on a sheet, said second visualizing means forms an image on said sheet.

17. An apparatus according to claim 15, wherein said control means controls said image forming means such that said images of said first area and of said second area are formed on the same surface of the same sheet in said mode.

18. An apparatus according to claim 15, wherein said image forming means includes erasing means for erasing an unnecessary image, and said control means controls said erasing means in response to an area designated by said designating means.

19. An apparatus according to claim 18, wherein said image forming means includes a photosensitive member and charging means for charging a surface of said photosensitive member, and erasing means discharges an electric charge on said surface of said photosensitive member in order to provide an uncharged surface.

20. An apparatus according to claim 15, wherein said mode designating means is able to designate both an image forming color and one among the first, second, and third modes.

21. An apparatus according to claim 15, wherein said area designating means includes a plane surface member for placing the original thereon and wherein said mode designating means is arranged at a portion of said plane surface member.

* * * * *

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

ON THE TITLE PAGE,

[56] References Cited

U.S. PATENT DOCUMENTS

Line 4,
insert --4,582,417 4/1986 Yagasaki, et al. ..... 355/7
4,538,182 8/1985 Saito, et al. ..... 358/280--

ON THE TITLE PAGE,

[75] Inventors

Line 5, "Kazuki Miyamato," should read -- Kazuki Miyamoto,--.

SHEET 7

Fig. 6A, "ONE-SIDE" should read --ONE-SIDED--.

SHEET 19

Fig. 20, "TIMIN" should read --TIMING--.

SHEET 30

Figure 37:
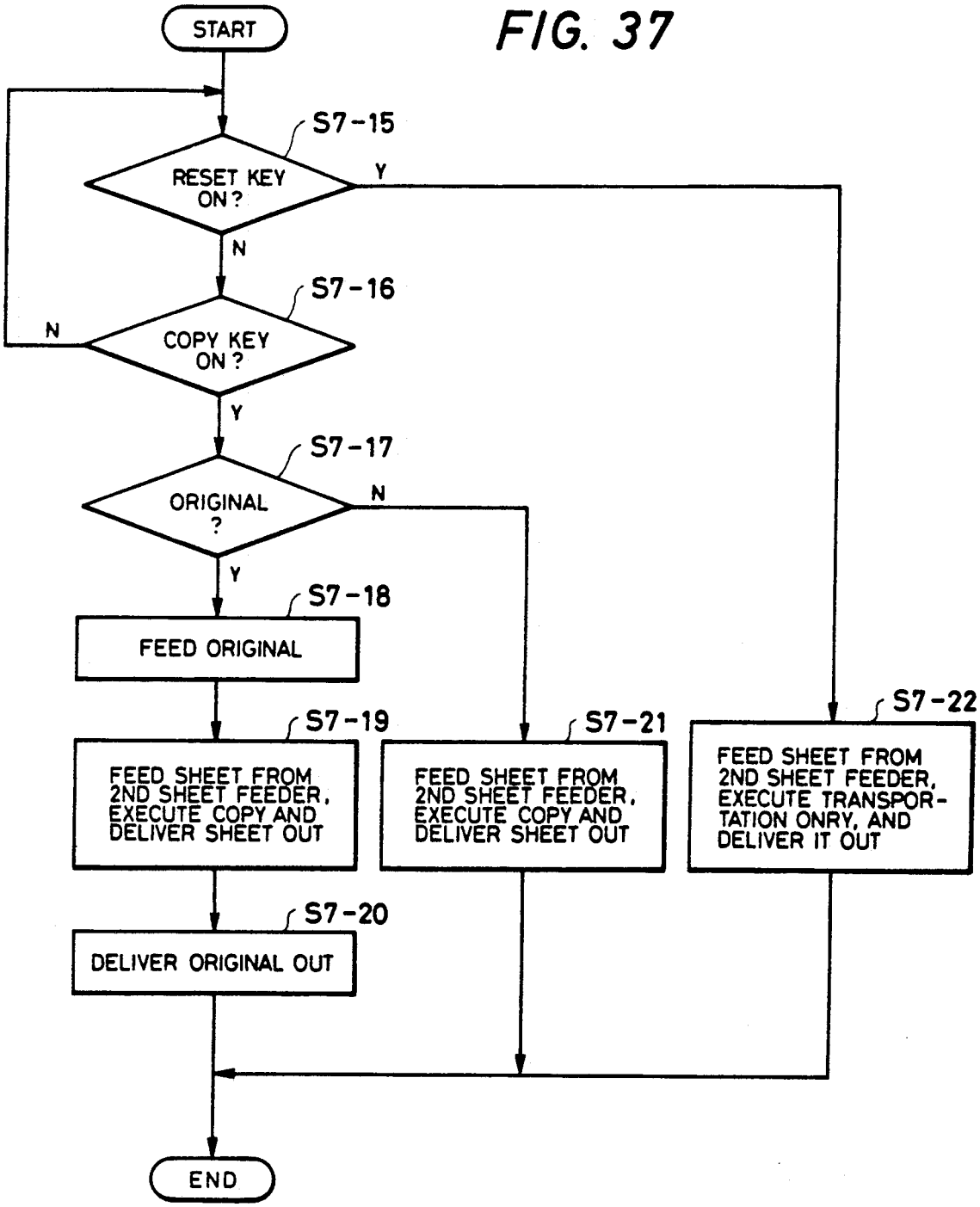

Fig. 37, 'ONRY" should read --ONLY--.

SHEET 43

Fig. 67, "SECTED" should read --SELECTED--.

COLUMN 1:

Line 7, "11/17/86," should read --Nov. 17, 1986,--; and
Line 63, "cannot" should read --modes cannot--.

COLUMN 5:

Line 47, "Sensors 16 and 17" should read --Sensors S16 and S17--; and
Line 64, "one-side" should read --one sided--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 6:

Line 6, "motor 18" should read --motor 19--;
Line 38, "rollers 10" should read --roller 10--; and
Line 41, "rollers 10," should read --roller 10,--.

COLUMN 7:

Line 19, "rollers 10." should read --roller 10.--.

COLUMN 8:

Line 31, "mode," should read --mode, a key 112 for designating a standard magnification ratio,--; and
Line 66, "LEDs 132 and 37" should read --LEDs 132 to 137--.

COLUMN 9:

Line 27, "one-side" should read --one-sided--; and
Line 66, 'LEDS 156" should read --LEDs 156--.

COLUMN 10:

Line 30, "comprise" should read --comprises--;
Line 46, "form" should read --from--; and
Line 50, "tors 81." should read --tor 81.--.

COLUMN 11:

Line 37, "key 91," should read --key 91, and--; and
Line 60, "use" should read --user--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 12:

Line 6, "One-Side" should read --One-Sided--;
Line 7, "(LIghting" should read --(Lighting--;
Line 9, "one-side" should read --one-sided--;
Line 19, "sides a" should read --sides A--;
Line 22, "faces" should read --face--;
Line 29, "One-Side" should read --One-Sided--;
Line 58, "area" should read --Area--; and
Line 67, "coped" should read --copied--.

COLUMN 13:

Line 2, "area" should read --Area--.

COLUMN 14:

Line 11, "are" should read --is--; and
Line 33, "recirculation" should read --recirculates--.

COLUMN 16:

Line 19, "RDF," should read --RDF, if--; and
Line 32, "sheet" should read --sheets--.

COLUMN 17:

Line 24, "step 303-6." should read --step 302-6.--; and "step 303-6," should read --step 302-6,--; and
Line 52, "connector a" should read --connector A--.

COLUMN 18:

Line 39, "(step 4-3)." should read --(step 4-3-2).--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 19:
Line 29, "mode," should read --mode, and--.

COLUMN 21:
Line 29, "key 109" should read --key 104--;

COLUMN 22:
Line 42, "advances" should read --advances to--; and
Line 45, "the" should read --if the--.

COLUMN 23:
Line 47, "NO" should read --YES--; and
Line 48, "is" should read --are--.

COLUMN 24:
Line 16, "are" should read --is--; and
Line 27, "the" (1st occurrence) should read --if the--.

COLUMN 25:
Line 7, "counter 200.12" should read --counter 200-12--; and
Line 66, "images" should read --the images--.

COLUMN 26:
Line 14, "section 150-3," should read --section 250-3,--; and
Line 26, "area" should read --designated area--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 31:
Line 39, "copy" should read --copying--.

COLUMN 34:
Line 15, "turned" should read --turns--;
Line 16, "is" (second occurrence) should be deleted; and
Line 54, "rotation" should read --rotation.--.

COLUMN 36:
Line "in" should be deleted.

COLUMN 37:
Line 6, "from" should read --from when--;
Line 12, "reaches." should read --is reached.--; and
Line 56, "anC." should read --and 1.--.

COLUMN 38:
Line 63, "stocked" should read --stacked--.

COLUMN 39:
Line 37, "no toner" should read --no-toner--; and
Line 55, "represents" should read --represent--.

COLUMN 40:
Line 8, "tone" should read --toner--;
Line 30, "T8" should read --t8--;
Line 50, "T9." should read --t9.--; and
Line 57, "100mm." should read --150 mm.--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 42:
Line 48, "not" should be deleted; and
Line 61, "two-side" should read --two-sided--.

COLUMN 43:
Line 61, "I.-CNT" should read --L-CNT--.

COLUMN 44:
Line 64, "displayed" should read --display--.

COLUMN 45:
Line 9, "$" should be deleted; and
Line 55, "incapable" should read --being incapable--.

COLUMN 46:
Line 31, "gizes" should read --gize--; and
Line 66, "stored" should read --store--.

UNITED STATES PATENT AND TRADEMARK OFFICE

CERTIFICATE OF CORRECTION

PATENT NO. : 5,006,890

DATED : April 9, 1991

INVENTOR(S) : Masato Ishida, et al.

It is certified that error appears in the above-identified patent and that said Letters Patent is hereby corrected as shown below:

COLUMN 48:

Line 12, "mean" should read --means--; and
Line 21, "line." should read --a line.--.

COLUMN 49:

Line 29, "uncharged" should read --an uncharged--; and
Line 39, "original" should read --original;--.

Signed and Sealed this

Second Day of February, 1993

*Attest:*

STEPHEN G. KUNIN

*Attesting Officer*

*Acting Commissioner of Patents and Trademarks*